US007989131B2

(12) United States Patent
Inoue et al.

(10) Patent No.: US 7,989,131 B2
(45) Date of Patent: Aug. 2, 2011

(54) TONER, DEVELOPER, IMAGE FORMING METHOD, IMAGE FORMING APPARATUS, PROCESS CARTRIDGE, AND TONER CONTAINER

(75) Inventors: Ryota Inoue, Mishima (JP); Shigeru Emoto, Numazu (JP); Naohiro Watanabe, Shizuoka (JP); Masahide Yamada, Numazu (JP); Akinori Saitoh, Numazu (JP); Masahiro Ohki, Iruma (JP); Tsunemi Sugiyama, Kashiwa (JP); Shinichi Wakamatsu, Numazu (JP); Takayuki Yoshii, Yokohama (JP); Eiji Sawamura, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 11/519,893

(22) Filed: Sep. 13, 2006

(65) Prior Publication Data

US 2007/0059626 A1 Mar. 15, 2007

(30) Foreign Application Priority Data

Sep. 15, 2005 (JP) ..... 2005-267942

(51) Int. Cl.
*G03G 9/08* (2006.01)

(52) U.S. Cl. ..... 430/108.8; 430/108.1; 430/123.5; 430/123.52; 430/137.17; 430/110.1; 399/159

(58) Field of Classification Search ..... 430/108.1, 430/108.8, 110.1, 123.5, 123.52, 137.17; 399/159

See application file for complete search history.

(56) References Cited

U.S. PATENT DOCUMENTS

| | | | |
|---|---|---|---|
| 5,400,123 | A | 3/1995 | Sato et al. |
| 5,426,495 | A | 6/1995 | Sawamura et al. |
| 5,602,651 | A | 2/1997 | Tabata et al. |
| 5,717,843 | A | 2/1998 | Tabata et al. |
| 5,745,664 | A | 4/1998 | Nomura et al. |
| 5,747,210 | A | 5/1998 | Emoto et al. |
| 5,774,232 | A | 6/1998 | Tabata et al. |
| 5,913,095 | A | 6/1999 | Takashima et al. |
| 5,999,789 | A | 12/1999 | Sawamura |
| 6,221,549 | B1 | 4/2001 | Emoto et al. |
| 6,287,246 | B1 | 9/2001 | Yoshii et al. |

(Continued)

FOREIGN PATENT DOCUMENTS

JP 2663016 6/1997

(Continued)

OTHER PUBLICATIONS

Machine generated translation of JP 2004-246345 published Sep. 2, 2004.*

(Continued)

*Primary Examiner* — Mark F Huff
*Assistant Examiner* — Peter L Vajda
(74) *Attorney, Agent, or Firm* — Oblon, Spivak, McClelland, Maier & Neustadt, L.L.P.

(57) ABSTRACT

A toner is provided including a binder resin and a wax having primarily C—H and C—C bonds, and having a melting point of 50 to 90° C., wherein the wax is present in a surface portion of the toner in an amount of from 0.1 to 4.0% by weight, wherein the amount of the wax is determined by Fourier transform infrared spectroscopy attenuated total reflectance (FTIR-ATR); and the use of the toner in an image forming method, image forming apparatus, developer and toner cartridge containing the toner.

22 Claims, 10 Drawing Sheets

U.S. PATENT DOCUMENTS

| | | | | |
|---|---|---|---|---|
| 6,335,137 | B1 | 1/2002 | Suzuki et al. | |
| 6,395,443 | B2 | 5/2002 | Kuroda et al. | |
| 6,468,706 | B2 | 10/2002 | Matsuda et al. | |
| 6,534,232 | B1 | 3/2003 | Matsuda et al. | |
| 6,544,704 | B1 | 4/2003 | Matsuda et al. | |
| 6,660,443 | B2 | 12/2003 | Sugiyama et al. | |
| 6,682,866 | B2 | 1/2004 | Sugiyama et al. | |
| 6,740,460 | B2 | 5/2004 | Tomita et al. | |
| 6,756,175 | B2 | 6/2004 | Yamada et al. | |
| 6,787,280 | B2 | 9/2004 | Yamashita et al. | |
| 6,800,412 | B2 | 10/2004 | Sugiyama et al. | |
| 6,824,945 | B2 | 11/2004 | Emoto et al. | |
| 6,835,519 | B2 | 12/2004 | Sugiyama et al. | |
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 6,936,390 | B2 | 8/2005 | Nanya et al. | |
| 6,946,229 | B2 | 9/2005 | Suzuki et al. | |
| 6,947,692 | B2 | 9/2005 | Kondo et al. | |
| 7,005,223 | B2 | 2/2006 | Yamashita et al. | |
| 7,024,923 | B2 | 4/2006 | Aze et al. | |
| 7,056,635 | B2 | 6/2006 | Tanaka et al. | |
| 7,056,636 | B2 | 6/2006 | Tomita et al. | |
| 7,056,638 | B1 | 6/2006 | Tomita et al. | |
| 7,074,535 | B2 | 7/2006 | Saito et al. | |
| 7,074,541 | B2 | 7/2006 | Yamashita et al. | |
| 7,083,890 | B2 | 8/2006 | Emoto et al. | |
| 2003/0027066 | A1 | 2/2003 | Yamashita et al. | |
| 2003/0055159 | A1 | 3/2003 | Yamashita et al. | |
| 2003/0096185 | A1 | 5/2003 | Yamashita et al. | |
| 2004/0053154 | A1 | 3/2004 | Tomita et al. | |
| 2004/0115551 | A1 | 6/2004 | Sugiyama et al. | |
| 2004/0131961 | A1 | 7/2004 | Watanabe et al. | |
| 2004/0157146 | A1 | 8/2004 | Tomita et al. | |
| 2004/0175640 | A1* | 9/2004 | Kawanishi et al. | 430/108.8 |
| 2004/0175641 | A1 | 9/2004 | Nanya et al. | |
| 2004/0209181 | A1 | 10/2004 | Higuchi et al. | |
| 2004/0224165 | A1 | 11/2004 | Kondoh et al. | |
| 2004/0229147 | A1 | 11/2004 | Higuchi et al. | |
| 2004/0259013 | A1 | 12/2004 | Ohtani et al. | |
| 2004/0265721 | A1 | 12/2004 | Matsuoka et al. | |
| 2005/0003288 | A1 | 1/2005 | Sugiyama et al. | |
| 2005/0003291 | A1 | 1/2005 | Takada et al. | |
| 2005/0008961 | A1 | 1/2005 | Takada et al. | |
| 2005/0026066 | A1 | 2/2005 | Tanaka et al. | |
| 2005/0031980 | A1 | 2/2005 | Inoue et al. | |
| 2005/0042534 | A1 | 2/2005 | Tanaka et al. | |
| 2005/0079433 | A1 | 4/2005 | Watanabe et al. | |
| 2005/0112488 | A1 | 5/2005 | Yamada et al. | |
| 2005/0164112 | A1 | 7/2005 | Ohki et al. | |
| 2005/0164114 | A1 | 7/2005 | Yagi et al. | |
| 2005/0180786 | A1 | 8/2005 | Yamada et al. | |
| 2005/0186498 | A1 | 8/2005 | Honda et al. | |
| 2005/0191574 | A1* | 9/2005 | Koike et al. | 430/109.4 |
| 2005/0196691 | A1 | 9/2005 | Ohtani et al. | |
| 2005/0207806 | A1 | 9/2005 | Yoshii et al. | |
| 2005/0250036 | A1 | 11/2005 | Emoto et al. | |
| 2005/0277044 | A1 | 12/2005 | Watanabe et al. | |
| 2005/0277045 | A1 | 12/2005 | Saito et al. | |
| 2005/0286938 | A1 | 12/2005 | Aze et al. | |
| 2006/0046174 | A1 | 3/2006 | Ohki et al. | |
| 2006/0056888 | A1 | 3/2006 | Sugiyama et al. | |
| 2006/0057488 | A1 | 3/2006 | Inoue et al. | |
| 2006/0063089 | A1 | 3/2006 | Tanaka et al. | |
| 2006/0068312 | A1 | 3/2006 | Yamashita et al. | |
| 2006/0099529 | A1 | 5/2006 | Tanaka et al. | |
| 2006/0127788 | A1 | 6/2006 | Yamashita et al. | |

FOREIGN PATENT DOCUMENTS

| | | | |
|---|---|---|---|
| JP | 10-207116 | A | 8/1998 |
| JP | 11-7156 | | 1/1999 |
| JP | 11-329700 | | 11/1999 |
| JP | 3225889 | | 8/2001 |
| JP | 2002-6541 | | 1/2002 |
| JP | 2002-268436 | | 9/2002 |
| JP | 2004-246345 | * | 2/2004 |
| JP | 2004-70046 | A | 3/2004 |
| JP | 3530058 | | 3/2004 |
| JP | 2004-101798 | A | 4/2004 |
| JP | 2004-143418 | A | 5/2004 |
| JP | 2004-151470 | A | 5/2004 |
| JP | 3577390 | | 7/2004 |
| JP | 2004-226669 | | 8/2004 |
| JP | 2004-246345 | | 9/2004 |
| JP | 2005-301199 | | 10/2005 |
| JP | 2006-11217 | | 1/2006 |

OTHER PUBLICATIONS

U.S. Appl. No. 12/026,937, filed Feb. 6, 2008, Seshita, et al.
U.S. Appl. No. 11/868,618, filed Oct. 8, 2007, Sugiyama, et al.
U.S. Appl. No. 12/046,011, filed Mar. 11, 2008, Nagatomo, et al.
U.S. Appl. No. 11/734,895, filed Apr. 13, 2007, Yamashita, et al.
U.S. Appl. No. 11/852,778, filed Sep. 10, 2007, Nagatomo, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.
Y. Ohtsuka, et al., "A Study on On-Demand Fusing Technology", pp. 61-64, w/English Abstract.
U.S. Appl. No. 11/206,128, filed Aug. 18, 2005.
U.S. Appl. No. 12/042,041, filed Mar. 4, 2008, Yamada, et al.
U.S. Appl. No. 12/046,941, filed Mar. 12, 2008, Awamura, et al.
U.S. Appl. No. 12/040,451, filed Feb. 29, 2008, Saitoh, et al.
U.S. Appl. No. 11/529,370, filed Sep. 29, 2006, Emoto, et al.
U.S. Appl. No. 12/203,278, filed Sep. 3, 2008, Yamada, et al.
U.S. Appl. No. 12/209,583, filed Sep. 12, 2008, Seshita, et al.

* cited by examiner

TONER, DEVELOPER, IMAGE FORMING METHOD, IMAGE FORMING APPARATUS, PROCESS CARTRIDGE, AND TONER CONTAINER

BACKGROUND OF THE INVENTION

1. Field of the Invention

The present invention relates to a toner for use in electrophotography. In addition, the present invention also relates to a developer, an image forming method, an image forming apparatus, a process cartridge, and a toner container.

2. Discussion of the Background

In electrophotography, an image is typically formed as follows:

(1) an electrostatic latent image is formed on a photoreceptor (i.e., an image bearing member);
(2) the electrostatic latent image is developed with a developer to form a visible image (i.e., a toner image);
(3) the visible image is transferred onto a recording medium such as paper; and
(4) the transferred image is fixed on the recording medium upon application of heat, pressure, solvent vapor, and/or the like thereto.

This method is disclosed in, for example, U.S. Pat. No. 2,297,691.

Developers used for electrophotography are classified into one-component developers consisting essentially of a magnetic toner or a non-magnetic toner, and two-component developers consisting essentially of a toner and a carrier. One-component developing methods, for which a one-component developer is used, are classified into magnetic one-component developing methods, in which a toner is held on a developing roller due to magnetic force, and non-magnetic one-component developing methods.

A toner is typically manufactured by a kneading-pulverization method in which a thermoplastic resin is melt-kneaded together with other toner constituents (such as colorants), followed by pulverization and classification. The thus prepared toner (hereinafter referred to as pulverization toner) is optionally mixed with a particulate inorganic or organic material to improve fluidity and cleanability thereof.

A pulverization toner is typically fixed on a recording medium upon application of heat thereto using a heat roller. When the temperature of the heat roller is too high, offset problem tends to be caused in that part of a fused toner is adhered to the surface of the heat roller. In contrast, when the temperature of the heat roller is too low, the toner cannot be sufficiently fused. Recently, demands for energy saving and downsizing of the apparatus have increased, and therefore a need exists for a toner which minimizes hot offset (this property is hereinafter referred to as hot offset resistance) and which can be fixed at low temperatures (this property is hereinafter referred to as low temperature fixability). Since full-color copiers and printers are required to produce images having good glossiness and color reproducibility, toners having a low melting point are preferably used therein. However, since such toners have poor hot offset resistance and poor thermostable preservability under high temperature and high humidity conditions, a fixing oil (such as silicone oil) is applied to the heat roller of the full-color machines to improve the releasability thereof. In this case, the machine needs an oil tank, a fixing oil applying system, and the like, and therefore the full-color machine must be larger and the fixing system becomes complicated. In addition, the heat roller is easily damaged, and therefore maintenance has to be constantly performed. There is another problem such that the oil applied to the heat roller tends to adhere to copier papers and overhead projection (OHP) films, resulting in deterioration of the color tone of the produced images.

In attempting to solve these problems, a technique in which a release agent (such as wax) is added to a toner is proposed and widely used to prevent the toner from adhering to the heat roller without applying an oil thereto. Releasability of the toner greatly depends upon dispersing conditions of the wax in the toner. When the wax is compatible with the binder resin used, the toner has no releasability. When the wax is incompatible with the binder resin and forms domains thereof in the toner, the toner has releasability. In this case, when the domains are too large, the amount of the wax existing near the surface of the toner relatively increases. Thereby, the toner particles tend to aggregate, resulting in deterioration of fluidity thereof. In addition, the wax tends to form films thereof on a carrier, a photoreceptor, and the like, after a long period of use, and therefore the image quality deteriorates. When the domains are too small, the wax is too excessively dispersed to impart good releasability to the toner.

It is difficult to control the size of the wax domain in pulverization toners. In addition, since the wax tends to exist at pulverized sections, i.e., the surface of the toner particles, the toner has poor fluidity and the wax forms films thereof on the other image forming members, as mentioned above. Pulverization toners have another drawback of typically having a broad particle diameter distribution. As a result, the toner cannot be uniformly friction-charged and tends to cause background fouling in that the background portion of an image is soiled with toner particles. It is difficult to obtain a pulverized toner having a volume average particle diameter of from 2 to 8 μm in terms of manufacturing efficiency. Because of these reasons, pulverized toners cannot satisfy the demands for producing high quality images.

On the other hand, toners manufactured in an aqueous medium have received attention recently. Because such toners have a narrow particle diameter distribution and a small particle diameter, high quality and high definition images can be produced. A release agent (such as wax) can be well dispersed therein, resulting in impartment of good hot offset resistance and low temperature fixability to the toner. The toner also has a uniform chargeability, and therefore transferability improves. In addition, because of having high fluidity, the toner has advantages in designing the developing system such that various hoppers can be used and the torque for rotating the developing roller can be decreased.

As toners manufactured in an aqueous medium (hereinafter referred to as chemical toners), suspension polymerization toners, emulsion aggregation toners, and the like are known.

In a suspension polymerization method, toner constituents such as a monomer, a polymerization initiator, a colorant, and a release agent are added to an aqueous medium containing a dispersing agent to form oil droplets, and then the oil droplets are heated so that the monomer therein is subjected to a polymerization reaction. The suspension polymerization method has an advantage of producing a toner having a small particle diameter. However, the suspension polymerization method has a drawback such that a dispersing agent, which tends to deteriorate chargeability of the resultant toner, is needed. When the aqueous medium contains no dispersing agent, the release agent tends to exist deep inside of the oil droplets, and therefore the resultant toner cannot have an adequate amount of the release agent on the surface thereof.

In the emulsion aggregation method, toner particles are prepared as follows:

(1) a binder resin (e.g., a polyester resin), which is dissolved in a solvent, is dispersed (emulsified) in an aqueous medium, and then the solvent is removed therefrom to prepare a dispersion of fine particles of the binder resin;

(2) the dispersion of fine particles of the binder resin are mixed with an aqueous dispersion of other toner constituents (such as a colorant, a release agent (e.g., a wax), and the like), so that fine particles of the binder resin and the toner constituents aggregate; and (3) the aggregated particles are heated to be fused, to prepare toner particles.

This method is disclosed in, for example, Japanese Patent No. (hereinafter referred to as JP) 3577390 and published unexamined Japanese Patent Application No. (hereinafter referred to as JP-A) 11-007156.

This method has an advantage of producing a toner having a sharp particle diameter distribution without performing classification, because ultra-fine toner particles are not produced, i.e., the emulsification is performed efficiently. However, if the fine particles of the binder resin are aggregated without application of heat, the fine particles cannot sufficiently be united with each other, resulting in the occurrence of fracture at interfaces between the particles constituting the resultant toner particles. Therefore, it is necessary to aggregate the fine particles upon application of heat. However, when the aggregated particles are heated, the wax tends to come out to the surface of the aggregated particles, and each of the dispersed wax particles tends to aggregate. As a result, the wax cannot be appropriately dispersed in the resultant toner. In particular, a release agent having a low melting point easily exudes from the aggregated particles when being heated. A toner including such a release agent has poor releasability, and therefore such a toner is not suitable for use in oilless heat roll fixing methods.

JP-A 2004-226669 discloses a toner, on a surface of which release agent particles which are covered with a vinyl polymer or into which a vinyl polymer penetrates are uniformly and firmly adhered, wherein the release agent particles are prepared by polymerizing a vinyl monomer using a water-soluble polymerization initiator in an emulsion of the release agent. The above release agent particles are added in an aqueous medium in which a toner constituent mixture is emulsified. In this method, it is necessary to polymerize the vinyl monomer. Since the vinyl polymer included in the release agent particles has a high glass transition temperature (Tg), there is a problem such that the resultant toner has poor releasability and low temperature fixability.

JP 2663016 discloses a toner obtained by subjecting a monomer liquid containing a material having a polar group and a release agent to a suspension polymerization. It is described therein that a wax having a low melting point, which cannot be used for the pulverization method, can be used for this method. It is also described therein that nonpolar components such as release agents tend not to exist near the surface of the toner particles whereas polar components tend to exist near the surface of the toner particles, and therefore the resultant toner has a pseudo-capsule structure. However, no mention is made of the real dispersing condition of the wax in the toner.

JP 3225889 discloses a toner including a wax in an amount of from 0.1 to 40% by weight, and at a surface of which the wax exists in an amount of from 1 to 10% by weight, based on the total amount of toner constituents existing at the surface of the toner. The amount of the wax existing at the surface of the toner is determined by ESCA (electron spectroscopy for chemical analysis). However, since the analyzable depth of ESCA is about 0.1 μm (i.e., only a surface region having a depth of 0.1 μm from the outermost surface of the toner can be analyzed with ESCA), the dispersing conditions of the wax existing deep inside of the toner are unknown.

JP-A 2002-6541 discloses a toner including wax particles which exist inside the toner particles while locally existing on the surface of the toner particles. However, no mention is made of detailed dispersing conditions of the wax particles existing near the surface of the toner.

JP-A 2004-246345 discloses a toner, on a surface of which a specific amount of wax exists. The amount of the wax existing on the surface of the toner is determined by FTIR-ATR (Fourier transform infrared spectroscopy attenuated total reflectance). However, it is difficult to improve fixability of the toner only by controlling the dispersing condition of the wax, while imparting a good combination of toner blocking resistance, hot offset resistance, toner filming resistance, and resistance to a paper winding problem such that a receiving paper sheet having a toner image thereon is wound round a fixing member due to adhesion of the toner image to the fixing member.

Because of these reasons, a need exists for a toner manufacturing method which can stably and efficiently produce a toner having a good combination of low temperature fixability, toner filming resistance, and thermostable preservability, and which can produce high quality images, while having advantages of the chemical toners such as small particle diameter, narrow particle diameter distribution, and high fluidity.

In typical fixing processes, heat pressure fixing methods are preferably used in which an unfixed toner image is melted upon application of heat and pressure by directly contacting a fixing member (such as a fixing roller and a fixing belt), and then fixed on a recording material (such as a paper). The heat pressure fixing methods have advantages in terms of thermal efficiency, simplicity of the fixing mechanism, and manufacturing cost of the fixing member.

JP-A 11-329700 discloses a belt fixing device adopting electromagnetic induction heating. The fixing device includes a fixing roller, a facing roller consisting of a non-magnetic material and arranged in parallel with the fixing roller, an endless fixing belt tightly stretched with the fixing roller and the facing roller, an induction coil configured to externally heat the fixing belt, and a pressing roller configured to press the fixing roller with the fixing belt therebetween. A recording paper having a toner image thereon passes through a nip formed between the fixing belt and the pressing roller so that the toner image is fixed on the recording paper by the heat of the fixing belt and the pressure of the pressing roller.

FIG. 1 is a schematic view illustrating the cross section of an embodiment of a typical fixing belt. The fixing belt includes a substrate 1, an exothermic layer 2, an elastic layer 3, and a release layer 4, wherein the layers 2, 3, and 4 are overlaid on the substrate 1 in this order.

The substrate consists of an endless belt made of a thermostable resin. Specific examples of the thermostable resins include, but are not limited to, polyimides, polyamideimides, polyetheretherketones (PEEK), etc. The substrate 1 typically has a thickness of from 20 to 100 μm in view of stiffness and thermal capacity thereof.

The exothermic layer 2 consists of a metal such as SUS, iron, nickel, manganese, titanium, chromium, and copper. The elastic layer 3 is necessary for improving uniformity of the produced images, and consists of a thermostable rubber, such as silicone rubbers and fluorocarbon rubbers, having a thickness of from 100 to 300 μm. The release layer 4 consists of a resin having good thermostability and durability such as fluorocarbon resins, because the release layer 4 contacts a transfer paper and a toner image under pressure.

In the fixing device disclosed in JP-A 11-329700, the fixing belt is merely heated with the induction coil while the temperature of the fixing belt is not controlled, and thereby hot offset tends to occur at both ends of the fixing belt. This is because when small-sized recording papers continuously pass through the fixing belt, the papers draw heat only from the central part of the fixing belt, and therefore the fixing belt is heated to raise the temperature of the central part. In this case, the temperature of both ends of the fixing belt excessively increases. As a result, hot offset tends to occur only at both ends of the fixing belt when large-sized papers pass through the fixing belt under such a condition.

In conventional fixing devices such as the fixing device disclosed in JP-A 11-329700, the facing roller contains bearings, which have large thermal capacity, at both ends. Therefore, although the fixing belt is heated with the induction coil, the heat diffuses into both ends (i.e., bearings) of the facing belt. As a result, the temperature rising speed of both ends of the facing belt is slower than that of the central part of the facing belt, as shown in FIG. 2. It takes a long time to start up such a fixing device.

JP-A 2002-268436 discloses a fixing device including an endless fixing belt which is tightly stretched with a fixing roller and a heat roller so as to have a small curvature radius at a fixing nip. The fixing belt endlessly moves while being heated with the heat roller and contacts a toner image formed on a transfer material upon application of pressure to fix the toner image thereon. The fixing belt includes a substrate consisting of a thermostable resin (such as polyimides) or a metal, an elastic layer consisting of a thermostable rubber or an elastomer, and a release layer serving as an outermost layer and consisting of a fluorocarbon resin. The release layer is formed by covering the elastic layer with a fluorocarbon resin tube which is prepared by extrusion, and then subjecting the fluorocarbon resin to heat treatment. The release layer can also be formed by applying a particulate fluorocarbon resin to the elastic layer using a spray and the like, and then subjecting the fluorocarbon resin to a heat treatment. A fixing belt having a release layer consisting of a fluorocarbon resin has good releasability and thermostability. In particular, such a fixing belt has great releasability, and therefore hot offset and paper winding problems hardly occur. However, fluorocarbon resins have poor flexibility. Therefore, when the fixing belt has a small curvature radius, cracks tend to appear on the release layer after long repeated use, resulting in deterioration of durability of the fixing belt.

Various attempts have been made to solve these problems. For example, a presentation entitled "A Study on On-Demand Fusing Technology (A-11)" was made at Japan Hardcopy '94 (The Annual Conference of the Society of Electrophotography of Japan, held on Jun. 23 and 24, 1994). However these attempts are not sufficient to solve the above problems.

Because of these reasons, a need exists for a fixing device which can produce a high quality images for a long period of time.

SUMMARY OF THE INVENTION

Accordingly, an object of the present invention is to provide a toner having a good combination of the following properties:

(1) releasability at low temperatures;
(2) toner filming resistance;
(3) low temperature fixability;
(4) thermostable preservability; and
(5) small particle diameter and narrow particle diameter distribution.

Another object of the present invention is to provide a developer which can stably produce high quality images.

Another object of the present invention is to provide an image forming method, an image forming apparatus, a process cartridge, and a toner container which can produce high quality images for a long period of time without causing hot offset problem.

These and other objects of the present invention, either individually or in combinations thereof, as hereinafter will become more readily apparent can be attained by a toner, comprising:

a binder resin; and a wax consisting essentially of C—H and C—C bonds, and having a melting point of 50 to 90° C., wherein the wax is present in a surface portion of the toner in an amount of from 0.1 to 4.0% by weight, wherein the amount of the wax is determined by Fourier transform infrared spectroscopy attenuated total reflectance (FTIR-ATR); and a developer, an image forming method, an image forming apparatus, a process cartridge, and a toner container including the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
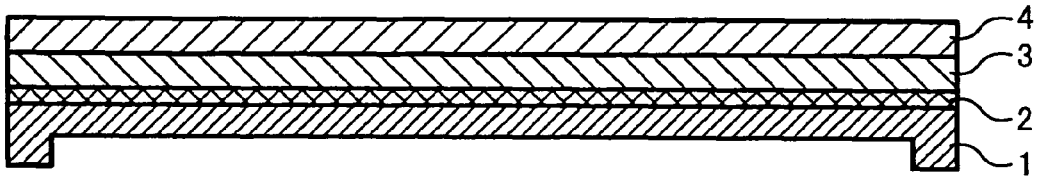
FIG. 1 is a schematic view illustrating a cross section of an embodiment of a typical fixing belt.
Figure 2:
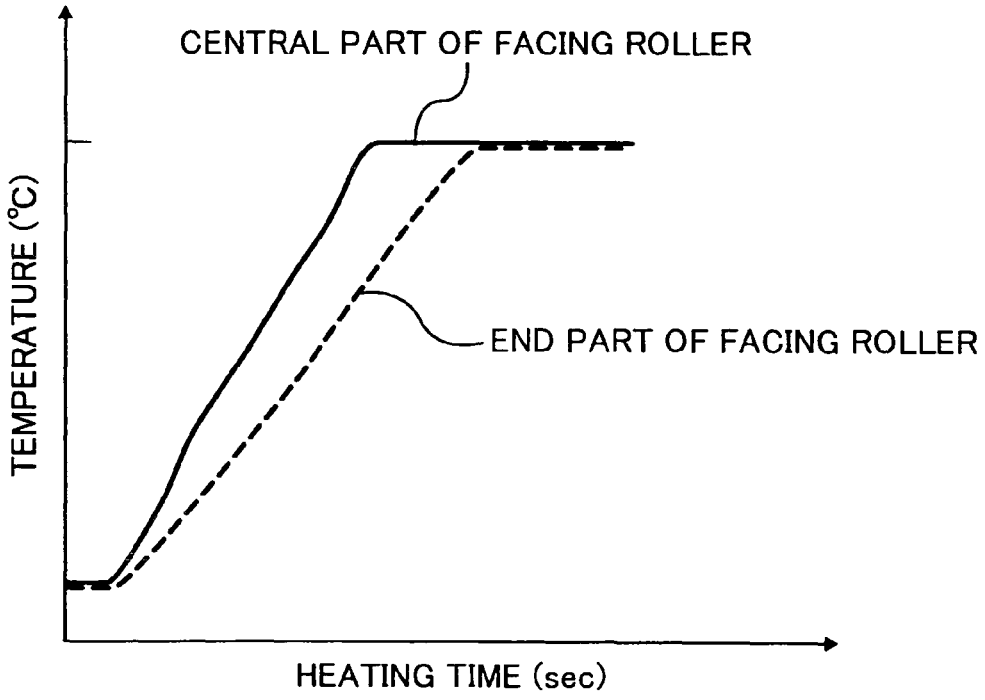
FIG. 2 is a graph illustrating the relationship between the heating time and the temperature of a facing roller.

The present invention relates to a toner, comprising:

a binder resin; and a wax consisting essentially of C—H and C—C bonds, and having a melting point of 50to 90° C., wherein the wax is present in a surface portion of the toner in an amount of from 0.1 to 4.0% by weight, wherein the amount of the wax is determined by a Fourier transform infrared spectroscopy attenuated total reflectance (FTIR-ATR) method.

Toner Manufacturing Method

The toner of the present invention is preferably manufactured by a method comprising:

dissolving or dispersing toner constituents in an oily medium to prepare a toner constituent mixture liquid; and emulsifying or dispersing the toner constituent mixture liquid in an aqueous medium to prepare a dispersion including toner particles.

Toner constituents for manufacturing the toner of the present invention preferably include a compound having an active hydrogen group, a polymer capable of reacting with the active hydrogen group, and a wax. The toner of the present invention is preferably manufactured by reacting the compound having an active hydrogen group with the polymer capable of reacting with the active hydrogen group. This toner manufacturing method will be explained in detail.

(1) Process for Preparing Toner Constituent Mixture Liquid (1-1) Toner Constituent Mixture Liquid The toner constituent mixture liquid is an oily medium in which toner constituents are dispersed.

Any known materials which can prepare a toner can be used as the toner constituents, and are not particularly limited. The toner constituents include at least one member selected from the group consisting of monomers, polymers, compounds having an active hydrogen group, and polymers (i.e., prepolymers) capable of reacting with the active hydrogen group; and a wax, and optionally include a colorant, a charge controlling agent, etc.

The toner constituent mixture liquid is preferably prepared by dissolving or dispersing toner constituents such as a compound having an active hydrogen group, a polymer capable of reacting with the active hydrogen group, a wax, a colorant, and a charge controlling agent, in an oily medium. The above toner constituents except for the polymer capable of reacting with the active hydrogen group may be added to after-mentioned aqueous medium when the aqueous medium is prepared, or when the toner constituent mixture liquid is added to the aqueous medium.

Any known oily media which can dissolve and/or disperse the toner constituents can be used, and are not particularly limited. The oily media preferably include organic solvents. It is preferable that the organic solvent is removed when mother toner particles are formed or after mother toner particles are formed. Volatile organic solvents having a boiling point of less than 150° C. are preferably used because such solvents can be easily removed. Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and the like, but are not limited thereto. Among these, toluene, xylene, benzene, methylene chloride, 1,2-dichloroethane, chloroform, and carbon tetrachloride, are preferably used, and ethyl acetate is most preferably used. These organic solvents can be used alone or in combination.

The toner constituent mixture liquid typically includes an organic solvent in an amount of from 40 to 300 parts by weight, preferably from 60 to 140 parts by weight, and more preferably from 80 to 120 parts by weight, based on 100 parts by weight of the toner constituents.

(1-2) Compound Having Active Hydrogen Group

The compound having an active hydrogen group acts as an elongation agent and/or a crosslinking agent when the polymer capable of reacting with the active hydrogen group is subjected to an elongation reaction and/or a crosslinking reaction.

Any known compounds having an active hydrogen group can be used as the compound having an active hydrogen group in the present invention, and are not particularly limited. For example, when a polymer capable of reacting with the active hydrogen group is the below-mentioned polyester prepolymer (A) having an isocyanate group, an amine (B) is preferably used as the compound having an active hydrogen group, because the amine (B) can react with the polyester prepolymer (A) having an isocyanate group so as to prepare a polymer by elongation reaction or crosslinking reaction.

Any known amines can be used as the amine (B) of the present invention. Specific examples of the amines (B) include, but are not limited to, diamines (B1), polyamines (B2) having three or more amino groups, amino alcohols (B3), amino mercaptans (B4), amino acids (B5) and blocked amines (B6) in which the amino groups in the amines (B1) to (B5) are blocked.

These can be used alone or in combination. Among these amines (B), diamines (B1) and mixtures in which a diamine (B1) is mixed with a small amount of polyamine (B2) are preferably used.

Specific examples of the diamines (B1) include, but are not limited to, aromatic diamines such as phenylene diamine, diethyltoluene diamine, and 4,4'-diaminodiphenyl methane; alicyclic diamines such as 4,4'-diamino-3,3'-dimethyldicyclohexyl methane, diaminocyclohexane, and isophoronediamine; aliphatic diamines such as ethylene diamine, tetramethylene diamine, and hexarnethylene diamine; etc.

Specific examples of the polyamines (B2) having three or more amino groups include, but are not limited to, diethylene triamine, triethylene tetramine, etc.

Specific examples of the amino alcohols (B3) include, but are not limited to, ethanolamine, hydroxyethyl aniline, etc.

Specific examples of the amino mercaptan (B4) include, but are not limited to, aminoethyl mercaptan, aminopropyl mercaptan, etc.

Specific examples of the amino acids (B5) include, but are not limited to, amino propionic acid, amino caproic acid, etc.

Specific examples of the blocked amines (B6) include, but are not limited to, ketimine compounds which are prepared by reacting one of the amines (B1) to (B5) with a ketone such as acetone, methyl ethyl ketone and methyl isobutyl ketone; oxazoline compounds, etc.

When the compound having an active hydrogen group and the polymer capable of reacting with the active hydrogen group are subjected to an elongation reaction and/or a crosslinking reaction, reaction auxiliary agents (i.e., catalysts) are preferably used. Specific examples of the catalysts include tertiary amine compounds, etc.

Any known tertiary amine compounds can be used as the catalyst in the present invention, and are not particularly limited. Among the tertiary amine compounds, a compound having the following formula (I) is preferably used:

(I)

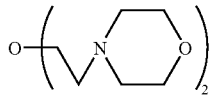

The tertiary amine compound functions not only as a catalyst, but also as an emulsification auxiliary agent when the toner constituent mixture liquid is dispersed in an aqueous medium.

When an elongation reaction and/or a crosslinking reaction between the compound having an active hydrogen group and the polymer capable of reacting with the active hydrogen is stopped, reaction stopping agents can be used. The reaction stopping agents are preferably used in terms of controlling the molecular weight of the reaction product (i.e., the resultant binder resin).

Specific examples of the reaction stopping agents include, but are not limited to, monoamines such as diethyl amine, dibutyl amine, butyl amine and lauryl amine; and blocked amines, i.e., ketimine compounds prepared by blocking the monoamines mentioned above.

The mixing ratio (i.e., an equivalent ratio [NCO]/[NHx]) of the content of the polyester prepolymer (A) having an isocyanate group to the amine (B) is from 1/3 to 3/1, preferably from 1/2 to 2/1, and more preferably from 1/1.5 to 1.5/1.

When the mixing ratio is too small, low temperature fixability of the resultant toner deteriorates. When the mixing ratio is too large, the resultant urea-modified polyester resin has too low a molecular weight, resulting in deterioration of hot offset resistance of the resultant toner.

(1-3) Polymer Capable of Reacting with Active Hydrogen Group (Prepolymer)

As the polymer capable of reacting with an active hydrogen group, i.e., prepolymer, any known compounds having a site capable of reacting with an active hydrogen group can be used, and are not particularly limited. Specific examples of such polymers include polyol resins, polyacrylic resins, polyester resins, epoxy resins, and derivative resins thereof, but are not limited thereto.

These resins can be used alone or in combination. Among these resins, polyester resins are preferably used because of having high fluidity and transparency when the resin is melted.

As the site capable of reacting with an active hydrogen group, which is included in the prepolymer, any known functional group can be used. Specific examples of the functional groups include, but are not limited to, isocyanate group, epoxy group, carboxylic group, acid chloride group, etc.

These functional groups can be included in the prepolymer alone or in combination. Among these, isocyanate group is most preferably included therein.

Among the prepolymers, a polyester resin (RMPE) having a functional group capable of forming a urea bond is preferably used. It is easy to control the molecular weight of the resultant resin when such a polyester resin is used, and therefore the resultant resin can impart good releasability and fixability to the resultant toner even if the fixing device includes no oil applying system, which applies a release oil to the heating medium for fixing.

Specific examples of the functional groups capable of forming a urea bond include isocyanate group, but are not limited thereto. When a RMPE includes an isocyanate group as the functional group capable of forming a urea bond, the polyester prepolymer (A) having an isocyanate group is preferably used as the RMPE.

Specific examples of the polyester prepolymers (A) having an isocyanate group include compounds obtained by reacting (1) a base polyester formed by polycondensation reaction between a polyol (PO) and a polycarboxylic acid (PC), and having an active hydrogen group, with (2) a polyisocyanate (PIC), but are not limited thereto.

Specific examples of the active hydrogen group, which is included in the base polyester, include hydroxyl group (alcoholic hydroxyl group and phenolic hydroxyl group), amino group, carboxyl group, mercapto group, etc., but are not limited thereto. These active hydrogen groups can be included in the base polymer alone or in combination. Among these, alcoholic hydroxyl group is preferably included in the base polyester.

As the polyol (PO), diols (DIO), polyols (TO) having three or more valences, and mixtures thereof can be used, and diols (DIO) alone or mixtures of a diol and a small amount of a polyol are preferably used.

Specific examples of the diols (DIO) include, but are not limited to, alkylene glycols, alkylene ether glycols, alicyclic diols, adducts of the alicyclic diols with an alkylene oxide, bisphenols, adducts of the bisphenols with an alkylene oxide, etc.

Specific examples of the alkylene glycols include, but are not limited to, ethylene glycol, 1,2-propylene glycol, 1,3-propylene glycol, 1,4-butanediol, 1,6-hexanediol, etc., which has 2 to 12 carbon atoms.

Specific examples of the alkylene ether glycols include, but are not limited to, diethylene glycol, triethylene glycol, dipropylene glycol, polyethylene glycol, polypropylene glycol, polytetramethylene ether glycol, etc.

Specific examples of the alicyclic diols include, but are not limited to, 1,4-cyclohexanedimethanol, hydrogenated bisphenol A, etc.

Specific examples of the adducts of the alicyclic diols with an alkylene oxide include, but are not limited to, the adducts of the alicyclic diol with ethylene oxide, propylene oxide, butylenes oxide, etc.

Specific examples of the bisphenols include, but are not limited to, bisphenol A, bisphenol F, bisphenol S, etc.

Specific examples of the adducts of the bisphenols with an alkylene oxide include, but are not limited to, the adducts of the bisphenol with ethylene oxide, propylene oxide, butylenes oxide, etc.

Among these, alkylene glycols having 2 to 12 carbon atoms and adducts of bisphenols with an alkylene oxide are preferably used, and a mixture thereof is more preferably used.

Specific examples of the polyols (TO) having three or more valences include, but are not limited to, multivalent aliphatic alcohols having three or more valences, polyphenols having three or more valences, adducts of the polyphenols having three or more valences with an alkylene oxide, etc.

Specific examples of the multivalent aliphatic alcohols having three or more valences include, but are not limited to, glycerin, trimethylolethane, trimethylolpropane, pentaerythritol, sorbitol, etc.

Specific examples of the polyphenols having three or more valences include, but are not limited to, trisphenol PA, phenol novolac, cresol novolac, etc.

Specific examples of the adducts of the polyphenols having three or more valences with an alkylene oxide include, but are not limited to, the adducts of the polyphenols having three or more valences with ethylene oxide, propylene oxide, butylenes oxide, etc.

The mixing ratio (i.e., DIO/TO) of the content of the diol (DIO) to the polyol (TO) having three or more valences is preferably from 100/0.01 to 100/10, and more preferably from 100/0.01 to 100/1.

As the polycarboxylic acid (PC), dicarboxylic acids (DIC) and polycarboxylic acids (TC) having three or more valences, and mixtures thereof can be used. Dicarboxylic acids (DIC) alone, or mixtures of a dicarboxylic acid and a small amount of a polycarboxylic acid are preferably used.

Specific examples of the dicarboxylic acids (DIC) include, but are not limited to, alkylene dicarboxylic acids, alkenylene dicarboxylic acids, aromatic dicarboxylic acids, etc.

Specific examplcs of the alkylene dicarooxylic acids include, but are not limited to, succinic acid, adipic acid, sebacic acid, etc.

Specific examples of the alkenylene dicarboxylic acids include, but are not limited to, maleic acid, fumaric acid, etc., which has 4 to 20 carbon atoms.

Specific examples of the aromatic dicarboxylic acids include, but are not limited to, phthalic acid, isophthalic acid, terephthalic acid, naphthalene dicarboxylic acid, etc., which has 8 to 20 carbon atoms.

Among these, alkenylene dicarboxylic acids having 4 to 20 carbon atoms and aromatic dicarboxylic acids having 8 to 20 carbon atoms are preferably used.

Specific examples of the polycarboxylic acid (TC) having three or more valences include, but are not limited to, aromatic polycarboxylic acids, etc.

Specific examples of the aromatic polycarboxylic acids include, but are not limited to, trimellitic acid, pyromellitic acid, etc., which has 9 to 20 carbon atoms.

As the polycarboxylic acid (PC), acid anhydrides and lower alkyl esters of one member selected from the group consisting of dicarboxylic acids (DIC), polycarboxylic acids (TC) having three or more valences, and mixtures thereof, can also be used. Suitable lower alkyl esters include, but are not limited to, methyl esters, ethyl esters, and isopropyl esters.

The mixing ratio (i.e., DIC/TC) of the content of the dicarboxylic acid (DIC) to the polycarboxylic acid (TC) having three or more valences is preferably from 100/0.01 to 100/10, and more preferably from 100/0.01 to 100/1.

A polyol (PO) and a polycarboxylic acid (PC) are mixed so that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polyester prepolymer (A) having an isocyanate group preferably includes a polyol (PO) unit in an amount of from 0.5 to 40% by weight, more preferably from 1 to 30% by weight, and much more preferably from 2 to 20% by weight, but the content of the polyol (PO) unit is not particularly limited.

When the content is too small, hot offset resistance of the resultant toner deteriorates and the toner cannot have a good combination of thermostable preservability and low temperature fixability. When the content is too large, low temperature fixability of the resultant toner deteriorates.

Specific examples of the polyisocyanates (PIC) include, but are not limited to, aliphatic polyisocyanates, alicyclic polyisocyanates, aromatic diisocyanates, aromatic aliphatic diisocyanates, isocyanurates, the above-mentioned polyisocyanates blocked with phenol derivatives, oxime, caprolactam, etc.

Specific examples of the aliphatic polyisocyanates include, but are not limited to, tetramethylene diisocyanate, hexamethylene diisocyanate, 2,6-diisocyanatemethyl caproate, octamethylene diisocyanate, decamethylene diisocyanate, dodecamethylene diisocyanate, tetradecamethylene diisocyanate, trimethylhexane diisocyanate, tetramethylhexane diisocyanate, etc.

Specific examples of the alicyclic polyisocyanates include, but are not limited to, isophorone diisocyanate, cyclohexylmethane diisocyanate, etc.

Specific examples of the aromatic diisocyanates include, but are not limited to, tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, diphenylether-4,4'-diisocyanate, etc.

Specific examples of the aromatic aliphatic diisocyanates include, but are not limited to, $\alpha,\alpha,\alpha',\alpha'$-tetramethylxylylene diisocyanate, etc.

Specific examples of the isocyanurates include, but are not limited to, tris-isocyanatoalkyl-isocyanurate, triisocyanatocycloalkyl-isocyanurate, etc.

These can be used alone or in combination.

A polyisocyanate (PIC) is mixed with a polyester resin having an active hydrogen group (e.g., a polyester resin having a hydroxyl group) so that the equivalent ratio ([NCO]/[OH]) between an isocyanate group [NCO] and polyester having a hydroxyl group [OH] is typically from 5/1 to 1/1, preferably from 4/1 to 1.2/1 and more preferably from 3/1 to 1.5/1.

When the ratio [NCO]/[OH] is too large, low temperature fixability of the resultant toner deteriorates. When the ratio [NCO]/[OH] is too small, hot offset resistance of the resultant toner deteriorates.

The polyester prepolymer (A) having an isocyanate group preferably includes a polyisocyanate (PIC) unit in an amount of from 0.5 to 40% by weight, preferably from 1 to 30% by weight, and more preferably from 2 to 20% by weight.

When the content is too small, hot offset resistance of the resultant toner deteriorates and the toner cannot have a good combination of thermostable preservability and low temperature fixability. When the content is too large, low temperature fixability of the resultant toner deteriorates.

The average number of the isocyanate groups included in a molecule of the polyester prepolymer (A) is preferably 1 or more, more preferably from 1.2 to 5, and much more preferably from 1.5 to 4.

When the number of isocyanate groups is less than 1 per molecule, the molecular weight of the urea-modified polyester decreases and hot offset resistance of the resultant toner deteriorates.

The polymer capable of reacting with an active hydrogen group preferably has a weight average molecular weight (Mw) of from 3,000 to 40,000, and more preferably from 4,000 to 30,000, when the molecular weight distribution of the tetrahydrofuran (THF) soluble components of the above polymer is determined by gel permeation chromatography (GPC). When the Mw is too small, thermostable preservability of the resultant toner deteriorates. When the Mw is too large, low temperature fixability of the resultant toner deteriorates.

The molecular weight distribution can be measured with a gel permeation chromatography (GPC) system such as HLC-8220GPC (manufactured by Tosoh Corporation) by the following method:

(1) columns are stabilized in a heat chamber at a temperature of 40° C., and THF (i.e., column solvent) flows therein at a flow rate of 1 ml/min; and (2) from 50 to 200 μl of a sample solution of THF having a concentration of from 0.05 to 0.6% by weight is injected to the columns.

A molecular weight is calculated from a calibration curve (i.e., a relationship between molecular weight and count number) prepared using standard monodisperse polystyrenes. For example, standard monodisperse polystyrenes (manufactured by Pressure Chemical Co. or Tosoh Corporation) having a molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$, can be used. It is preferable that at least 10 standard monodisperse polystyrenes are used for preparing the calibration curve. As a detector, a refractive index detector (RI) can be used.

(1-4) Wax

Long-chain hydrocarbons consisting essentially of C—H bonds and C—C bonds are preferably used as the wax used for the toner of the present invention.

Specific examples of the long-chain hydrocarbons include, but are not limited to, paraffin waxes, polyethylene waxes, polypropylene waxes, SASOL waxes, etc. Among these waxes, paraffin waxes are preferably used because of having a low melting point, which can impart low temperature fixability to the resultant toner.

The wax for use in the present invention preferably has a melting point of from 50 to 90° C., and preferably from 60 to 85° C., in terms of improving low temperature fixability of the resultant toner.

When the melting point is too low, thermostable preservability of the resultant toner deteriorates. When the melting point is too high, cold offset tends to occur when the resultant toner is fixed at low temperatures.

The dispersion state of the wax is defined by the total amount of the wax included in the toner, and the amount of the wax existing at the surface of the toner.

The total amount of the wax included in the toner can be determined by DSC (differential scanning calorimetry). In particular, a wax and a toner including the wax are independently subjected to DSC measurement to determine the endothermic heat quantity specific to the wax, and the ratio between each of the above endothermic heat quantities is calculated. The measurement conditions are as follows:

Measurement instrument: DSC-60 (manufactured by Shimadzu Corporation)

Sample amount: about 5 mg

Temperature rising speed: 10° C./min

Measurement range: from room temperature to 150° C.

Measurement environment: nitrogen gas atmosphere

The total amount of the wax included in the toner is calculated by the following equation (1):

$$W_{total}=(Q_T/Q_w)\times100 \quad (1)$$

wherein $W_{total}$ (% by weight) represents the total amount of the wax included in the toner, $Q_T$(J/g) represents the endothermic heat quantity specific to the wax included in the toner, and $Q_w$(J/g) represents the endothermic heat quantity specific to the wax.

Even if a part of the wax flows out in the toner manufacturing process and is not incorporated in the resultant toner, the total amount of the wax actually included in the toner can be effectively determined by the above-mentioned method.

The amount of the wax existing at the surface of the toner can be determined by FTIR-ATR (Fourier transform infrared spectroscopy attenuated total reflectance). Since the analysis depth of FTIR-ATR is about 0.3 μm, the amount of the wax existing in a surface region having a depth of 0.3 μm from the outermost surface of the toner can be analyzed. At first, 3 g of a toner is pelletized with an automatic pelletizer (TYPE M No. 50 BRP-E manufactured by Maekawa Testing Machine MFG. Co. Ltd.) for 1 minute at a load of 6 t, to prepare a pellet having a diameter of 40 mm (a thickness of about 2 mm), and then the surface of the pellet is subjected to FTIR-ATR analysis. The measurement conditions are as follows:

Measurement instrument: SPECTRUM ONE (manufactured by Perkin Elmer, Inc.) attaching MULTI SCOPE FTIR unit Measurement mode: micro ATR Crystal: Ge (germanium) crystal having a diameter of 100 μm Incidence angle of infrared light: 41.5°

Resolution: 4 $cm^{-1}$

Quantity survey: 20 times

An absorption peak specific to the wax is observed at a wave number of 2850 $cm^{-1}$,and that specific to the binder resin is observed at a wave number of 828 $cm^{-1}$. The ratio between the above peak intensities (P2850/P828) represents the relative amount of the wax existing at the surface of the toner. The measurement is performed 4 times, and the measurement values are averaged.

The amount of the wax existing at the surface of the toner is calculated using a calibration curve (i.e., a relationship between absolute amount of the wax and relative amount thereof) prepared using samples in which a known amount of the wax is dispersed.

Different toners (i.e., toners manufactured by different methods, toners having different dispersing conditions of the wax, etc.) have different relationships between the total amount of the wax determined by DSC (hereinafter referred to as DSC total wax quantity) and the amount of the wax existing at the surface of the toner determined by FTIR-ATR (hereinafter referred to as FTIR-ATR surface wax quantity). For example, in a toner having the preferred embodiment of the present invention (i.e., a toner manufactured by a method comprising dispersing a toner constituent mixture liquid, in which a compound having an active hydrogen group, a polymer capable of reacting with the active hydrogen group, a polyester, a colorant, and a wax are dissolved or dispersed in an organic solvent, in an aqueous medium containing a particulate resin while subjecting the polymer to an elongation and/or a crosslinking reaction), the wax is dispersed inside the toner and does not exist at the surface of the toner. Such toners have been prepared, each of which includes different amount of the wax, and the relationship between the DSC total wax quantity and the FTIR-ATR surface wax quantity checked. The results were as follows. In a region in which the DSC total wax quantity is small, the FTIR-ATR surface wax quantity (represented by the peak intensity ratio P2850/P828) is constantly 0. The FTIR-ATR surface wax quantity starts to increase when the DSC total wax quantity has a specific value. This phenomenon supports the fact that the wax does not selectively exist near the surface of the toner and uniformly disperse inside the surface region of the toner. The wax existing in a surface region having a depth of 0.3 μm from the outermost surface of the toner, the amount of which is determined by FTIR-ATR, can easily exude from the toner to the surface thereof and imparts releasability to the toner.

The FTIR-ATR surface wax quantity is preferably from 0.1 to 4% by weight. When the FTIR-ATR surface wax quantity is too small, the amount of the wax existing near the surface of the toner is too small, and therefore the toner cannot sufficiently release from fixing members. When the FTIR-ATR surface wax quantity is too large, the amount of the wax existing near the surface of the toner is too large, i.e., too large an amount of the wax is exposed at the outermost surface of the toner. It is more preferable that the FTIR-ATR surface wax quantity is from 0.1 to 3% by weight, in order that the toner may have a good combination of hot offset resistance, chargeability, developability, and toner blocking resistance.

The FTIR-ATR surface wax quantity of the toner can be controlled by changing conditions such as the amount of the wax added to the toner, wax dispersing time, usage of wax dispersing agent, etc.

The DSC total wax quantity is preferably from 0.5 to 21% by weight, and more preferably from 0.5 to 20% by weight. When the DSC total wax quantity is too small, the toner includes too small an amount of the wax, and therefore the toner cannot sufficiently release from fixing members, resulting in deterioration of hot offset resistance. When the DSC total wax quantity is too large, toner blocking resistance of the toner deteriorates and the produced color images have low glossiness.

Figure 3:
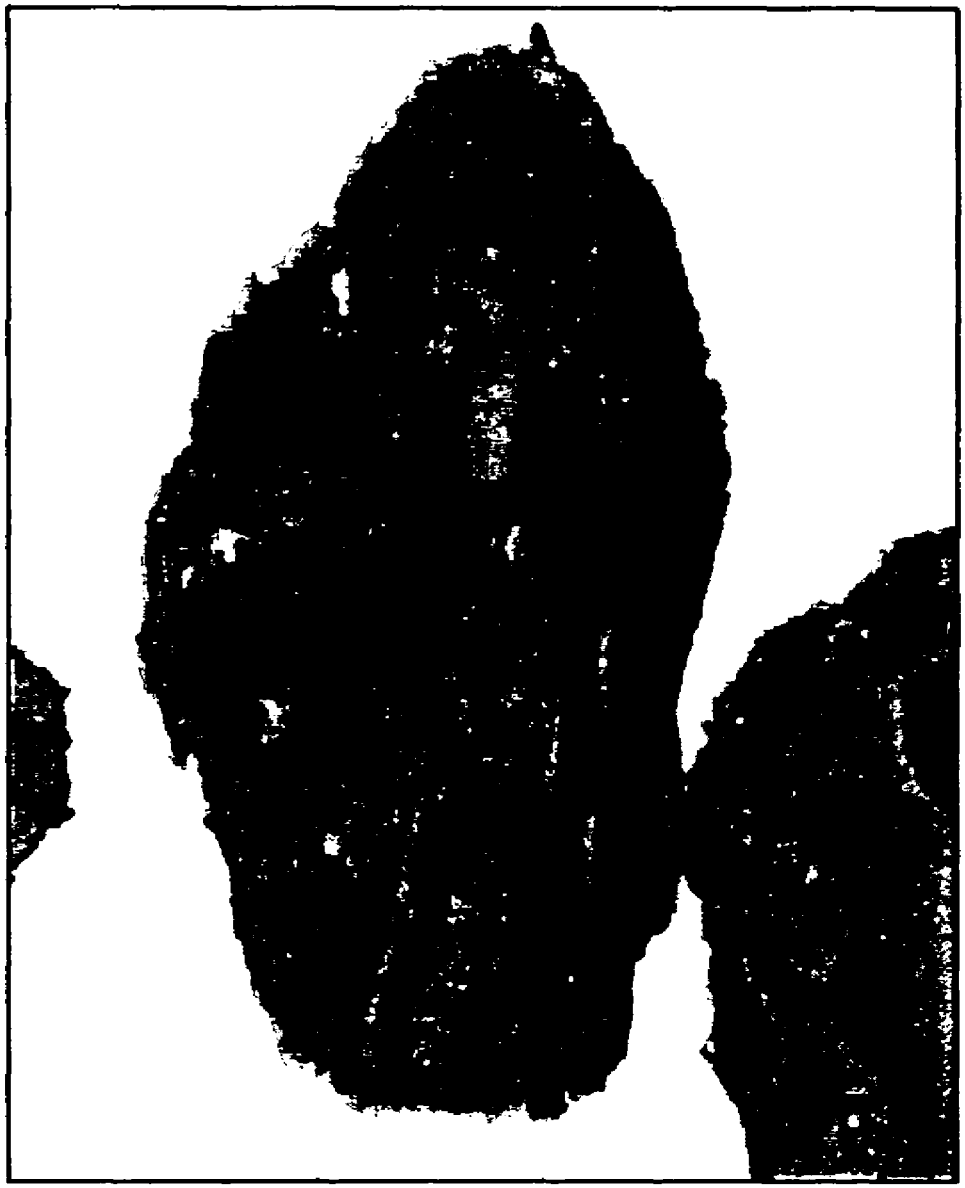
FIG. 3 is a cross section image of an embodiment of the toner of the present invention obtained by a transmission electron microscope (TEM)

Whether at least a part of a wax is incorporated and dispersed in toner particles as plural independent wax particles, the dispersing state of the wax can be determined using transmission electron microscope (TEM). In particular, a toner is embedded in an epoxy resin so as to be cut into an ultrathin section having a thickness of about 100 nm. The ultrathin section is stained with ruthenium tetroxide to distinguish a resin phase and a wax phase. The thus prepared sample is observed with a transmission electron microscope (TEM) at a magnification of 10,000 times to obtain cross section images. FIG. 3 is a cross section image of an embodiment of the toner of the present invention obtained by a TEM. It is clear from FIG. 3 that the wax particles are dispersed throughout the toner particle. Such a wax dispersion state imparts good hot offset resistance to the toner even if the amount of the wax is small, and does not deteriorate chargeability, developability, and toner blocking resistance.

Wax particles are preferably uniformly dispersed in a toner particle. In other words, plural wax particles are preferably not unevenly distributed in a toner particle. For example, in a cross section of a toner including the center of the toner, greater than 30% by number and not greater than 60% by number of the wax particles, based on total wax particles included in the cross section, are preferably included in a region circumscribed by points of which a distance from the toner center is two thirds of the particle radius, which connects the toner center and a point on the circumference of the toner. It is preferable that the total surface area of the toner includes an area in which the wax exists in an amount of not greater than 5%.

In the toner constituent mixture liquid, wax particles are dispersed in an oily medium.

The wax particles are preferably fine particles having a volume average particle diameter of from 0.1 to 2 μm, and preferably from 0.1 to 1 μm, but the volume average particle diameter is not limited thereto. When the volume average particle diameter is too small, the toner has poor releasability. When the volume average particle diameter is too large, the wax particles cannot be uniformly dispersed in the toner particles.

(1-5) Other Toner Constituents

The toner of the present invention may include colorant, charge controlling agent, particulate inorganic material, fluidity improving agent, cleanability improving agent, magnetic material, metal soap, etc., if desired.

Colorant

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The toner preferably includes a colorant in an amount of from 1 to 15% by weight, and more preferably from 3 to 10% by weight.

When the amount of the colorant is too small, the coloring power of the resultant toner deteriorates. When the amount of the colorant is too large, the colorant cannot be sufficiently dispersed in the toner, resulting in deterioration of coloring power and electrical property of the resultant toner.

The colorant for use in the present invention can be combined with a resin to be used as a master batch. Specific examples of the resin for use in the master batch include, but are not limited to, styrene polymers and substituted styrene polymers, styrene copolymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

Specific examples of the styrene polymers and substituted styrene polymers include, but are not limited to, polystyrenes, poly-p-chlorostyrenes, polyvinyltoluenes, etc. Specific examples of the styrene copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers, etc.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

Charge Controlling Agent

Any known charge controlling agents can be used for the toner of the present invention, and are not particularly limited. However, since colored materials tend to change color tone of the resultant toner, colorless materials or whitish materials are preferably used. Specific examples of such charge controlling agents include triphenylmethane dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto. These can be used alone or in combination.

Specific examples of commercially available charge controlling agents include, but are not limited to, BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; quinacridone, azo pigments and polymers having a functional group such as a sulfonate group, a carboxyl group, a quaternary ammonium group, etc.

The charge controlling agent can be melt-kneaded with a master batch or a binder resin, or directly dissolved in an organic solvent, or fixed on the surface of the toner.

The content of the charge controlling agent is determined depending on the species of the binder resin used, whether or not an additive is added, and dispersing method used, and is not particularly limited. However, the content of the charge controlling agent is typically from 0.1 to 10 parts by weight, and preferably from 0.2 to 5 parts by weight, based on 100 parts by weight of the binder resin included in the toner. When the content is too small, the toner has poor chargeability. When the content is too large, the toner has too large a charge quantity, and thereby the electrostatic force of a developing roller attracting the toner increases, resulting in deterioration of the fluidity of the toner and image density of the toner images.

Fluidity Improving Agent

Any known particulate inorganic materials can be mixed with the toner of the present invention to improve fluidity. Specific examples of such particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

The particulate inorganic material preferably has a primary particle diameter of from 5 nm to 2 μm, and more preferably from 5 nm to 500 nm, and a specific surface area of from 20 to 500 $m^2/g$ when measured by BET method.

The content of the particulate inorganic material is preferably from 0.01% to 5.0% by weight, and more preferably from 0.01% to 2.0% by weight, based on the total weight of the toner.

The above particulate inorganic materials are preferably surface-treated to improve the hydrophobicity thereof. Such a surface-treated inorganic material can prevent deterioration of fluidity and chargeability of the toner even under high humidity conditions. Specific examples of surface treatment agents include, but are not limited to, silane coupling agents, silylation agents, silane coupling agents having a fluorinated alkyl group, organic titanate coupling agents, aluminum coupling agents, silicone oils, modified silicone oils, etc.

Cleanability Improving Agent

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agents include, but are not limited to, fatty acids and their metal salts such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent.

Magnetic Material

Any known magnetic materials can be used for the toner of the present invention, and are not particularly limited. Specific examples of the magnetic materials include, but are not limited to, iron powder, magnetite, ferrite, etc. Whitish materials are preferably used in terms of color tone of the toner.

(2) Process for Preparing Toner Particles

The toner constituent mixture liquid is emulsified or dispersed in an aqueous medium to prepare toner particles.

(2-1) Aqueous Medium

Any known aqueous media can be used in the present invention, and are not particularly limited. Specific examples of the aqueous media include, but are not limited to, water, solvents which can be mixed with water, mixtures thereof, etc. Among these, water is preferably used.

Specific examples of the solvents which can be mixed with water include, but are not limited to, alcohols, dimethylformamide, tetrahydrofuran, cellosolves, lower ketones, etc.

Specific examples of the alcohols include, but are not limited to, methanol, isopropanol, ethylene glycol, etc. Specific examples of the lower ketones include, but are not limited to, acetone, methyl ethyl ketone, etc.

These can be used alone or in combination.

The toner constituent mixture liquid is preferably dispersed in an aqueous medium under agitation of the aqueous medium. Any known dispersing methods can be used, and are not particularly limited. For examples, known dispersing machines can be used. Specific examples of the dispersing machines include, but are not limited to, low shearing force type dispersing machines, high shearing force type dispersing machines, friction type dispersing machines, high pressure jet type dispersing machines, ultrasonic dispersing machines, etc. Among these, high shearing force type dispersing machines are preferably used, because the particle diameter of the dispersing element can be easily controlled.

(2-2) Particulate Organic Resin

In the present invention, toner particles are preferably manufactured in an aqueous medium in the presence of a particulate organic resin. In this case, it is possible to control shape and particle diameter distribution of the resultant toner, i.e., a toner having a narrow particle diameter distribution can be prepared.

The particle diameter of the toner can be controlled by changing the amount of the particulate organic resin which is added to the aqueous medium. The dispersion of the toner particles preferably includes the particulate organic resin in an amount of from 0.5 to 10% by weight, but the amount is not limited thereto.

Any known resins capable of forming an aqueous dispersion thereof can be used for the particulate organic resin of the present invention, and are not particularly limited. Both thermoplastic resins and thermosetting resins can be used. Specific examples of the resins for use in the particulate organic resin include, but are not limited to, vinyl resins, polyurethane resins, epoxy resins, polyester resins, polyamide resins, polyimide resins, silicon resins, phenol resins, melamine resins, urea resins, aniline resins, ionomer resins, polycarbonate resins, etc.

These resins can be used alone or in combination. Among these resins, vinyl resins, polyurethane resins, epoxy resins, polyester resins, and mixtures thereof are preferably used because these resins can easily form an aqueous dispersion of fine particles thereof.

Specific examples of the vinyl resins include, but are not limited to, homopolymers and copolymers of a vinyl monomer such as styrene-(meth)acrylate copolymers, styrene-butadiene copolymers, (meth)acrylic acid-acrylate copolymers, styrene-acrylonitrile copolymers, styrene-maleic anhydride copolymers, and styrene-(meth)acrylic acid copolymers.

As the particulate organic resins, copolymers comprising a monomer having at least 2 unsaturated groups can be used.

Specific examples of the copolymers comprising a monomer having at least 2 unsaturated groups include, but are not limited to, sodium salts of sulfate of an ethylene oxide adduct of methacrylic acid (e.g., ELEMINOL RS-30 from Sanyo Chemical Industries Ltd.), divinylbenzene, 1,6-hexanediol acrylate, etc.

The particulate organic resin can be polymerized by any known method, and is preferably prepared as an aqueous dispersion thereof. Suitable methods for forming an aqueous dispersion of an organic particulate resin are as follows, but are not limited thereto:

(1) When the resin is a vinyl resin, an aqueous dispersion of a particulate resin is directly formed by polymerization reaction (such as suspension polymerization, emulsion polymerization, seed polymerization, and dispersion polymerization) of monomers in an aqueous medium.

(2) When the resin is a polyaddition resin or a polycondensation resin such as polyester resin, polyurethane resin, and epoxy resin, a precursor of the resin (such as monomer and oligomer) or a solvent solution of the precursor is dispersed in an aqueous medium in the presence of a suitable dispersing agent, followed by heating or adding a curing agent so that an aqueous dispersion of a particulate resin is formed.

(3) When the resin is a polyaddition resin or a polycondensation resin such as polyester resin, polyurethane resin, and epoxy resin, a precursor of the resin (such as monomer and oligomer, preferably in liquid form, if not liquid, preferably liquefied by the application of heat) or a solvent solution of the precursor is phase-inversion emulsified by adding an aqueous medium after adding a suitable emulsifying agent thereto so that an aqueous dispersion of a particulate resin is formed.

(4) A resin formed by polymerization reaction (such as addition polymerization, ring-opening polymerization, condensation polymerization, addition condensation, etc.) is pulverized using a mechanical rotational type pulverizer or a jet type pulverizer, followed by classification, to prepare a particulate resin. The particulate resin is dispersed in an aqueous medium in the presence of a suitable dispersing agent so that an aqueous dispersion of the particulate resin is formed.

(5) A resin formed by polymerization reaction (such as addition polymerization, ring-opening polymerization, condensation polymerization, addition condensation, etc.) is dissolved in a solvent, and then the resin solution is sprayed in the air to prepare a particulate resin. The particulate resin is dispersed in an aqueous medium in the presence of a suitable dispersing agent so that an aqueous dispersion of the particulate resin is formed.

(6) A resin formed by polymerization reaction (such as addition polymerization, ring-opening polymerization, condensation polymerization, addition condensation, etc.) is dissolved in a solvent to prepare a resin solution. Another solvent is added to the resin solution or the resin solution is subjected to cooling after heating, and then the solvent is removed so that a particulate resin separates out. The particulate resin is dispersed in an aqueous medium in the presence of a suitable dispersing agent so that an aqueous dispersion of the particulate resin is formed.

(7) A resin formed by polymerization reaction (such as addition polymerization, ring-opening polymerization, condensation polymerization, addition condensation, etc.) is dissolved in a solvent, and then the resin solution is dispersed in an aqueous medium in the presence of a suitable dispersing agent, followed by removal of the solvent, so that an aqueous dispersion of a particulate resin is formed.

(8) A resin formed by polymerization reaction (such as addition polymerization, ring-opening polymerization, condensation polymerization, addition condensation, etc.) is dissolved in a solvent, and then the resin solution is phase-inversion emulsified by adding an aqueous medium after adding a suitable emulsifying agent thereto so that an aqueous dispersion of a particulate resin is formed.

The particulate resin preferably has a volume average particle diameter of from 10 to 200 nm, and more preferably from 20 to 80 nm, which is measured with a light scattering photometer (manufactured by Otsuka Electronics Co., Ltd.).

(2-3) Binder Resin

The toner having the preferred embodiment of the present invention includes a reactant product of an elongation reaction and/or a crosslinking reaction between the compound having an active hydrogen group and the polymer capable of reacting with the active hydrogen group, as a binder resin.

The binder resin is an adhesive polymer, which is prepared by reacting the compound having an active hydrogen group and the polymer capable of reacting with the active hydrogen group, which adheres to a recording medium such as paper.

The binder resin preferably has a weight average molecular weight of not less than 3,000, more preferably from 5,000 to 1,000,000, and more preferably from 7,000 to 500,000.

When the weight average molecular weight is too small, hot offset resistance of the resultant toner deteriorates.

The binder resin preferably has a glass transition temperature (Tg) of from 30 to 70° C., and more preferably from 40 to 65° C. Since the toner of the present invention includes a polyester resin which is a reaction product of an elongation reaction and/or a cross linking reaction, the toner has good thermostable preservability even if the glass transition temperature is low, in comparison with conventional polyester toners.

When the glass transition temperature is too low, thermostable preservability of the resultant toner deteriorates. When the glass transition temperature is too high, low temperature fixability of the resultant toner deteriorates.

The glass transition temperature can be determined using a TG-DSC system such as TAS-100 (manufactured by Rigaku Corporation) as follows:

(1) about 10 mg of a sample is fed in a sample container made of aluminum, and then the sample container is put on a holder unit and set in an electric furnace;
(2) the sample is heated from room temperature to 150° C. at a temperature rising speed of 10° C./min, and left for 10 minutes at 150° C.;
(3) the sample is cooled to room temperature, and left for 10 minutes at room temperature;
(4) the sample is heated to 150° C. again at a temperature rising speed of 10° C./min to obtain a DSC curve using a differential scanning calorimeter (DSC); and
(5) the DSC curve is analyzed with an analysis system of a TG-DSC system TAS-100 to determine a glass transition temperature (Tg), which is determined by finding a contact point between a tangent line of the DSC curve near the glass transition temperature (Tg) and a baseline.

Specific preferred examples of suitable binder resins include urea-modified polyester resins prepared by reacting (i) the amine (B) serving as a compound having an active hydrogen group with (ii) the polyester prepolymer (A) having an isocyanate group serving as a polymer capable of reacting with the an active hydrogen group, in an aqueous medium.

The urea-modified polyester resin may include a urethane bond other than the urea bond. In this case, the molar ratio of the urea bond to the urethane bond (i.e., urea bond/urethane bond) is preferably from 100/0 to 10/90, more preferably from 80/20 to 20/80, and much more preferably from 60/40 to 30/70.

When the content of the urea bond is too small, hot offset resistance of the resultant toner deteriorates.

Specific preferred examples of suitable urea-modified polyester resins include, but are not limited to, the following (1) to (10):

(1) a mixture of (i) a urea-modified compound of a polyester prepolymer, which is obtained by reacting isophorone diisocyanate with a polycondensation product between an ethylene oxide (2 mol) adduct of bisphenol A and isophthalic acid, obtained by using isophorone diamine, and (ii) a polycondensation product between an ethylene oxide (2 mol) adduct of bisphenol A and isophthalic acid;
(2) a mixture of (i) a urea-modified compound of a polyester prepolymer, which is obtained by reacting isophorone diisocyanate with a polycondensation product between an ethylene oxide (2 mol) adduct of bisphenol A and isophthalic acid, obtained by using isophorone diamine, and (ii) a polycondensation product between an ethylene oxide (2 mol) adduct of bisphenol A and terephthalic acid;
(3) a mixture of (i) a urea-modified compound of a polyester prepolymer, which is obtained by reacting isophorone diisocyanate with a polycondensation product between a mixture of an ethylene oxide (2 mol) adduct of bisphenol A and a propylene oxide (2 mol) adduct of bisphenol A, and terephthalic acid, obtained by using isophorone diamine, and (ii) a polycondensation product between a mixture of an ethylene oxide (2 mol) adduct of bisphenol A and a propylene oxide (2 mol) adduct of bisphenol A, and terephthalic acid;
(4) a mixture of (i) a urea-modified compound of a polyester prepolymer, which is obtained by reacting isophorone diisocyanate with a polycondensation product between a mixture of an ethylene oxide (2 mol) adduct of bisphenol A and a propylene oxide (2 mol) adduct of bisphenol A, and terephthalic acid, obtained by using isophorone diamine, and (ii) a polycondensation product between a propylene oxide (2 mol) adduct of bisphenol A and terephthalic acid;
(5) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using hexamethylene diamine, and (ii) a polycondensation product between an ethylene oxide (2 mol) adduct of bisphenol A and terephthalic acid;
(6) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using hexamethylene diamine, and (ii) a polycondensation product between a mixture of an ethylene oxide (2 mol) adduct of bisphenol A and a propylene oxide (2 mol) adduct of bisphenol A, and terephthalic acid;
(7) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using ethylene diamine, and (ii) a polycondensation product between an ethylene oxide (2 mol) adduct of bisphenol A and terephthalic acid;
(8) a mixture of (i) a urea-modified compound of a polyester prepolymer, which is obtained by reacting diphenylmethane diisocyanate with a polycondensation product between an ethylene oxide (2 mol) adduct of bisphenol A and isophthalic acid, obtained by using hexamethylene diamine, and (ii) a polycondensation product between an ethylene oxide (2 mol) adduct of bisphenol A and isophthalic acid;
(9) a mixture of (i) a urea-modified compound of a polyester prepolymer, which is obtained by reacting diphenylmethane diisocyanate with a polycondensation product between a mixture of an ethylene oxide (2 mol) adduct of bisphenol A and a propylene oxide (2 mol) adduct of bisphenol A, and a mixture of terephthalic acid and dodecenyl succinic anhydride, obtained by using hexamethylene diamine, and (ii) a polycondensation product between a mixture of an ethylene oxide (2 mol) adduct of bisphenol A and a propylene oxide (2 mol) adduct of bisphenol A, and isophthalic acid; and

(10) a mixture of (i) a urea-modified compound of a polyester prepolymer, which is obtained by reacting toluene diisocyanate with a polycondensation product between an ethylene oxide (2 mol) adduct of bisphenol A and isophthalic acid, obtained by using hexamethylene diamine, and (ii) a polycondensation product between an ethylene oxide (2 mol) adduct of bisphenol A and isophthalic acid.

The toner of the present invention may include another binder resin other than the elongation and/or crosslinking reaction product between the compound having an active hydrogen group and the polymer capable of reacting with the active hydrogen group.

Any known resins can be used as the binder resin, and are not particularly limited. Specific preferred examples of the binder resins include, but are not limited to, polyester resins, etc. Among the polyester resins, unmodified polyester resins are preferably used.

The toner including the unmodified polyester resin has good low temperature fixability and produces images having high glossiness.

Specific examples of the unmodified polyester resins include, but are not limited to, polycondensation products between a polyol (PO) and a polycarboxylic acid (PC), as same as the polyester resin (RMPE) having a finctional group capable of forming a urea bond. It is preferable that the unmodified polyester resin is partially compatible with the RMPE, i.e., these resins have similar structures, in terms of improving low temperature fixability and hot offset resistance of the resultant toner.

The unmodified polyester resin preferably has a weight average molecular weight (Mw) of from 1,000 to 30,000, and more preferably from 1,500 to 15,000, when the molecular weight distribution of the tetrahydrofuran (THF) soluble components is determined by GPC (gel permeation chromatography). When the weight average molecular weight (Mw) is too small, thermostable preservability of the resultant toner deteriorates. For this reason, the toner preferably includes the components having a weight average molecular weight (Mw) of less than 1,000 in an amount of from 8 to 28% by weight. When the weight average molecular weight (Mw) is too large, low temperature fixability of the resultant toner deteriorates.

The unmodified polyester resin preferably has a glass transition temperature of from 35 to 70° C. When the glass transition temperature is too low, thermostable preservability of the resultant toner deteriorates. When the glass transition temperature is too high, low temperature fixability of the resultant toner deteriorates.

The unmodified polyester resin preferably has a hydroxyl value of not less than 5 mgKOH/g, more preferably from 10 to 120 mgKOH/g, and much more preferably from 20 to 80 mgKOH/g. When the hydroxyl value is too small, the resultant toner hardly has a good combination of thermostable preservability and low temperature fixability.

The unmodified polyester resin preferably has an acid value of from 1.0 to 30.0 mgKOH/g, and more preferably from 5.0 to 20.0 mgKOH/g. Generally speaking, toners having an acid value can be easily negatively charged.

The mixing ratio (i.e., RMPE/PE) between the polyester resin (RMPE) having a functional group capable of forming a urea bond and the unmodified polyester resin (PE) is preferably from 5/95 to 25/75, and more preferably from 10/90 to 25/75, by weight.

When the mixing ratio is too small, hot offset resistance of the resultant toner deteriorates. When the mixing ratio is too large, low temperature of the resultant toner deteriorates and the produced images have low glossiness.

The following are suitable methods for preparing a binder resin obtained by reacting the compound having an active hydrogen group and the polymer capable of reacting with the active hydrogen group, i.e., a urea-modified polyester resin.

(1) A toner constituent mixture liquid containing a polymer capable of reacting with an active hydrogen group (e.g., the polyester prepolymer (A) having an isocyanate group) is emulsified or dispersed in an aqueous medium together with a compound having an active hydrogen group (e.g., the amine (B)), to prepare a dispersion of the toner constituent mixture liquid while subjecting the compound having an active hydrogen group and the polymer capable of reacting with the active hydrogen group to an elongation and/or crosslinking reaction.

(2) The toner constituent mixture liquid is emulsified or dispersed in an aqueous medium previously containing a compound having an active hydrogen group, to prepare a dispersion of the toner constituent mixture liquid while subjecting the compound having an active hydrogen group and the polymer capable of reacting with the active hydrogen group to an elongation and/or crosslinking reaction.

(3) The toner constituent mixture liquid is emulsified or dispersed in an aqueous medium, and then the compound having an active hydrogen group is added thereto, to prepare a dispersion of the toner constituent mixture liquid while subjecting the compound having an active hydrogen group and the polymer capable of reacting with the active hydrogen group to an elongation and/or crosslinking reaction.

In the above method (3), a modified polyester resin is selectively formed on the surface of the produced toner particles, i.e., the resultant toner has a concentration gradient in the quantity of the modified resin.

The reaction conditions for preparing the binder resin are not particularly limited, and depend on a combination of a compound having an active hydrogen group and a polymer capable of reacting with the active hydrogen group. However, the reaction time is preferably from 10 minutes to 40 hours, and more preferably from 2 hours to 24 hours. The reaction time is preferably from 0 to 150° C., and more preferably from 40 to 98° C.

(2-4) Emulsification or Dispersion

In order to stably form an aqueous dispersion containing the polymer capable of reacting with an active hydrogen group (e.g., the polyester prepolymer (A) having an isocyanate group), it is preferable that a toner constituent mixture liquid, which is prepared by dissolving or dispersing the polymer capable of reacting with an active hydrogen group (e.g., the polyester prepolymer (A) having an isocyanate group), a colorant, a charge controlling agent, a unmodified polyester resin, etc., in an organic solvent, is dispersed in an aqueous medium upon application of shear force. However, the dispersing method is not limited thereto.

It is preferable that the content of the aqueous medium used for the emulsification or dispersion is 50 to 2,000 parts by weight, and more preferably 100 to 1,000 parts by weight, based on 100 parts by weight of the toner constituent mixture.

When the content is too small, the toner constituent mixture liquid cannot be well dispersed, and therefore the toner cannot have a desired particle diameter. When the content is too large, the toner manufacturing cost increases.

When the toner constituent mixture liquid is emulsified or dispersed in an aqueous medium, dispersants are preferably used to improve stability of the dispersion so as to obtain a toner having a desired shape and a narrow particle diameter distribution.

Any known dispersants can be used in the present invention, and are not particularly limited. Specific examples of the dispersants include, but are not limited to, surfactants, water-insoluble inorganic dispersants, polymeric protection colloids, etc. These can be used alone or in combination. Among these, surfactants are preferably used.

Specific examples of the surfactants include, but are not limited to, anionic surfactants, cationic surfactants, nonionic surfactants, ampholytic surfactants, etc.

Specific examples of the anionic surfactants include, but are not limited to, alkylbenzene sulfonic acid salts, α-olefin sulfonic acid salts, phosphoric acid salts, etc. In particular, anionic surfactants having a fluoroalkyl group are preferably used. Specific examples of the anionic surfactants having a fluoroalkyl group include, but are not limited to, fluoroalkyl carboxylic acids having 2 to 10 carbon atoms and their metal salts, disodium perfluorooctanesulfonylglutamate, sodium 3-{ω-fluoroalkyl(C6-C11)oxy}-1-alkyl(C3-C4)sulfonate, sodium 3-{ω-fluoroalkanoyl(C6-C8)-N-ethylamino}-1-propanesulfonate, fluoroalkyl(C11-C20)carboxylic acids and their metal salts, perfluoroalkyl(C7-C13)carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethyl ammonium salts, salts of perfluoroalkyl(C6-C10)-N-ethylsulfonyl glycin, monoperfluoroalkyl(C6-C16) ethylphosphates, etc.

Specific examples of useable commercially available surfactants include, but are not limited to, SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 123B, 306A, 501, 201 and 204, which are manufactured by Tochem Products Co., Ltd.; FUTARGENT® F-100 and F-150 manufactured by Neos; etc.

Specific examples of the cationic surfactants include, but are not limited to, amine salts, quaternary ammonium salts, etc. Specific examples of the amine salts include, but are not limited to, alkyl amine salts, aminoalcohol fatty acid derivatives, polyamine fatty acid derivatives, imidazoline, etc. Specific examples of the quaternary ammonium salts include, but are not limited to, alkyltrimethyl ammonium salts, dialkyldimethyl ammonium salts, alkyldimethyl benzyl ammonium salts, pyridinium salts, alkyl isoquinolinium salts, benzethonium chloride, etc. In addition, primary, secondary and tertiary aliphatic amines having a fluoroalkyl group, aliphatic quaternary salts such as perfluoroalkyl(C6-C10)sulfoneamidepropyltrimethylammonium salts, benzalkonium salts, benzetonium chloride, pyridinium salts, imidazolinium salts, etc., can be used. Specific examples of useable commercially available products thereof include, but are not limited to, SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Specific examples of the nonionic surfactants include, but are not limited to, fatty acid amine derivatives, polyhydric alcohol derivatives, etc.

Specific examples of the ampholytic surfactants include, but are not limited to, aniline, dodecyldi(aminoethyl)glycin, di(octylaminoethyl)glycin, N-alkyl-N,N-dimethylammonium betaine, etc.

Specific examples of the water-insoluble inorganic dispersants include, but are not limited to, tricalcium phosphate, calcium carbonate, titanium oxide, colloidal silica, hydroxyapatite, etc.

Specific examples of the protection colloids include, but are not limited to, polymers and copolymers prepared using monomers such as acids, (meth)acrylic monomers having a hydroxyl group, vinyl alcohols and ethers thereof, esters of a vinyl alcohol with a compound having a carboxyl group, amide compounds and methylol compounds thereof, chlorides, and monomers having a nitrogen atom or an alicyclic ring having a nitrogen atom; polyoxyethylene compounds; cellulose compounds; etc.

Specific examples of the acids include, but are not limited to, acrylic acid, methacrylic acid, α-cyanoacrylic acid, α-cyanomethacrylic acid, itaconic acid, crotonic acid, fumaric acid, maleic acid, maleic anhydride, etc.

Specific examples of the (meth)acrylic monomers having a hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, N-methylolmethacrylamide, etc.

Specific examples of the vinyl alcohols and ethers thereof include, but are not limited to, vinyl methyl ether, vinyl ethyl ether, vinyl propyl ether, etc.

Specific examples of the esters of a vinyl alcohol with a compound having a carboxyl group include, but are not limited to, vinyl acetate, vinyl propionate, vinyl butyrate, etc.

Specific examples of the amide compounds and methylol compounds thereof include, but are not limited to, acrylamide, methacrylamide, diacetoneacrylamide acid, etc., and methylol compounds thereof.

Specific examples of the chlorides include, but are not limited to, acrylic acid chloride, methacrylic acid chloride, etc.

Specific examples of the monomers having a nitrogen atom or an alicyclic ring having a nitrogen atom include, but are not limited to, vinyl pyridine, vinyl pyrrolidone, vinyl imidazole, ethylene imine, etc.

Specific examples of the polyoxyethylene compounds include, but are not limited to, polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, polyoxyethylene nonylphenyl esters, etc.

Specific examples of the cellulose compounds include, but are not limited to, methyl cellulose, hydroxyethyl cellulose, hydroxypropyl cellulose, etc.

In the toner manufacturing process, dispersion stabilizer can be optionally used.

Specific examples of the dispersion stabilizer include, but are not limited to, calcium phosphate, which is soluble both in acids and bases, etc.

When a compound soluble both in acids and bases is used as a dispersion stabilizer, the dispersion stabilizer can be removed by being dissolved by acids such as hydrochloric acid, followed by washing with water, or being decomposed by an enzyme.

In the toner manufacturing process, catalysts of the elongation and/or crosslinking reaction can be optionally used.

(2-5) Solvent Removal

In the toner manufacturing process, the organic solvent is preferably removed from the emulsion or the dispersion of the toner particles.

The removal of the organic solvent is particularly performed in known dissolution suspension method and the toner manufacturing process of the toner having the preferred embodiment of the present invention.

In order to remove an organic solvent from the emulsion, the following methods can be used.

(1) The emulsion is gradually heated to completely evaporate the organic solvent present in the drops of the oil phase.
(2) The emulsion is gradually placed under reduced pressure to completely evaporate the organic solvent in the drops of the oil phase.
(3) The emulsion is sprayed in a dry environment to dry the organic solvent in the drops of the oil phase and water in the dispersion, resulting in formation of toner particles.

Specific examples of the dry environment include gases of air, nitrogen, carbon dioxide, combustion gas, etc., which are preferably heated to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

After the organic solvent is removed, toner particles are obtained. The toner particles are subjected to washing and drying treatment, and then optionally subjected to classification. The toner particles can be classified by removing fine particles by methods such as cyclone, decantation, centrifugal separation, etc. in a liquid. Of course, the dried toner particles can be classified by the above methods.

The dried toner particles can be mixed with other particulate materials such as colorant, charge controlling agent, etc., optionally upon application of a mechanical impact thereto to fix and fuse the particulate materials on the surface of the toner particles.

Specific examples of such mechanical impact application methods include, but are not limited to, methods in which a mixture is mixed with a highly rotated blade and methods in which a mixture is put into an air stream to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

(3) Toner Properties (3-1) Particle Diameter

The toner of the present invention preferably has a volume average particle diameter of from 3 to 9 μm, and more preferably from 3 to 7 μm.

When the Dv is too small, the toner tends to fuse on the surface of the carrier by long-term agitation in a developing device, resulting in deterioration of chargeability of the carrier, when the toner is used for a two-component developer. When the toner is used for a one-component developer, problems such that the toner forms a film on a developing roller, and the toner fuses on a toner layer forming member tend to be caused. In contrast, when the Dv is too large, it is difficult to obtain high definition and high quality images. In addition, an average particle diameter of toner particles included in a developer tends to be largely changed when a part of the toner particles are replaced with fresh toner particles.

The toner preferably has a ratio (Dv/Dn) between the volume average particle diameter (Dv) and a number average particle diameter (Dn) of from 1.00 to 1.25, and more preferably from 1.05 to 1.20.

When the ratio (Dv/Dn) is too small, the toner tends to fuse on the surface of the carrier by long-term agitation in a developing device, resulting in deterioration of chargeability of the carrier, when the toner is used for a two-component developer. When the toner is used for a one-component developer, problems such that the toner forms a film on a developing roller, and the toner fuses on a toner layer forming member tend to be caused. In contrast, when the ratio (Dv/Dn) is too large, it is difficult to obtain high definition and high quality images. In addition, an average particle diameter of toner particles included in a developer tends to be largely changed when a part of the toner particles are replaced with fresh toner particles.

When the ratio (Dv/Dn) is from 1.05 to 1.20, the toner has a good combination of thermostable preservability, low temperature fixability, and hot offset resistance. In particular, the produced full-color images have good glossiness. When such a toner is used for a two-component developer, an average particle diameter of toner particles included in the developer hardly changes even if a part of the toner particles are replaced with fresh toner particles, and therefore the toner has good and stable developability even after a long repeated agitation in the developing unit. When such a toner is used for a one-component developer, an average particle diameter of the toner particles hardly changes even if a part of the toner particles are replaced with fresh toner particles, and the toner hardly forms a film on a developing roller and hardly fuses on a toner layer forming member. Therefore, the toner has good and stable developability even after long repeated use, resulting in producing high quality images.

The volume average particle diameter (Dv), the number average particle diameter (Dn), and the ratio (Dv/Dn) can be determined with an instrument such as COULTER MULTISIZER II (manufactured by Coulter Electrons Inc.).

(3-2) Penetration

The toner of the present invention preferably has a penetration of not less than 15 mm, and more preferably from 20 to 30 mm, which is measured by a method based on JIS K2235-1991.

When the penetration is too small, thermostable preservability of the resultant toner deteriorates.

The penetration is measured by the following method based on JIS K2235-1991. At first, a 50 ml glass container is filled with a toner and put in a thermostatic chamber for 20 hours at 50° C., and then the toner is cooled to room temperature and subjected to the penetration test. The larger penetration a toner has, the better thermostable preservability the toner has.

(3-3) Fixability

Fixability is evaluated by the minimum fixable temperature and the maximum fixable temperature above which the offset problem occurs. It is preferable that the minimum fixable temperature is as low as possible, and the maximum fixable temperature is as high as possible. In particular, it is preferable that the minimum fixable temperature is less than 120° C., and the maximum fixable temperature is not less than 200° C.

Fixability is determined by forming images with an image forming apparatus in which a fixing member temperature is variable.

The minimum fixable temperature is defined as, for example, the fixing member temperature below which the residual rate of the fixed image density was less than 70% when the fixed image was rubbed with a pad.

The maximum fixable temperature is defined as, for example, the fixing member temperature above which the offset problem occurs.

(3-4) Thermal Property

Thermal properties (i.e., flow tester property) of the toner are evaluated by softening temperature (Ts), flow-starting temperature (Tfb), softening temperature (T1/2) based on the 1/2 method, etc. These temperatures can be determined from a flow curve obtained with an instrument such as CAPILLARY RHEOMETER SHIMADZU FLOWMETER CFT-500 (from Shimadzu Corporation).

The toner preferably has a softening temperature (Ts) of not less than 30° C., and more preferably from 50 to 90° C. When the Ts is too low, thermostable preservability of the resultant toner deteriorates.

The toner preferably has a flow-starting temperature (Tfb) of not less than 60° C., and more preferably from 80 to 120° C. When the Tfb is too low, at least one of thermostable preservability and hot offset resistance of the resultant toner deteriorates.

The toner preferably has a softening temperature (T1/2) based on the 1/2 method of not less than 90° C., and more preferably from 100 to 170° C. When the T1/2 is too low, hot offset resistance of the resultant toner deteriorates.

In addition, the toner preferably has a glass transition temperature (Tg) of from 40 to 70° C., and more preferably from 45 to 65° C. When the Tg is too low, thermostable preservability of the resultant toner deteriorates. When the Tg is too high, low temperature fixability of the resultant toner deteriorates.

The glass transition temperature (Tg) can be measured using a differential scanning calorimeter such as DSC-60 (manufactured by Shimadzu Corporation).

The toner preferably has an acid value of from 0.5 to 40.0 mgKOH/g, and more preferably from 3.0 to 35.0 mgKOH/g. The toner can be easily negatively charged when the toner has such an acid value.

(3-5) Average Circularity

The toner of the present invention preferably has an average circularity of from 0.93 to 1.00. When the average circularity is too small (i.e., the toner is far from a true sphere), the toner has poor transferability and therefore high quality images having scattering tend to be produced. Since such toner particles having an irregular form contact smooth media (such as photoreceptor) at plural convexity points, of which the charges of the toner particles are concentrated at tips thereof, van der Waals' forces and image forces generated therebetween are larger than these generated between spherical toner particles and the smooth media. When the toner includes both irregular particles and spherical particles, the spherical particles are selectively transferred, and therefore image deficit tends to occur in character parts and line parts. Since toner particles remaining on the image bearing member have to be removed so as to prepare for the next developing process, the image forming apparatus needs a cleaning device. The minimum amount of the toner needed for image forming thus increases, resulting in deterioration of toner yield.

The circularity of a particle is determined by the following equation:

$$C=Lo/L$$

wherein C represents the circularity, Lo represents the length of the circumference of a circle having the same area as that of the image of the particle and L represents the peripheral length of the image of the particle.

The average circularity of a toner can be determined using a flow-type particle image analyzer FPIA-2100 (manufactured by Sysmex Corp.). Specifically, the method is as follows:

(1) 0.1 g to 0.5 g of a sample to be measured is mixed with 100 ml to 150 ml of water, in which solid impurities are removed, including 0.1 ml to 0.5 ml of a dispersant (i.e., a surfactant);

(2) the mixture is dispersed using an ultrasonic dispersing machine for about 1 to 3 minutes to prepare a suspension including particles of 3,000 to 10,000 per micro-liter of the suspension.

(3-6) Size Factors

Figure 4A:
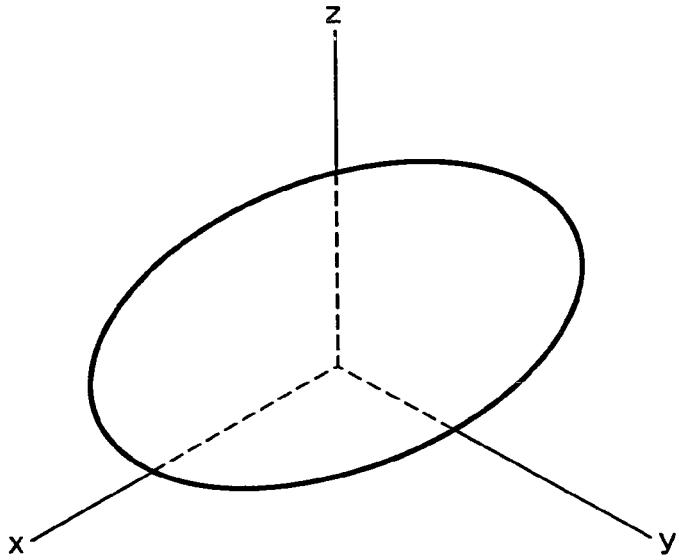
FIGS. 4A-4C are schematic views illustrating a typical particle of the toner of the present invention.
Figure 4B:
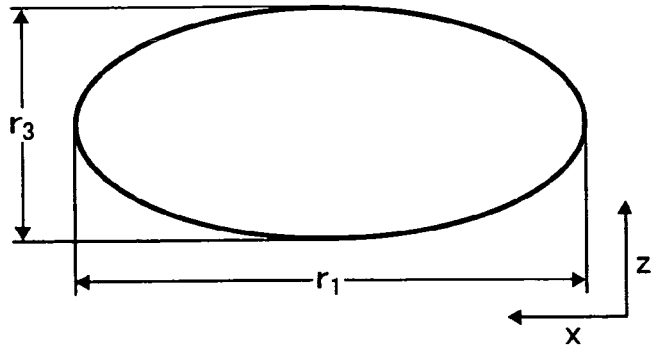
Figure 4C:
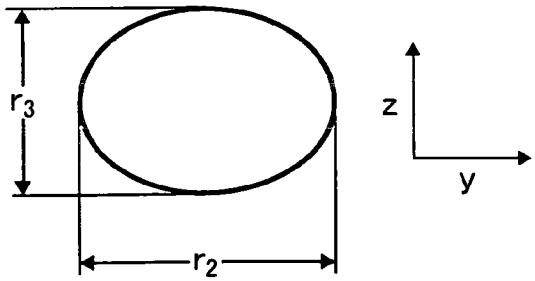

The toner of the present invention may have a form similar to the spherical form. FIG. 4A is an external view of the toner, and FIGS. 4B and 4C are cross sections of the toner. The toner preferably satisfies the following relationship:

$$0.5 \leqq (r2/r1) \leqq 1.0 \text{ and } 0.7 \leqq (r3/r2) \leqq 1.0$$

wherein r1, r2 and r3 represent the average major axis particle diameter, the average minor axis particle diameter and the average thickness of particles of the toner, wherein r3≦r2≦r1.

When the ratio (r2/r1) is too small, the toner has a form far away from the spherical form, and therefore the toner has poor dot reproducibility and transferability, resulting in deterioration of the image quality. When the ratio (r3/r2) is too small, the toner has a form far away from the spherical form, and therefore the toner has poor transferability. When the ratio (r3/r2) is 1.0, the toner has a form similar to the spherical form, and therefore the toner has good fluidity.

The above-mentioned size factors (i.e., r1, r2 and r3) of toner particles can be determined by observing the toner particles with a scanning electron microscope while the viewing angle is changed.

(3-7) Image Density

An image produced with the toner of the present invention preferably has an image density of not less than 1.40, more preferably not less than 1.45, and much more preferably not less than 1.50, which is measured with a spectrodensitometer such as X-RITE 938 (from X-rite Inc.). When the image density is too low, high quality images cannot be produced.

Image density can be measured as follows. For example, a solid image having 0.9 to 1.1 mg/cm$^2$ of a toner thereon is produced and fixed on plain paper (TYPE6200 from Ricoh Co., Ltd.) at a fixing roller temperature of from 158 to 162° C., using a full-color image forming apparatus (IPSIO COLOR 8100 from Ricoh Co., Ltd.). The image density of the produced solid image is determined by averaging image densities of five randomly selected portions of the solid image measured with X-RITE 938 (from X-rite Inc.).

The color of the toner of the present invention is not limited. However, it is preferable that the toner has a color at least one selected from the member consisting of black, cyan, magenta, and yellow. A toner having a desired color can be prepared by choosing a proper colorant from the colorants mentioned above.

The toner of the present invention is manufactured by a method comprising emulsifying or dispersing a toner constituent mixture liquid in an aqueous medium. In such a toner, wax particles having a small particle diameter are uniformly dispersed therein, and a proper amount of the wax particles exist at the surface thereof, i.e., the wax particles are not unevenly dispersed in the toner. The resultant toner has good releasability and hardly forms toner films.

Since the toner is not exposed to heat in the toner manufacturing process, the toner can include a wax having a low melting point. When the toner has a proper amount of the wax existing at the surface thereof, the toner has good releasability at low temperatures. Namely, such a toner has a good combination of low temperature fixability and thermostable preservability, and produces high quality images, while having a small particle diameter and a narrow particle diameter distribution.

As mentioned above, the toner of the present invention has a good combination of the following properties:

(1) small particle diameter and narrow particle diameter distribution;
(2) releasability at low temperatures;
(3) toner filming resistance;
(4) low temperature fixability;
(5) hot offset resistance; and
(6) ability to produce high quality images.

When the toner includes at least a binder resin which is prepared by reacting a compound having an active hydrogen group and a polymer capable of reacting with the active hydrogen group, the toner has a good combination of incohesiveness, chargeability, fluidity, releasability, and fixability.

The toner of the present invention can be used for various fields, and preferably used for electrophotography. A toner container, a developer, a process cartridge, an image forming apparatus, and an image forming method, using the toner will be explained in detail hereafter.

(4) Developer

The developer of the present invention includes at least the toner of the present invention and other components such as a carrier as appropriate. The developer may be either a one-component developer or a two-component developer. Two-component developers are used for high-speed printers which can respond to the demands of improvement of information processing speed, in terms of life thereof.

A one-component developer consisting essentially of the toner of the present invention has a stable average particle diameter even if a part of the toner particles are replaced with fresh toner particles, and hardly forms a film on a developing roller and hardly fuses on a toner layer forming member. Such a one-component developer has stable good developability, and therefore high quality images can be produced even after a long repeated use.

A two-component developer including the toner of the present invention also has a stable average particle diameter even if a part of the toner particles are replaced with fresh toner particles. Such a two-component developer has stable good developability, and therefore high quality images can be produced even after a long repeated use.

Any known carriers can be used for the two-component developer of the present invention, and are not particularly limited. However, carriers including a core and a resin layer which covers the core are preferably used.

Any known cores can be used for the carriers, and are not particularly limited. Specific examples of the cores include, but are not limited to, manganese-strontium (Mn—Sr) materials and manganese-magnesium (Mn—Mg) materials having a magnetization of from 50 to 90 emu/g, etc. In order to obtain images having a high image density, high-magnetization materials such as iron powders (having a magnetization of not less than 100 emu/g) and magnetites (having a magnetization of from 75 to 120 emu/g) are preferably used. In order to obtain high quality images, low-magnetization materials such as copper-zinc (Cu—Zn) materals (having a magnetization of from 30 to 80 emu/g) are preferably used, because the magnet brushes can weakly contact a photoreceptor in such a case. These materials can be used alone or in combination.

The core preferably has a volume average particle diameter of from 10 to 150 μm, and more preferably from 40 to 100 μm.

When the volume average particle diameter is too small, the carrier includes too large an amount of fine particles and therefore magnetization per carrier particle decreases, resulting in occurrence of carrier scattering. When the volume average particle is too large, the carrier has too small a specific surface area and therefore carrier scattering tends to occur and image reproducibility deteriorates especially in full-color solid images.

Any known resins can be used for the resin layer, and are not particularly limited. Specific examples of the resins include, but are not limited to, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomer, copolymers of vinylidene fluoride and vinyl fluoride, fluoroterpolymers (e.g., terpolymer of tetrafluoroethylene and vinylidene fluoride and non-fluoride monomer), silicone resins, etc. These resins can be used alone or in combination.

Specific examples of the amino resins include, but are not limited to, urea-formaldehyde resins, melamine resins, benzoguanamine resins, urea resins, polyamide resins, epoxy resins, etc.

Specific examples of the polyvinyl resins include, but are not limited to, acrylic resins, polymethyl methacrylate resins, polyacrylonitrile resins, polyvinyl acetate resins, polyvinyl alcohol resins, polyvinyl butyral resins, etc.

Specific examples of the polystyrene resins include, but are not limited to, polystyrene resins, styrene-acrylic copolymer resins, etc.

Specific examples of the halogenated olefin resins include, but are not limited to, polyvinyl chloride, etc.

Specific examples of the polyester resins include, but are not limited to, polyethylene terephthalate resins, polybutylene terephthalate resins, etc.

The resin layer optionally includes particulate conductive materials. Specific examples of the particulate conductive materials include, but are not limited to, metal powders, carbon blacks, titanium oxides, tin oxides, zinc oxides, etc. The particulate conductive material preferably has an average particle diameter of not greater than 1 μm. When the average particle diameter is too small, it is difficult to control the electrical resistance of the carrier.

The resin layer can be formed by the following method:

(1) the resin, etc. are dissolved in an organic solvent to prepare a resin layer constituent liquid;
(2) the resin layer constituent liquid is uniformly coated on the core by known methods such as dip coating, spray coating, brush coating, etc.; and
(3) the coated core is subject to drying and baking.

Specific examples of the organic solvents include toluene, xylene, methyl ethyl ketone, methyl isobutyl ketone, cellosolve butyl acetate, etc., but are not limited thereto.

The baking method can be either or both of an external heating method or an internal heating method. Specific baking methods include methods using a fixed electric furnace, a portable electric furnace, a rotary electric furnace, a burner furnace and a microwave, but are not limited thereto.

The carrier preferably includes the resin layer in an amount of from 0.01 to 5.0% by weight. When the amount is too small, the resin layer cannot be uniformly formed on the surface of the core. When the amount is too large, the carrier has too thick a resin layer and therefore each of the carrier particles tend to aggregate. In this case, uneven carrier particles are obtained.

The two-component developer preferably includes the carrier in an amount of from 90 to 98% by weight, and more preferably from 93 to 97% by weight.

The developer including the toner of the present invention has good transferability and fixability, and therefore stably produces high quality images.

The developer of the present invention is preferably used for any known electrophotographic image forming methods such as magnetic one-component developing methods, non-magnetic one-component developing methods, and two-component developing methods.

(5) Toner Container

The toner container of the present invention contains the toner or the developer of the present invention.

Suitable toner containers include any known containers such that including a main body of a toner container and a cap.

The toner container is not limited in size, shape, structure, material, etc. The toner container preferably has a cylinder shape having spiral projections and depressions on the inner surface thereof. Such a toner container can feed a toner to an ejection opening by rotating. It is more preferable that a part of the spiral parts, or all of the spiral parts of such a toner container have a structure like an accordion.

Suitable materials for use in the toner container include materials having good dimensional accuracy. In particular, resins are preferably used. Specific examples of the resins for use in the toner container include, but are not limited to, polyester resins, polyethylene resins, polypropylene resins, polystyrene resins, polyvinylchloride resins, polyacrylic acids, polycarbonate resins, ABS resins, polyacetal resins, etc.

The toner container of the present invention can be easily preserved, transported, handled, and detached from the process cartridge and the image forming apparatus of the present invention (to be hereinafter explained) to feed a developer thereto.

(6) Process Cartridge

The process cartridge of the present invention comprises:

an image bearing member configured to bear an electrostatic latent image; and a developing device configured to develop the electrostatic latent image with a developer including a toner to form a toner image on the image bearing member, and optionally includes other devices.

The developing device comprises:

a developer container configured to contain the developer of the present invention; and a developer bearing member configured to bear and transport the developer contained in the developer container, and optionally includes a thickness controlling member configured to control the thickness of the developer layer formed on the image bearing member.

The process cartridge of the present invention is detachably attachable to any image forming apparatuses using the electrophotography, and preferably detachably attachable to the image forming apparatus of the present invention (to be hereinafter explained).

(7) Image Forming Apparatus and Image Forming Method

The image forming method of the present invention comprises:

forming an electrostatic latent image on an image bearing member (i.e., electrostatic latent image forming process);

developing the electrostatic latent image with a developer including a toner to form a toner image on the image bearing member (i.e., developing process);

transferring the toner image onto a transfer material (i.e., transfer process); and fixing the toner image on a recording medium (i.e., fixing process), and optionally includes a discharging process, a cleaning process, a recycling process, a controlling process, etc.

(7-1) Electrostatic Latent Image Forming Process

In the electrostatic latent image forming process, an electrostatic latent image is formed on an image bearing member.

The image bearing members (i.e., photoreceptors) are not limited in material, shape, structure, size, etc., and any known image bearing members can be used. However, the image bearing member preferably has a cylinder shape. Specific examples of the materials used for the image bearing members include amorphous silicon and selenium (used for inorganic photoreceptors), polysilane and phthalopolymethine (used for organic photoreceptors), etc. Among these, amorphous silicon is preferably used with respect to the long life of the photoreceptor.

The electrostatic latent image is formed by irradiating the charged image bearing member with a light containing image information in an electrostatic latent image forming device.

The electrostatic latent image forming device comprises a charger configured to charge the image bearing member, and a light irradiator configured to irradiate the charged image bearing member with a light containing image information on the image bearing member.

A voltage is applied to the surface of the image bearing member by the charger.

Specific examples of the chargers include known contact chargers including members such as electroconductive or semiconductive rollers, brushes, films, rubber blades, etc., and non-contact chargers using corona discharge such as corotron and scorotron, etc.

The light irradiator irradiates the surface of the charged image bearing member with a light containing image information.

Specific examples of the light irradiators include emit optical irradiators, rod lens array irradiators, laser optical irradiators, liquid crystal shutter irradiators, etc.

In the present invention, the image bearing member can be irradiated from the back side thereof.

(7-2) Developing Process

In the developing process, the electrostatic latent image is developed with the toner or the developer of the present invention to form a toner image on the image bearing member.

The toner image can be formed with the toner or the developer of the present invention in a developing device.

Suitable developing devices include any known developing devices which can use the toner or the developer of the present invention, and are not particularly limited. For example, a developing device containing the toner or the developer of the present invention, and capable of directly or indirectly adhering the toner or the developer to the electrostatic latent image is preferably used. Such a developing device further including the toner container of the present invention is more preferably used.

The developing device may be either or both of a dry developing device or a wet developing device in the present invention. Moreover, the developing device may be either or both of a single-color developing device or a multi-colored developing device in the present invention. The developing device preferably includes an agitator configured to agitate the developer so as to be charged, and a rotatable magnet roller.

In the developing device, the toner and the carrier are mixed and agitated. The toner is charged by the agitation, and held in a magnet brush which is formed on the surface of a rotating magnet roller. Because the magnet roller is arranged near the image bearing member (photoreceptor), a part of the toner held in the magnet brush, which is formed on the surface of the rotating magnet roller, is moved to the surface of the image bearing member (photoreceptor) due to the electric force. Namely, the electrostatic latent image is developed with the toner to form a toner image on the image bearing member.

The developer contained in the developing device may be both a one-component developer and a two-component developer.

(7-3) Transfer Process

In the transfer process, the toner image is transferred onto a recording medium. It is preferable that the toner image is firstly transferred onto an intermediate transfer medium, and then secondly transferred onto the recording medium. It is more preferable that the toner image is a multiple toner image which is formed with two or more full-color toners, and the multiple toner image is firstly transferred onto the intermediate transfer medium (i.e., primary transfer process), and then secondly transferred onto the recording medium (i.e., secondary transfer process).

The toner image is charged with a transfer charger and then transferred in a transfer device. The transfer device for use in the present invention preferably includes a primary transfer device configured to transfer a toner image onto an intermediate transfer medium to form a multiple toner image, and a secondary transfer device configured to transfer the multiple toner image onto a recording medium.

As the intermediate transfer medium, any known transfer media can be used. In particular, transfer belts are preferably used.

The transfer device (the primary transfer device and the secondary transfer device) preferably comprises a transfer member configured to attract the toner image from the image bearing member (photoreceptor) to the recording material. The number of transfer devices can be one or more.

Specific examples of the transfer members include corona transfer members, transfer belts, transfer rollers, pressure transfer rollers, adhesion transfer members, etc.

Any known recording media (e.g., recoding papers) can be used as the recording media, and are not particularly limited.

(7-4) Fixing Process

In the fixing process, the toner image transferred onto the recording medium is fixed in a fixing device. The toner image can be fixed every time after each of toner image is transferred onto the recording medium one by one. Of course, the toner image can be fixed after all of the toner images are transferred and superimposed on the recording medium.

As the fixing device, any known fixing devices can be used, and are not particularly limited. However, the following fixing device is preferably used because hot offset hardly occurs at both ends of the fixing belt and the fixing belt hardly deteriorates even after a long repeated use.

Figure 5:
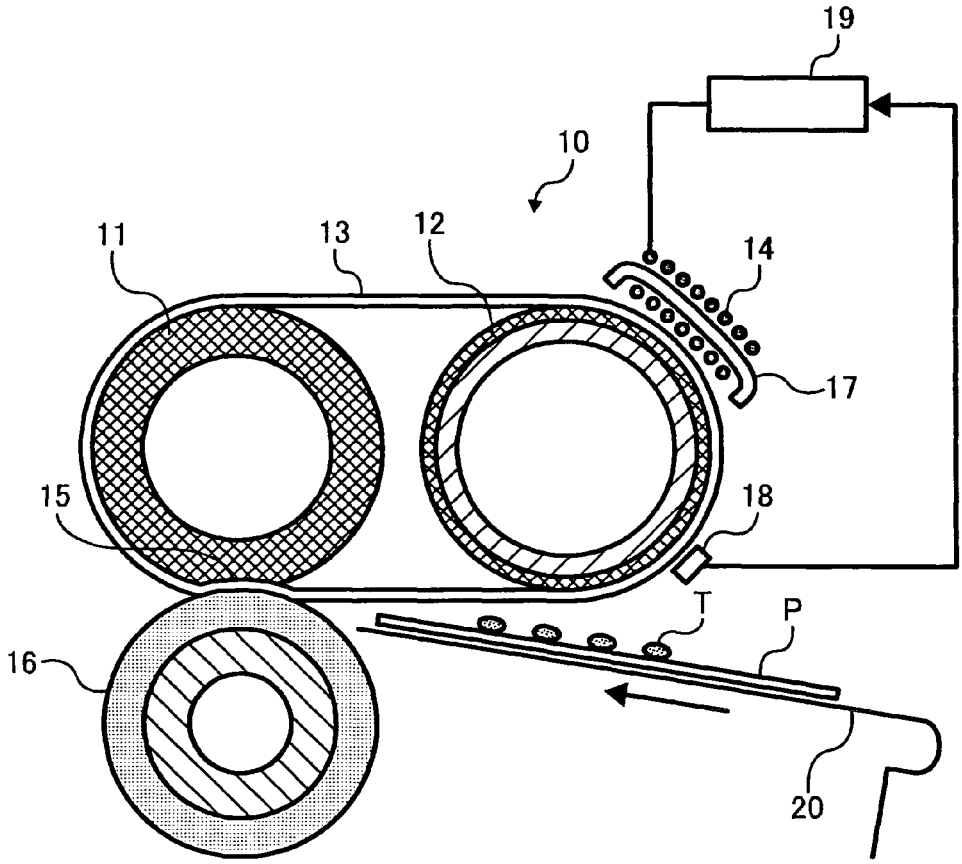
FIG. 5 is a schematic view illustrating an embodiment of a fixing device for use in the image forming method and image forming apparatus of the present invention.

FIG. 5 is a schematic view illustrating a preferred embodiment of the fixing device for use in the present invention. A fixing device 10 includes a fixing roller 11, a facing roller (i.e., a heating roller) 12 consisting essentially of a non-magnetic material and arranged in parallel with the fixing roller 11, an endless fixing belt 13 containing a magnetic material and tightly stretched with the fixing roller 11 and the facing roller 12, an induction coil (i.e., induction heating means) 14 configured to heat the fixing belt 13 by electromagnetic induction and arranged on a side of the facing roller 12, and a pressing roller 16 configured to press the fixing roller 11 with the fixing belt 13 therebetween so as to form a nip 15 between the fixing belt 13 and the pressing roller 16.

The fixing roller 11 includes a cored bar made of aluminum, iron, etc., and a heat insulating layer which is overlaid on the cored bar. The fixing roller 11 has an outer diameter of 40 mm, for example. Since the heat insulating layer needs to have thermostability, silicone rubbers (including sponges) are preferably used. It is preferable that materials used for the heat insulating layer preferably have a thermal conductivity as low as possible, and more preferably not less than 0.2 W/m/k.

The facing roller 12 includes the cored bar made of a non-magnetic material such as aluminum and SUS.

Figure 6:
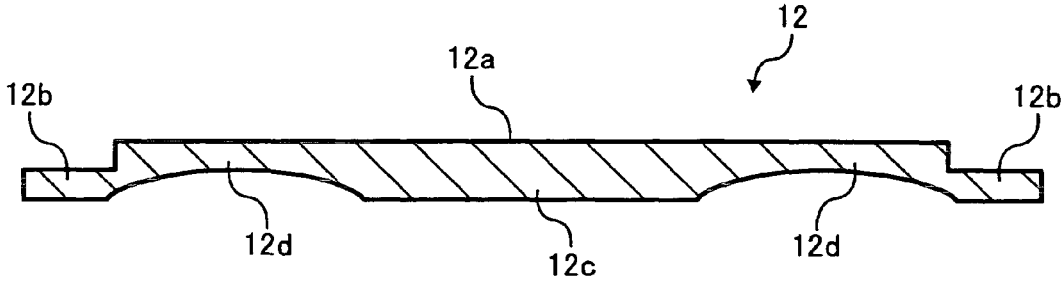
FIG. 6 is a schematic view illustrating a cross section of the upper half of the facing roller used for the fixing device illustrated in FIG. 5.

FIG. 6 is a schematic view illustrating a cross section of the upper half of the facing roller 12. The facing roller 12 includes a cylindrical portion 12*a* and rotation supporting portions 12*b* arranged on both ends of the cylindrical portion 12*a*. The rotation supporting portions 12*b* are supported with the main body of the fixing device via bearings.

Both end portions of the internal surface of the facing roller 12 are shaved so that the wall thickness of the central portion 12*c* is larger than these of the end portions 12*d*, in the axial direction of the facing roller 12. For example, the central portion 12*c* has a wall thickness of 0.6 mm and each of the end portions has a wall thickness of 0.3 mm.

In this case, the end portions 12*d* have small thermal capacities, and therefore the heat applied by electromagnetic induction heating is prevented from diffusing into the both end portions 12*d*. As a result, the temperature rising speed of the end portion 12*d* (i.e., the end portion of the facing roller 12) is as same as that of the central portion 12*c* (i.e., the central potion of the facing roller 12), and thereby start-up time of the fixing device can be shortened.

The pressing roller 16 includes a cored bar, a thermostable elastic layer (consisting essentially of a silicone rubber, etc.) which is overlaid on the cored bar, and an outermost release layer (consisting essentially of a fluorocarbon resin, etc.) which is overlaid on the thermostable elastic layer. In order to well separate a recording paper P from the fixing belt 13, the pressing roller 16 has a higher surface hardness than the fixing roller 11. When the pressing roller 16 presses the fixing roller 11 with the fixing belt 13 therebetween, a part of the fixing belt 13 forms a convexity on a side of the fixing belt 11, resulting in formation of the nip 15 on the fixing belt 13. The thermostable elastic layer of the pressing roller 16 has a thickness of from 1 to several mm.

The induction coil 14 is wound around an exiting core 17 consisting of a ferrite or a permalloy, the cross section of which has a nearly concave shape. When high-frequency current having a frequency of from several kHz to several hundred kHz is passed through the induction coil 14, induced current is generated in the fixing belt 13. As a result, the fixing belt 13 locally produces heat at a portion near the induction coil 14, and rapidly rises in temperature.

The fixing device 10 further includes a temperature sensor 18 configured to detect the temperature of the fixing belt 13 and a control device 19 configured to control a passage of a high-frequency current through the induction coil 14 by incorporating a detection signal of the temperature sensor 18.

On the lower side of the facing roller 12, a guide 20 configured to feed a recording paper P to the fixing device 10 is arranged. A toner T is adhered on the surface of the recording paper P.

Figure 7:
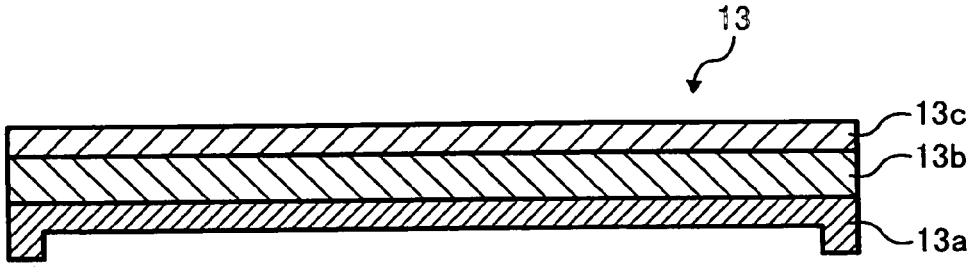
FIG. 7 is a schematic view illustrating a cross section of an embodiment of the fixing belt used for the fixing device illustrated in FIG. 5.

FIG. 7 is a schematic view illustrating a cross section of the fixing belt 13. The fixing belt 13 includes a substrate 13*a*, an elastic layer 13*b*, and a release layer 13*c*, wherein the layers 13*b* and 13*c* are overlaid on the substrate 13*a* in this order.

The substrate 13*a* is preferably an endless belt, and mainly includes a thermostable resin containing a magnetic shunt alloy powder. The magnetic shunt alloy has a Curie point lower than a temperature above which the toner causes hot offset. Specific examples of the thermostable resins include polyimides, polyamideimides, polyetheretherketones (PEEK), etc. The substrate 13*a* preferably has a thickness of from 20 to 100 μm in view of stiffness and thermal capacity of the belt.

The elastic layer 13*b* is necessary for improving uniformity of the produced images, and consists essentially of a thermostable rubber, such as silicone rubbers and fluorocarbon rubbers, having a thickness of from 100 to 300 μm.

The release layer 13*c* consists essentially of a resin having good thermostability and durability such as fluorocarbon resins, because the release layer 13*c* contacts the recording paper P and the toner T upon application of pressure.

When high-frequency current passes through the induction coil 14, the substrate 13*a* of the fixing belt 13 is heated due to electromagnetic induction, and therefore the fixing belt 13 produces a heat. The recording paper P fed on the guide 20 passes through the nip 15 formed between the fixing roller 11 and the pressing roller 16 so that the unfixed toner T in the recording paper P is fixed.

The image forming method of the present invention can also use a fixing device including a fixing roller, a facing roller arranged in parallel with the fixing roller, an endless fixing belt consisting essentially of a non-magnetic material and tightly stretched with the fixing roller and the facing roller, an induction heating means configured to heat the facing roller by electromagnetic induction, and a pressing roller configured to press the fixing roller with the fixing belt therebetween, wherein a recording medium passes through a nip formed between the fixing belt and the pressing roller so as to fix a unfixed toner image on the recording medium, and wherein the facing roller contains a magnetic shunt material, which has a Curie point lower than a temperature above which the toner causes hot offset, in the outermost layer thereof.

In this case, since the facing roller contains a magnetic shunt material, which has a Curie point lower than a temperature above which the toner causes hot offset, in the outermost layer thereof, the temperature of both ends of the fixing belt is always lower than a temperature above which the toner causes hot offset, and therefore hot offset hardly occurs at both ends of the fixing belt when large-sized papers pass through the fixing belt even after small-sized recording papers continuously pass through the fixing belt.

Figure 8:
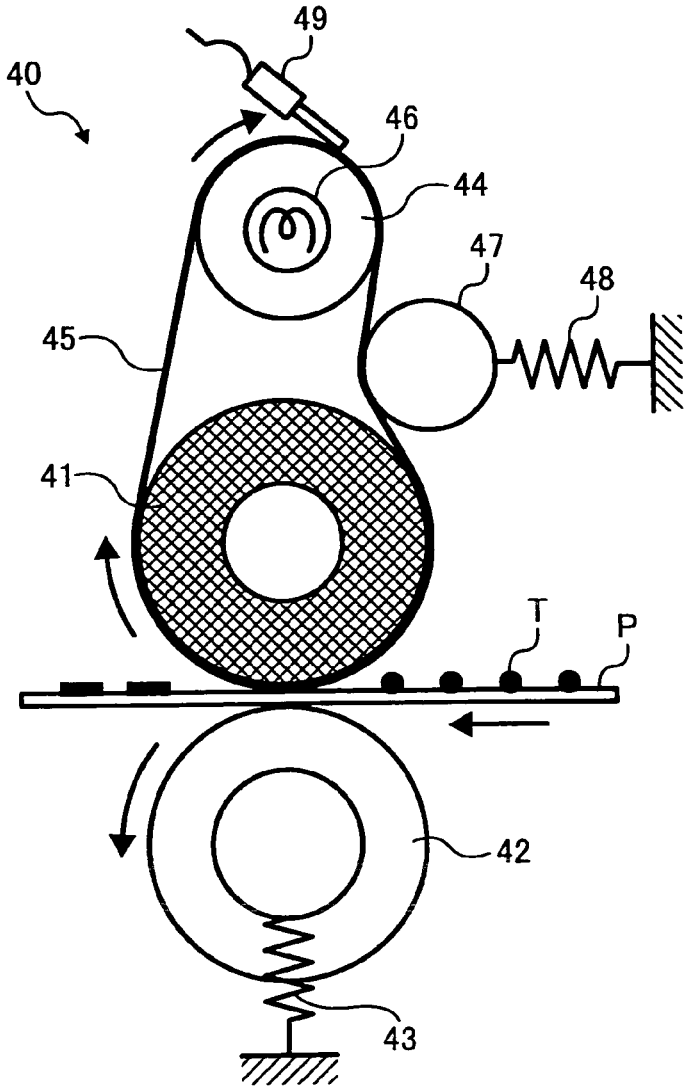
FIG. 8 is a schematic view illustrating an embodiment of another fixing device for use in the image forming method and image forming apparatus of the present invention.

FIG. 8 is a schematic view illustrating another embodiment of the fixing device for use in the present invention. A fixing device 40 includes a heating roller 44, a fixing roller 41, and a rotatable fixing belt 45 tightly stretched with the heating roller 44 and the fixing roller 41. The heating roller 44 includes a metallic cored bar, and a thermostable sponge rubber layer which is overlaid on the cored bar. The metallic cored bar contains a heating means such as a halogen lamp 46 therein, and internally heats the fixing belt with a radiant heat of the halogen lamp 46. A thermistor 49, which is an element of a temperature sensor, is arranged so as to face the heating roller 44, and contacts the central part of the fixing belt 45 to detect the surface temperature of the fixing belt 45. The heating roller 44 is temperature-controlled with a temperature controlling device (not shown) by controlling lighting of the halogen lamp 46 based on the temperature detected by the thermistor 49. A pressing roller 42 is arranged so as to contact the fixing roller 41 with the fixing belt 45 therebetween. The pressing roller 42 presses the fixing roller 41 by a force of a spring 43. The pressing roller 42 is rotated by a driving means (not shown) and the fixing roller 41 is driven thereby. A tension roller 47 is arranged on an upstream side from a nip formed with the pressing roller 42 relative to a moving direction of the fixing belt 45, so as to contact the central part of the fixing belt 45. The tension roller 47 is pressed by a spring 48, and thereby the fixing belt is held under a proper tension. Of course, the driving means may rotate the fixing roller 41, and the pressing roller 42 may be driven thereby. In addition, the pressing roller 42 and the fixing roller 41 may be engaged with a gear so that a driving force is transmitted to both the pressing roller 42 and the fixing roller 41 via the gear, i.e., both the pressing roller 42 and the fixing roller 41 may be rotated by the driving force.

In the fixing device 40, a recording paper P having a toner T thereon passes through a nip formed between the fixing belt 45 heated by the heating roller 44 and the pressing roller 42 so that the toner T is fixed on the recording paper P upon application of pressure by the pressing roller while the toner T is melted upon application of heat by the fixing belt 45.

Figure 9:
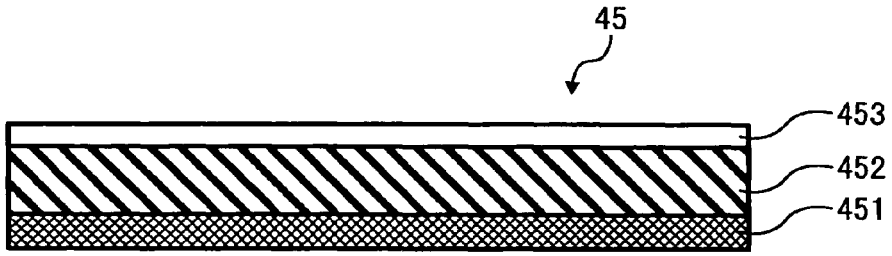
FIG. 9 is a schematic view illustrating a cross section of an embodiment of the fixing belt used for the fixing device illustrated in FIG. 8.

FIG. 9 is a schematic view illustrating a cross section of the fixing belt 45. The fixing belt 45 includes a cylindrical film substrate 451 made of a thermostable resin such as polyimides, an elastic layer 452 made of a silicone rubber, which is overlaid on the substrate 451 with a primer therebetween, and a release layer 453 made of a fluorocarbon resin and having a thickness of not less than 20 μm, which is overlaid on the elastic layer 452 with a primer therebetween. The substrate 451 consists essentially of a material having good thermostability and mechanical strength. Specific examples of such materials include thermostable resins such as polyimides, metals such as Ni and SUS, etc. In order to stabilize fixing property, the elastic layer 452 consists essentially of an elastic and adiathermic material which can apply uniform heat and pressure to toners and recording papers. The release layer 453 consists essentially of any known fluorocarbon resins such as polytetrafluoroethylenes (PTFE), tetrafluoroethylene-perfluoroalkylvinyl ether copolymers (PFA), and tetrafluoroethylene-hexafluoropropylene copolymers (FEP), and mixtures thereof. The release layer 453 is formed by being applied and subjecting to a heat treatment on the elastic layer 452 via the primer.

The fluorocarbon resin used for the release layer includes plural fluorocarbon resins, each of which has different melt flow rate (MFR). A fluorocarbon resin having a large MFR has good fluidity when the fluorocarbon resin is melted. Thereby, such a fluorocarbon resin having a large MFR can form a uniform layer thereof on the elastic layer by a heat treatment, resulting in formation of a fixing belt having a high surface smoothness. However, since the fluorocarbon resin having a large MFR has poor flexibility, cracks tend to appear after long repeated use, due to the tension by the fixing roller 41 and the heating roller 44, and the pressure from the tension roller 47. In contrast, since a fluorocarbon resin having a small MFR has good flexibility, cracks hardly appear even after long repeated use. However, such a fluorocarbon resin having a small MFR has poor fluidity when the fluorocarbon resin is melted. Therefore, the fluorocarbon resin having a small MFR cannot well flow on the elastic layer at a time of a heat treatment, resulting in formation of a nonuniform layer thereon. The resultant fixing belt has an uneven surface having concavity and convexity thereon. The fixing belt having a release layer including plural fluorocarbon resins, each of which has different MFR, has a good combination of durability and smoothness. This is because a fluorocarbon resin having a large MFR imparts high surface smoothness, and a fluorocarbon resin having a small MFR imparts good flexibility, to the resultant fixing belt.

Figure 10A:
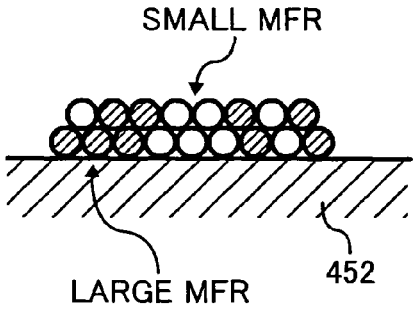
FIGS. 10A-10B are schematic views illustrating embodiments of particulate fluorocarbon resin layers formed on the elastic layer of the fixing belt illustrated in FIG. 9.
Figure 10B:
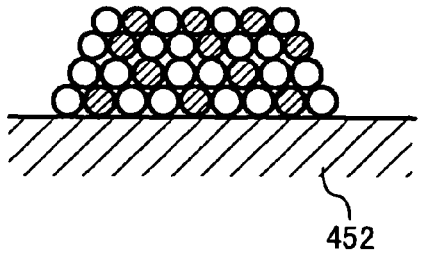

The fluorocarbon resin preferably includes a fluorocarbon resin having a large MFR in an amount of from 35 to 60% by weight, and a mixing ratio between the fluorocarbon resin having a large MFR and a fluorocarbon resin having a small MFR is preferably 1/1. A fixing belt having a release layer including nearly equal amounts of the fluorocarbon resin having a large MFR and the fluorocarbon resin having a small MFR has a good combination of durability and surface smoothness. The release layer preferably has a thickness of not less than 20 μm. When the thickness is too small, particles of the fluorocarbon resin having a large MFR and particles of the fluorocarbon resin having a small MFR cannot be sufficiently mixed on the elastic layer, and therefore a layer consisting of the fluorocarbon resin having a large MFR and a layer consisting of the fluorocarbon resin having a small MFR are separately formed. A schematic view for explaining this phenomenon is illustrated in FIG. 10A. In this case, a portion of the resultant fixing belt consisting of the fluorocarbon resin having a large MFR has poor flexibility and therefore cracks tend to appear thereon, and another portion of the resultant fixing belt consisting of the fluorocarbon resin having a small MFR has poor surface smoothness. In contrast, when the release layer has a thickness of not less than 20 μm, particles of the fluorocarbon resin having a large MFR and particles of the fluorocarbon resin having a small MFR are well mixed (i.e., dispersed) on the elastic layer. A schematic view for explaining this phenomenon is illustrated in FIG. 10B. In this case, the resultant fixing belt has a good combination of flexibility and surface smoothness.

Moreover, it is preferable that the fluorocarbon resin used for the release layer includes at least two kinds of fluorocarbon resins, each of which has different particle diameter. A particulate fluorocarbon resin having a small particle diameter can be uniformly dispersed in a solvent (such as water) because of having low cohesiveness. However, when a coating liquid including a solvent and such a particulate fluorocarbon resin having a small particle diameter is applied to the elastic layer, cracks tend to appear when the solvent is removed in the drying process. In contrast, because a particulate fluorocarbon resin having a large particle diameter has high cohesiveness, cracks hardly appear when the solvent is removed in the drying process. However, such a particulate fluorocarbon resin having a large particle diameter cannot be uniformly dispersed in a solvent (such as water). Therefore, when a coating liquid including a solvent and the particulate fluorocarbon resin having a large particle diameter is applied to the elastic layer, the particles nonuniformly adheres to the elastic layer (i.e., coating unevenness is caused). When the coating liquid includes both the particulate fluorocarbon resin having a large particle diameter and the particulate fluorocarbon resin having a small particle diameter, the particles can be uniformly dispersed in the coating liquid and uniformly adheres to the elastic layer. In the drying process, appearance of cracks can be prevented because the particulate fluorocarbon resin having a large particle diameter exists. In this case, the resultant release layer has good durability, and cracks hardly appear therein.

Figure 11:
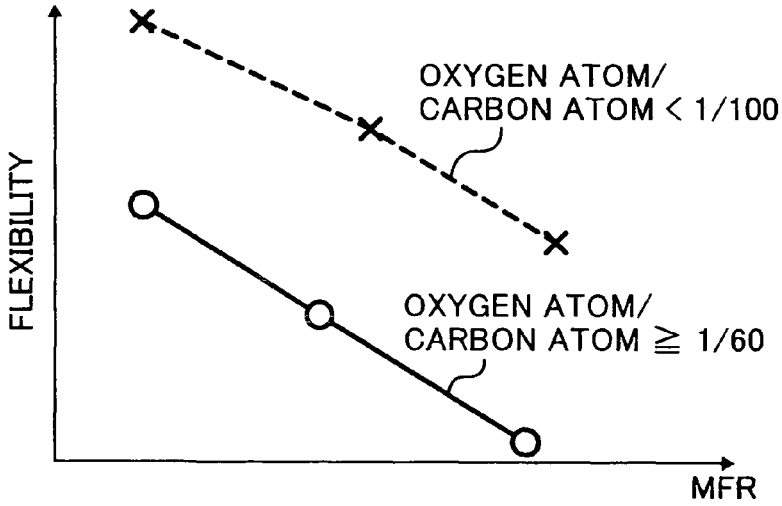
FIG. 11 is a graph illustrating the relationship between MFR and flexibility of a PFA used for the release layer of the fixing belt illustrated in FIG. 9.

The release layer 453 preferably includes a tetrafluoroethylene-perfluoroalkylvinyl ether copolymer (PFA) which has good flexibility, nonadhesiveness, and abrasion resistance. It is more preferable that a PFA including a large amount of perfluoroalkylvinyl ether units such that at an atomic ratio (i.e., oxygen atom/carbon atom) between oxygen atom and carbon atom included in one molecule is not less than 1/60, is preferably used for the release layer 453. FIG. 11 is a graph illustrating the relationship between MFR and flexibility. In the graph, when the value of the vertical axis increases, it means that flexibility decreases. It is clear from FIG. 11 that a PFA having an atomic ratio of not less than 1/60 has better flexibility than a PFA having an atomic ratio of not greater than 1/100, regardless of MFR value. It is considered that the PFA having an atomic ratio of not less than 1/60 is prevented from crystallization, and therefore flexibility thereof increases.

A heating temperature of a heat pressing device used for the above fixing process and the above fixing device is preferably from 80 to 200° C.

In the present invention, any known light fixing device can be used in combination with the fixing device, or instead of using the fixing device.

(7-5) Discharging Process

In the discharging process, a discharging bias is applied to the image bearing member so as to remove the charge therefrom with a discharging device.

As the discharging device, any known discharging device which can apply a discharging bias to the image bearing member can be used, and is not particularly limited. For example, discharging lamps are preferably used.

(7-6) Cleaning Process

In the cleaning process, residual toner particles remaining on the image bearing member are removed with a cleaning device.

As the cleaning device, any known cleaning device which can remove residual toner particles from the image bearing member can be used, and is not particularly limited. Specific examples of useable cleaning devices include, but are not limited to, magnetic brush cleaners, electrostatic brush cleaners, magnetic roller cleaners, blade cleaners, web cleaners, etc.

(7-7) Recycling Process

In the recycling process, the toner particles removed with the cleaning device are collected and transported to the developing device with a recycling device.

As the recycling device, any known transport device can be used, and is not particularly limited.

(7-8) Controlling Process

In the controlling process, each image forming process is controlled with a controlling device.

Specific examples of the controlling devices include sequencers, computers, etc., but are not limited thereto.

(7-9) Image Forming Apparatus

Figure 12:
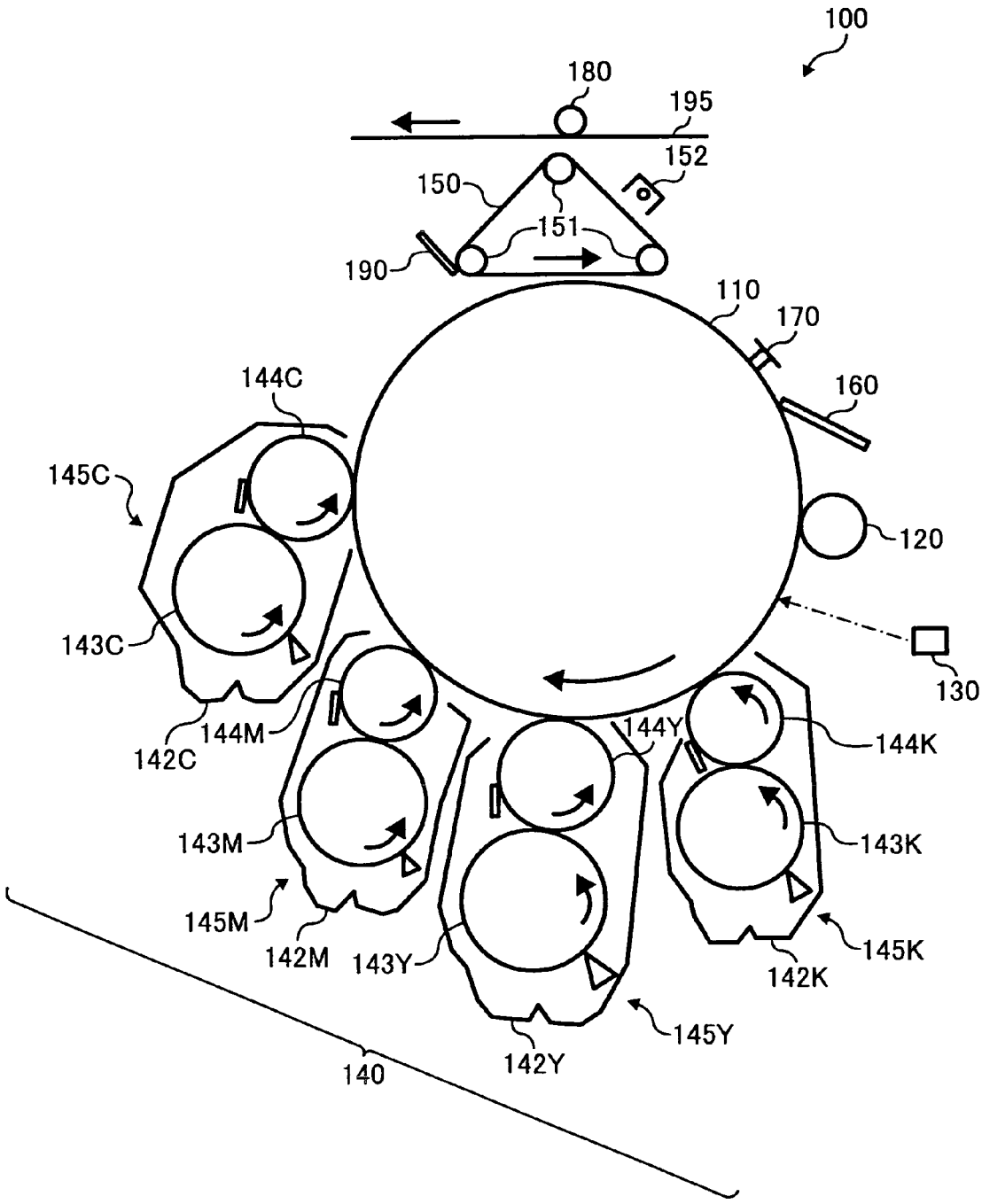
FIG. 12 is a schematic view illustrating an embodiment of the image forming apparatus of the present invention.

FIG. 12 is a schematic view illustrating an embodiment of the image forming apparatus of the present invention. An image forming apparatus 100 includes a photoreceptor 110 serving as an image bearing member, a charging roller 120 serving as a charging device, a light irradiator 130, a developing device 140, an intermediate transfer medium 150, a cleaning device 160 including a cleaning blade, and a discharging lamp 170 serving as a discharging device.

The intermediate transfer medium 150 is an endless belt. The intermediate transfer medium 150 is tightly stretched with three rollers 151 to move endlessly in the direction indicated by an arrow. Some of the rollers 151 have a function of applying a transfer bias (primary transfer bias) to the intermediate transfer medium 150. A cleaning device 190 including a cleaning blade is arranged close to the intermediate transfer medium 150. A transfer roller 180 is arranged facing the intermediate transfer medium 150. The transfer roller 180 can apply a transfer bias to a transfer paper 195, serving as a final transfer material, to transfer (i.e., secondary transfer) a toner image. A corona charger 152 configured to charge the toner image on the intermediate transfer medium 150 is arranged on a downstream side from a contact point of the photoreceptor 110 and the intermediate transfer medium 150, and a upstream side from a contact point of the intermediate transfer medium 150 and the transfer paper 195, relative to the rotating direction of the intermediate transfer medium 150.

The developing device 140 includes a black developing unit 145K, a yellow developing unit 145Y, a magenta developing unit 145M and a cyan developing unit 145C, arranged around the photoreceptor 110. The developing units 145K, 145Y, 145M and 145C include developer containers 142K, 142Y, 142M and 142C, developer feeding rollers 143K, 143Y, 143M and 143C, and developing rollers 144K, 144Y, 144M and 144C, respectively.

In the image forming apparatus 100, the photoreceptor 110 is uniformly charged by the charging roller 120, and then the light irradiator 130 irradiates the photoreceptor 110 with a light containing image information to form an electrostatic latent image thereon. The electrostatic latent image formed on the photoreceptor 110 is developed with a toner supplied from the developing device 140, to form a toner image. The toner image is transferred onto the intermediate transfer medium 150 due to a bias applied to a roller 151 (i.e., primary transfer), and then transferred onto the transfer paper 195 (i.e., secondary transfer). Toner particles remaining on the photoreceptor 110 are removed using the cleaning device 160, and the photoreceptor 110 is once discharged by the discharging lamp 170.

Figure 13:
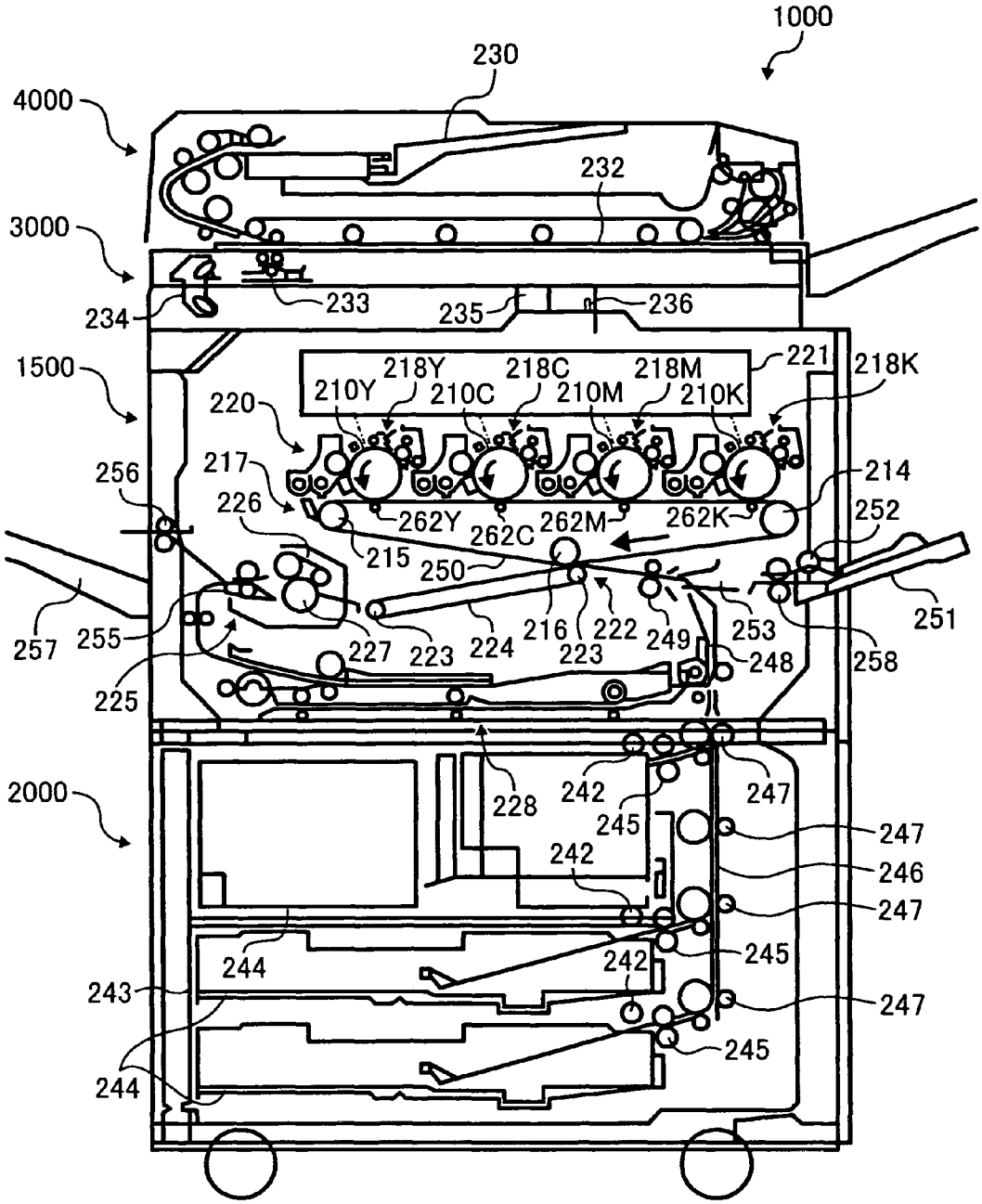
FIG. 13 is a schematic view illustrating another embodiment of the image forming apparatus of the present invention.

FIG. 13 is a schematic view illustrating another embodiment of the image forming apparatus of the present invention. An image forming apparatus 1000 is a tandem-type color image forming apparatus. The image forming apparatus 1000 includes a main body 1500, a paper feeding table 2000, a scanner 3000 and an automatic document feeder (ADF) 4000.

An intermediate transfer medium 250 is arranged in the center of the main body 1500. The intermediate transfer medium 250 is an endless belt. The intermediate transfer medium 250 is tightly stretched with support rollers 214, 215 and 216 to rotate in a clockwise direction. A cleaning device 217, configured to remove residual toner particles remaining on the intermediate transfer medium 250, is arranged close to the support roller 215. A tandem-type image forming device 220 including image forming units 218Y, 218C, 218M and 218K is arranged facing the intermediate transfer medium 250. The image forming units 218Y, 218C, 218M and 218K are arranged in this order around the intermediate transfer medium 250 relative to the rotating direction thereof. A light irradiator 221 is arranged close to the tandem-type image forming device 220. A secondary transfer device 222 is arranged on the opposite side of the intermediate transfer medium 250 relative to the tandem-type image forming device 220. The secondary transfer device 222 includes a secondary transfer belt 224 tightly stretched with a pair of rollers 223. The secondary transfer belt 224 is an endless belt. A transfer paper transported on the secondary transfer belt 224 can contact the intermediate transfer medium 250. A fixing device 225 is arranged close to the secondary transfer device 222. The fixing device 225 includes a fixing belt 226 and a pressing roller 227 configured to press the fixing belt 226. For example, the above-mentioned fixing device can be used for the fixing device 225.

In the image forming apparatus 1000, a reversing device 228 configured to reverse a transfer paper to form images on both sides of the transfer paper is arranged close to the secondary transfer device 222 and the fixing device 225.

Next, a procedure of forming a full color image with the image forming apparatus 1000 will be explained. An original document is set to a document feeder 230 included in the automatic document feeder (ADF) 4000, or placed on a contact glass 232, included in the scanner 3000.

When a start switch button (not shown) is pushed, the scanner 3000 starts to drive, and a first runner 233 and a second runner 234 start to move. When the original document is set to the document feeder 230, the scanner 3000 starts to drive after the original document is fed on the contact glass 232. The original document is irradiated with a light emitted by a light source via the first runner 233, and the light reflected from the original document is then reflected by a mirror included in the second runner 234. The light passes through an imaging lens 235 and is received by a reading sensor 236. Thus, image information of each color is read.

Image information of each color (yellow, cyan, magenta and black) is transported to each image forming units 218Y, 218C, 218M and 218K to form each toner image.

Figure 14:
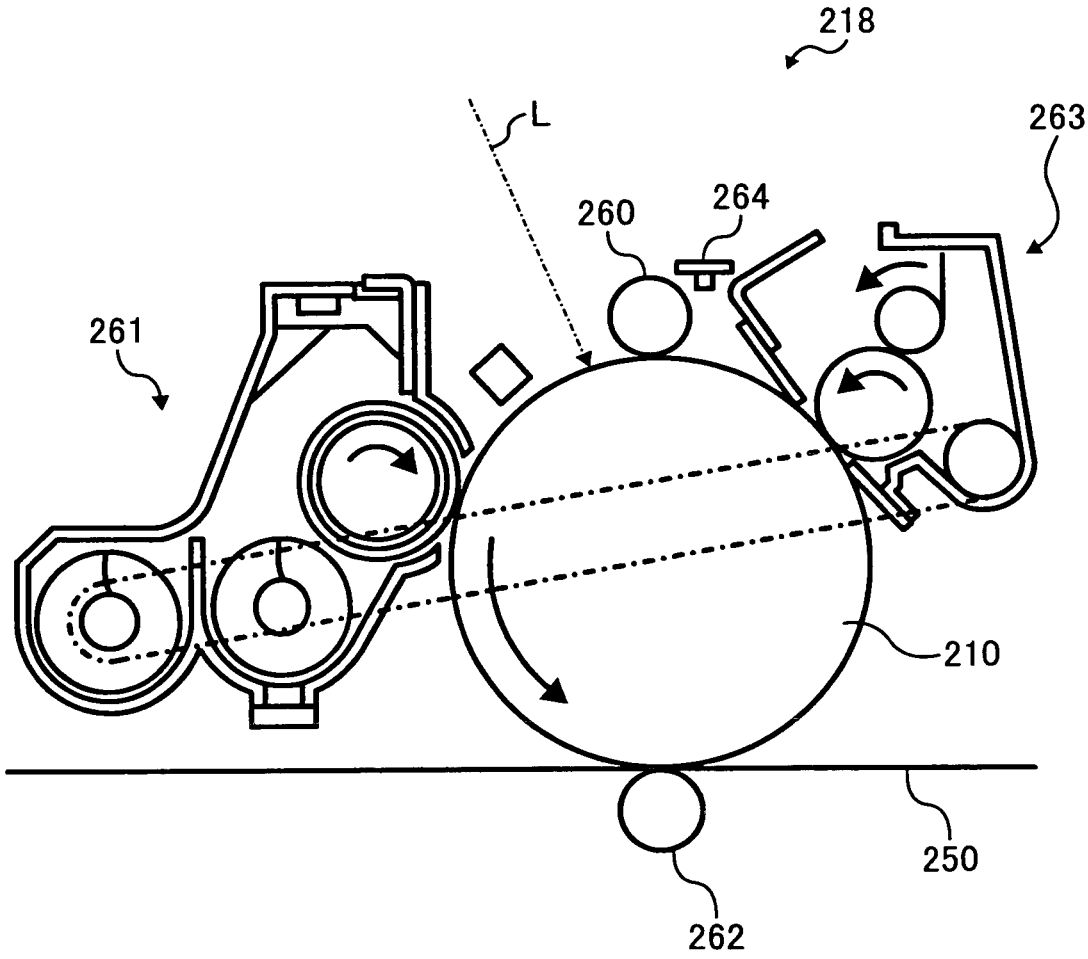
FIG. 14 is a schematic view illustrating an embodiment of the image forming unit included in the image forming apparatus illustrated in FIG. 13.

FIG. 14 is a schematic view illustrating an embodiment of the image forming units 218Y, 218C, 218M and 218K. Since the image forming units 218Y, 218C, 218M and 218K have the same configuration, only one image forming unit is illustrated in FIG. 14. Symbols Y, C, M and K, which represent each of the colors, are omitted from the reference number.

The image forming device 218 includes a photoreceptor 210, a charger 260 configured to uniformly charge the photoreceptor 210, a light irradiator (not shown) configured to form an electrostatic latent image on the photoreceptor 210 by irradiating a light L containing image information corresponding to color information, a developing device 261 configured to form a toner image by developing the electrostatic latent image with a developer including a toner, a transfer charger 262 configured to transfer the toner image to the intermediate transfer medium 250, a cleaning device 263, and a discharging device 264. Each of the image forming devices can form a single-color image based on each of color information.

The thus prepared toner image formed on the photoreceptor 210 of each color is transferred onto the intermediate transfer medium 250 one by one (i.e., a primary transfer). Namely, a full-color image is formed by overlaying the toner images of each color.

On the other hand, referring to FIG. 13, in the paper feeding table 2000, a recording paper is fed from one of multistage paper feeding cassettes 244, included in a paper bank 243, by rotating one of paper feeding rollers 242. The recording paper is separated by separation rollers 245 and fed to a paper feeding path 246. Then the recording paper is transported to a paper feeding path 248, included in the main body 1500, by transport rollers 247, and is stopped by a registration roller 249. When the recording paper is fed from a manual paper feeder 251 by rotating a paper feeding roller 252, the recording paper is separated by a separation roller 258 and fed to a manual paper feeding path 253, and is stopped by the registration roller 249. The registration roller 249 is typically grounded, however, a bias can be applied to the registration roller 249 in order to remove a paper powder.

The recording paper is timely fed to an area formed between the intermediate transfer medium 250 and the secondary transfer device 222, by rotating the registration roller 249, to meet the full-color toner image formed on the intermediate transfer medium 250. The full-color toner image is transferred onto the recording material in the secondary transfer device 222 (secondary transfer). Toner particles remaining on the intermediate transfer medium 250 are removed using the cleaning device 217.

The recording material having the toner image thereon is transported from the secondary transfer device 222 to the fixing device 225. The toner image is fixed on the recording material upon application of heat and pressure thereto in the fixing device 225. The recording paper is switched by a switch pick 255 and ejected by an ejection roller 256 and then stacked on an ejection tray 257. When the recording paper is switched by the switch pick 255 to be reversed in the reverse device 228, the recording paper is fed to a transfer area again in order to form a toner image on the backside thereof. And then the recording paper is ejected by the ejection roller 256 and stacked on the ejection tray 257.

Figure 15:
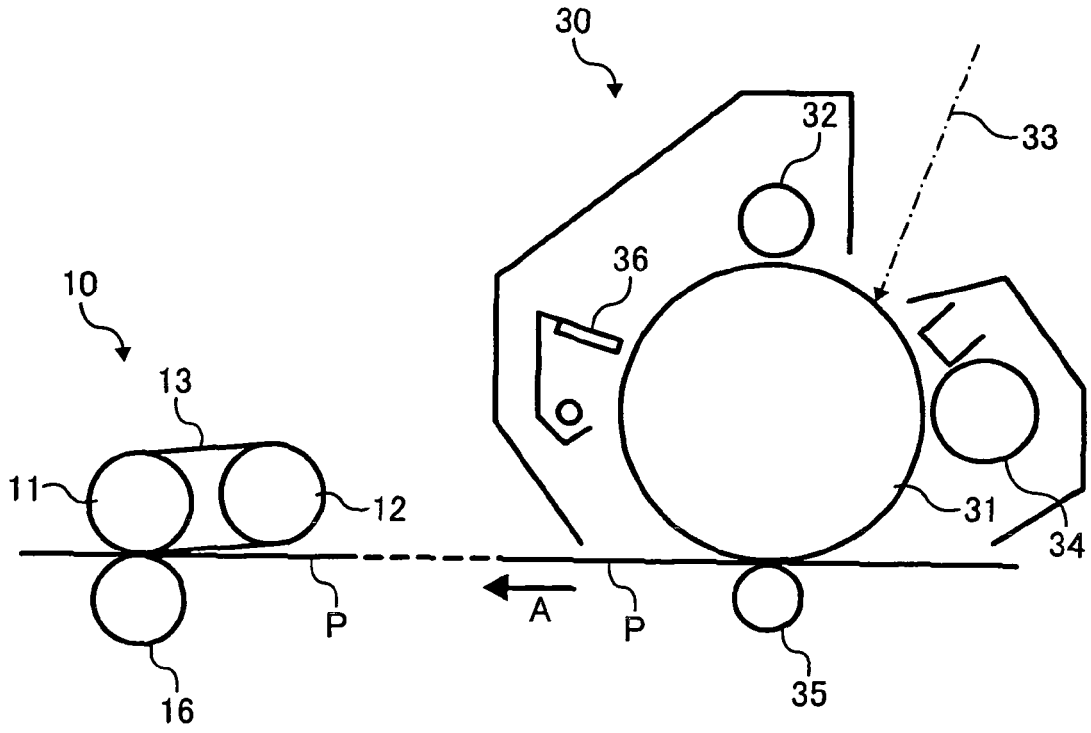
FIG. 15 is a schematic view illustrating an embodiment of the image forming apparatus which is used in Examples of the present invention.

FIG. 15 is a schematic view illustrating another embodiment of the image forming apparatus of the present invention, which is used for after-mentioned Examples of the present invention. An image forming apparatus 30 includes a photoreceptor 31. Around the photoreceptor 31, a charging roller 32 configured to charge the photoreceptor 31 and arranged in contact therewith or close thereto, a light irradiator (not shown) configured to irradiate the charged photoreceptor 31 with a light 33 to form an electrostatic latent image thereon, a developing roller 34 configured to adhere a toner to the electrostatic latent image formed on the photoreceptor 31 to form a toner image, a transfer roller 35 configured to transfer the toner image formed on the photoreceptor 31 to a recording paper P, and a cleaning device 36 configured to remove residual toner particles remaining on the photoreceptor after the transfer, are arranged in this order.

The fixing device 10 is arranged on a downstream side from the photoreceptor 31 relative to a direction in which the recording paper is transported (indicated by an arrow A).

The image forming method of the present invention efficiently produces high quality images since the method uses the toner of the present invention, which has a small particle diameter, a narrow particle diameter distribution, good releasability at low temperatures, good toner filming resistance, and a good combination of low temperature fixability and thermostable preservability.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Unmodified Polyester (1) (Low Molecular Weight Polyester (1))

The following components were fed in a reaction vessel equipped with a condenser, a stirrer and a nitrogen feed pipe.

| | |
|---|---|
| Ethylene oxide (2 mole) adduct of bisphenol A | 229 parts |
| Propylene oxide (3 mole) adduct of bisphenol A | 529 parts |

-continued

| | |
|---|---|
| Terephthalic acid | 208 parts |
| Adipic acid | 46 parts |
| Dibutyltin oxide | 2 parts |

The mixture was reacted for 8 hours at 230° C. under normal pressure.

Then the reaction was further continued for 5 hours under a reduced pressure of 10 to 15 mmHg.

Further, 44 parts of trimellitic anhydride was fed to the container to be reacted with the reaction product for 2 hours at 180° C. Thus, a unmodified polyester (1) was prepared.

The unmodified polyester (1) had a number average molecular weight (Mn) of 2,500, a weight average molecular weight (Mw) of 6,700, a glass transition temperature (Tg) of 43° C., and an acid value of 25 mgKOH/g.

Preparation of Master Batch (1)

The following components were mixed with a HENSCHEL MIXER (manufactured by Mitsui Mining Co., Ltd.).

| | |
|---|---|
| Water | 1200 parts |
| Carbon black (PRINTEX 35 from Degussa AG, DBP absorption value of 42 ml/100 g, pH of 9.5) | 540 parts |
| Unmodified polyester (1) | 1200 parts |

The mixture was kneaded for 30 minutes at 150° C. with a two-roll mill, and then subjected to rolling and cooling. The rolled mixture was pulverized using a pulverizer (manufactured by Hosokawa Micron Corporation). Thus, a master batch (1) was prepared.

Preparation of Wax Dispersion Liquid (1)

In a reaction vessel equipped with a stirrer and a thermometer, 378 parts of the unmodified polyester (1), 110 parts of a paraffin wax A (having a melting point of 78° C.), and 947 parts of ethyl acetate were mixed and the mixture was heated to 80° C. while agitated. After being heated at 80° C. for 5 hours, the mixture was cooled to 30° C. over 1 hour. Thus, a wax dispersion liquid (1) was prepared.

The wax particles contained in the wax dispersion liquid (1) have a volume average particle diameter (Dv) of 0.160 μm, which is determined using a laser light scattering type particle size distribution analyzer LA-920 (manufactured by Horiba Ltd.), and includes coarse particles having a volume average particle diameter (Dv) of 0.8 μm or more in an amount of 5% or less.

Preparation of Wax Dispersion Liquid (2)

The procedure for preparation of the wax dispersion liquid (1) was repeated except that the paraffin wax A (having a melting point of 78° C.) was replaced with a paraffin wax B (having a melting point of 68° C.). Thus, a wax dispersion liquid (2) was prepared.

The wax particles contained in the wax dispersion liquid (2) have a volume average particle diameter (Dv) of 0.130 μm, which is determined using a laser light scattering type particle size distribution analyzer LA-920 (manufactured by Horiba Ltd.), and includes coarse particles having a volume average particle diameter (Dv) of 0.8 μm or more in an amount of 3% or less.

Preparation of Wax Dispersion Liquid (3)

The procedure for preparation of the wax dispersion liquid (1) was repeated except that the paraffin wax A (having a melting point of 78° C.) was replaced with a polyethylene wax (having a melting point of 82° C.). Thus, a wax dispersion liquid (3) was prepared.

The wax particles contained in the wax dispersion liquid (3) have a volume average particle diameter (Dv) of 0.182 μm, which is determined using a laser light scattering type particle size distribution analyzer LA-920 (manufactured by Horiba Ltd.), and includes coarse particles having a volume average particle diameter (Dv) of 0.8 μm or more in an amount of 5% or less.

Preparation of Wax Dispersion Liquid (4)

The procedure for preparation of the wax dispersion liquid (1) was repeated except that the paraffin wax A (having a melting point of 78° C.) was replaced with a polypropylene wax (having a melting point of 86° C.). Thus, a wax dispersion liquid (4) was prepared.

The wax particles contained in the wax dispersion liquid (4) have a volume average particle diameter (Dv) of 0.162 μm, which is determined using a laser light scattering type particle size distribution analyzer LA-920 (manufactured by Horiba Ltd.), and includes coarse particles having a volume average particle diameter (Dv) of 0.8 μm or more in an amount of 5% or less.

Preparation of Wax Dispersion Liquid (5)

The procedure for preparation of the wax dispersion liquid (1) was repeated except that the cooling time was changed from 1 hour to 0.5 hours. Thus, a wax dispersion liquid (5) was prepared.

The wax particles contained in the wax dispersion liquid (5) have a volume average particle diameter (Dv) of 0.676 μm, which is determined using a laser light scattering type particle size distribution analyzer LA-920 (manufactured by Horiba Ltd.), and includes coarse particles having a volume average particle diameter (Dv) of 0.8 μm or more in an amount of 29%.

Preparation of Wax Dispersion Liquid (6)

The procedure for preparation of the wax dispersion liquid (1) was repeated except that the paraffin wax A (having a melting point of 78° C.) was replaced with a wax having a carbonyl group (having a melting point of 116° C.). Thus, a wax dispersion liquid (6) was prepared.

The wax particles contained in the wax dispersion liquid (6) have a volume average particle diameter (Dv) of 0.550 μm, which is determined using a laser light scattering type particle size distribution analyzer LA-920 (manufactured by Horiba Ltd.), and includes coarse particles having a volume average particle diameter (Dv) of 0.8 μm or more in an amount of 20%.

Example 1

Preparation of Wax/Colorant Dispersion (1)

At first, 1435 parts of the wax dispersion liquid (1), 500 parts of the master batch (1), and 500 parts of ethyl acetate were mixed and agitated for 1 hour to prepare a raw material dispersion (1).

Then 1324 parts of the raw material dispersion (1) was subjected to a dispersion treatment using a bead mill (ULTRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of a 65% ethyl acetate solution of the unmodified polyester (1) were added thereto. The mixture was subjected to the dispersion treatment using the bead mill. The dispersion conditions are the same as those mentioned above except that the dispersion operation was performed once (i.e., one pass).

Thus, a wax/colorant dispersion (1) was prepared. A solid content of the wax/colorant dispersion (1) was 50% by weight (when the liquid was heated for 30 minutes at 130° C.).

Preparation of prepolymer (1)

The following components were fed in a reaction vessel equipped with a condenser, a stirrer and a nitrogen feed pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture was reacted for 7 hours at 230° C. under normal pressure.

Then the reaction was further continued for 5 hours under a reduced pressure of 10 to 15 mmHg. Thus, an intermediate polyester (1) was prepared.

The intermediate polyester (1) had a number average molecular weight (Mn) of 2,200, a weight average molecular weight (Mw) of 9,700, a peak molecular weight of 3,000, a glass transition temperature (Tg) of 54° C., an acid value of 0.5 mgKOH/g, and a hydroxyl value of 52 mgKOH/g.

In a reaction vessel equipped with a condenser, a stirrer and a nitrogen feed pipe, 410 parts of the intermediate polyester (1), 89 parts of isophorone diisocyanate, and 500 parts of ethyl acetate were mixed and the mixture was heated for 5 hours at 100° C. to perform the rcaction. Thus, a polyester prepolymer (1) having an isocyanate group was prepared. The content of free isocyanate in the prepolymer (1) was 1.53% by weight.

Synthesis of Ketimine (1) (Compound Having Active Hydrogen Group)

In a reaction vessel equipped with a stirrer and a thermometer, 170 parts of isophorone diamine and 75 parts of methyl ethyl ketone were mixed and reacted for 5 hours at 50° C. to prepare a ketimine compound (1) (i.e., a compound having an active hydrogen group). The ketimine compound (1) had an amine value of 418 mgKOH/g.

Preparation of Toner Constituent Mixture Liquid (1)

The following components were mixed in a vessel.

| | |
|---|---|
| Wax/colorant dispersion (1) prepared above | 749 parts |
| Prepolymer (1) prepared above | 115 parts |
| Ketimine compound (1) prepared above | 2.9 parts |

The components were mixed for 1 minute using a mixer TK HOMOMIXER (from Tokushu Kika Kogyo K.K.) at a revolution of 7.5 m/s. Thus, a toner constituent mixture liquid (1) was prepared.

Preparation of Particulate Resin (1)

In a reaction vessel equipped with a stirrer and a thermometer, 683 parts of water, 20 parts of a sodium salt of sulfate of an ethylene oxide adduct of methacrylic acid (ELEMINOL RS-30 from Sanyo Chemical Industries Ltd.), 78 parts of styrene, 78 parts of methacrylic acid, 120 parts of butyl acrylate, and 1 part of ammonium persulfate were contained and the mixture was agitated with the stirrer for 15 minutes at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion (1) (i.e., particle dispersion (1)) of a vinyl resin (1) (i.e., a copolymer of styrene/methacrylic acid/butyl acrylate/sodium salt of sulfate of ethylene oxide adduct of methacrylic acid) was prepared.

The particulate vinyl resin (1) had a volume average particle diameter of 55 nm, which is determined by a particle size distribution analyzer NANOTRAC® UPA-150EX (manufactured by Nikkiso Co., Ltd.). A part of the particle dispersion (1) was dried to isolate the resin. The vinyl resin (1) had a glass transition temperature (Tg) of 48° C., and a weight average molecular weight (Mw) of 450,000.

Preparation of Water Phase (1)

990 parts of water, 37 parts of an aqueous solution of a sodium salt of dodecyldiphenyletherdisulfonic acid (ELEMINOL MON-7 from Sanyo Chemical Industries Ltd., solid content of 48.5%), 15 parts of the particle dispersion (1) prepared above, and 90 parts of ethyl acetate were mixed. As a result, a water phase (1) was prepared.

Emulsification or Dispersion 1200 parts of the water phase (1) were added to the toner constituent mixture liquid (1). The mixture was agitated for 20 minutes with a mixer TK HOMOMIXER at a revolution of 15 m/s. As a result, O/W dispersion (1) (i.e., an emulsion slurry (1)) was prepared.

Solvent Removal

The particle-diameter-controlled emulsion slurry (1) was fed into a container equipped with a stirrer and a thermometer, and the emulsion slurry (1) was heated for 8 hours at 30° C. to remove the organic solvent (ethyl acetate) therefrom. Then the emulsion slurry (1) was aged for 4 hours at 45° C. Thus, a dispersion slurry (1) was prepared.

The particles included in the dispersion slurry (1) had a volume average particle diameter of 4.3 μm and a number average particle diameter of 3.8 μm, which is measured using MULTISIZER III (manufactured by Beckman Coulter, Inc.).

Washing and Drying

One hundred (100) parts of the dispersion slurry (1) was filtered under a reduced pressure.

The thus obtained wet cake was mixed with 100 parts of ion-exchange water and the mixture was agitated for 10 minutes with a TK HOMOMIXER at a revolution of 10.0 m/s, followed by filtering. Thus, a wet cake (i) was prepared.

The wet cake (i) was mixed with 100 parts of ion-exchange water and the mixture was agitated for 10 minutes with a TK HOMOMIXER at a revolution of 10.0 m/s, followed by filtering under a reduced pressure. Thus, a wet cake (ii) was prepared.

The wet cake (ii) was mixed with 100 parts of a 10% aqueous solution of sodium hydroxide and the mixture was agitated for 10 minutes with a TK HOMOMIXER at a revolution of 10.0 m/s, followed by filtering. Thus, a wet cake (iii) was prepared.

The wet cake (iii) was mixed with 300 parts of ion-exchange water and the mixture was agitated for 10 minutes with a TK HOMOMIXER at a revolution of 10.0 m/s, followed by filtering. This washing operation was performed twice. Thus, a wet cake (iv) was prepared.

The wet cake (iv) was dried for 48 hours at 45° C. using a circulating air drier, followed by sieving with a screen having openings of 75 μm. Thus, a mother toner (1) was prepared.

External Treatment

One hundred (100) parts of the prepared mother toner (1) were mixed with 1.5 parts of a hydrophobized silica and 0.5 parts of a hydrophobized titanium oxide using a HENSHEL MIXER (manufactured by Mitsui Mining Co., Ltd.), followed by sieving with a screen having openings of 35 μm. Thus, a toner (1) was prepared.

Example 2

The procedure for preparation of the toner (1) in Example 1 was repeated except that the wax dispersion liquid (1) was replaced with the wax dispersion liquid (2). Thus, a toner (2) was prepared.

Example 3

The procedure for preparation of the toner (1) in Example 1 was repeated except that the wax dispersion liquid (1) was replaced with the wax dispersion liquid (3). Thus, a toner (3) was prepared.

Example 4

The procedure for preparation of the toner (1) in Example 1 was repeated except that the wax dispersion liquid (1) was replaced with the wax dispersion liquid (4). Thus, a toner (4) was prepared.

Example 5

The procedure for preparation of the toner (1) in Example 1 was repeated except that the wax dispersion liquid (1) was replaced with the wax dispersion liquid (5). Thus, a toner (5) was prepared.

Example 6

The procedure for preparation of the toner (1) in Example 1 was repeated except that the amount of the wax dispersion liquid (1) was changed from 1435 parts to 718 parts and the amount of the 65% ethyl acetate solution of the unmodified polyester was changed from 1324 parts to 1700 parts, which were added to the toner constituent mixture liquid. Thus, a toner (6) was prepared.

Example 7

The procedure for preparation of the toner (2) in Example 2 was repeated except that the amount of the wax dispersion liquid (2) was changed from 1435 parts to 718 parts and the amount of the 65% ethyl acetate solution of the unmodified polyester was changed from 1324 parts to 1700 parts, which were added to the toner constituent mixture liquid. Thus, a toner (7) was prepared.

Example 8

The procedure for preparation of the toner (3) in Example 3 was repeated except that the amount of the wax dispersion liquid (3) was changed from 1435 parts to 718 parts and the amount of the 65% ethyl acetate solution of the unmodified polyester was changed from 1324 parts to 1700 parts, which were added to the toner constituent mixture liquid. Thus, a toner (8) was prepared.

Comparative Example 1

The procedure for preparation of the toner (1) in Example 1 was repeated except that the wax dispersion liquid (1) was replaced with the wax dispersion liquid (6). Thus, a comparative toner (C1) was prepared.

The volume average particle diameter (Dv), the number average particle diameter (Dn), and the particle diameter distribution (Dv/Dn) of the prepared toners were measured using a MULTISIZER II (manufactured by Beckman Coulter, Inc.) with an aperture of 100 μm. The results and toner properties were shown in Table 1.

TABLE 1

| | Wax | | | | | | Toner | | |
|---|---|---|---|---|---|---|---|---|---|
| | Dispersion liquid No. | Component | Melting point (° C.) | Particle diameter (μm) | Total wax (%) | Surface wax (%) | Dv (μm) | Dn (μm) | Dv/Dn |
| Ex. 1 | (1) | Paraffin A | 78 | 0.160 | 3.8 | 1.8 | 5.2 | 4.6 | 1.13 |
| Ex. 2 | (2) | Paraffin B | 68 | 0.130 | 3.7 | 1.9 | 5.0 | 4.5 | 1.11 |
| Ex. 3 | (3) | Polyethylene | 82 | 0.182 | 3.9 | 1.7 | 4.8 | 4.2 | 1.14 |
| Ex. 4 | (4) | Polypropylene | 86 | 0.162 | 3.7 | 1.6 | 5.4 | 4.8 | 1.13 |
| Ex. 5 | (5) | Paraffin A | 78 | 0.676 | 3.8 | 2.0 | 5.1 | 4.6 | 1.11 |
| Ex. 6 | (1) | Paraffin A | 78 | 0.160 | 1.9 | 1.7 | 5.3 | 4.7 | 1.13 |
| Ex. 7 | (2) | Paraffin B | 68 | 0.130 | 1.9 | 1.8 | 5.1 | 4.6 | 1.11 |
| Ex. 8 | (3) | Polyethylene | 82 | 0.182 | 1.9 | 1.8 | 5.2 | 4.6 | 1.13 |
| Comp. Ex. 1 | (6) | Wax having carbonyl group | 116 | 0.550 | 6.4 | 4.4 | 5.3 | 4.5 | 1.18 |

Next, 2.5 parts of each of the toners (1) to (8) and (C1), prepared in Examples 1 to 8 and Comparative Example 1, were mixed with 97.5 parts of a ferrite carrier (a core of which has a particle diameter of 45 μm) covered with a silicone using a TURBLER MIXER to prepare a developer.

Preparation of Fixing Belt (1)

A fixing belt (1) having a configuration illustrated in FIG. 7 was prepared. The substrate 13*a* of the fixing belt (1) was made of a material in which a magnetic shunt material was dispersed.

Preparation of Fixing Belt (2)

A fixing belt (2) having a configuration illustrated in FIG. 7 was prepared. The substrate 13*a* of the fixing belt (2) was made of a material in which no magnetic shunt material was dispersed.

Preparation of Facing Roller (1)

A facing roller (1) having a configuration illustrated in FIG. 6 was prepared.

FIG. 6 is a schematic view illustrating a cross section of the upper half of the facing roller 12 illustrated in FIG. 5. The facing roller 12 includes a cylindrical portion 12*a* and rotation supporting portions 12*b* arranged on both ends of the cylindrical portion 12*a*. The rotation supporting portions 12*b* are supported with the main body of the fixing device via bearings.

Both end portions of the internal surface of the facing roller 12 are shaved so that the wall thickness of the central portion 12*c* is larger than that of the end portions 12*d*, in the axial direction of the facing roller 12. For example, the central portion 12*c* has a wall thickness of 0.6 mm and each of the end portions has a wall thickness of 0.3 mm.

Preparation of Facing Roller (2)

The procedure for preparation of the facing roller (1) was repeated except that the cylindrical portion was not shaved. Thus, a facing roller (2) was prepared.

Preparation of Fixing Device (1)

The fixing belt (1) and the facing roller (2) were set in the fixing device 10 illustrated in FIG. 5. Thus, a fixing device (1) was prepared.

Preparation of Fixing Device (2)

The fixing belt (1) and the facing roller (1) were set in the fixing device 10 illustrated in FIG. 5. Thus, a fixing device (2) was prepared.

Preparation of Fixing Device (3)

The fixing belt (2) and the facing roller (2) were set in the fixing device 10 illustrated in FIG. 5. Thus, a fixing device (3) was prepared.

Evaluations were performed on the prepared developers as follows. The results are shown in Table 2.

(1-a) Fixability (Hot Offset Resistance and Low Temperature Fixability)

Fixability was evaluated using a modified full-color electrophotographic apparatus IPSIO COLOR 8100 (manufactured and modified by Ricoh Co., Ltd) utilizing an oilless fixing method. A fixing device described in Table 2 was set to the above modified full-color electrophotographic apparatus.

Hot offset resistance was evaluated by the maximum fixable temperature. Solid images having 0.9 to 1.1 mg/cm$^2$ of a toner thereon were produced on a transfer paper TYPE 6000-70W (from Ricoh Co., Ltd.). The solid images on transfer papers were fixed at various temperatures to determine the maximum fixable temperature above which the hot offset occurs. Hot offset resistance is graded as follows.

Very good: Maximum fixable temperature is 210° C. or more

Good: Maximum fixable temperature is 200° C. or more and less than 210° C.

Average: Maximum fixable temperature is 190° C. or more and less than 200° C.

Poor: Maximum fixable temperature is less than 190° C.

Low temperature fixability was evaluated by the minimum fixable temperature. Solid images having 0.9 to 1.1 mg/cm$^2$ of a toner thereon were produced on a transfer paper TYPE 6200 (from Ricoh Co., Ltd.). The solid images on transfer papers were fixed at various temperatures to determine the minimum fixable temperature below which the residual rate of the image density was less than 70% when the fixed image was rubbed with a pad. Low temperature fixability was graded as follows.

Very good: Minimum fixable temperature is less than 100° C.

Good: Minimum fixable temperature is 100° C. or more and less than 110° C.

Average: Minimum fixable temperature is 110° C. or more and less than 120° C.

Poor: Minimum fixable temperature is 120° C. or more (1-b) Thermostable Preservability Thermostable preservability was evaluated by penetration. Penetration was measured by the following method based on JIS K2235-1991. At first, a 50 ml glass container was filled with a toner and the container was put in a thermostatic chamber for 20 hours at 50° C., and then the toner was cooled to room temperature and subjected to the penetration test. The larger penetration a toner has, the better thermostable preservability the toner has. Thermostable preservability is graded as follows.

Very good: Penetration is 20 mm or more

Good: Penetration is 15 mm or more and less than 20 mm

Average: Penetration is 10 mm or more and less than 15 mm

Poor: Penetration is less than 10 mm (1-c) Toner Filming Resistance

A developer was set in a full-color electrophotographic apparatus IPSIO COLOR 8100 (manufactured and modified by Ricoh Co., Ltd), and then a running test in which 50,000 copies were continuously produced was performed. After the running test, the developing roller and the photoreceptor were visually observed whether toner films were formed thereon. Toner filming resistance is graded as follows.

Very good: No toner film was observed

Good: Few linear toner films were observed

Average: Linear toner films were partially observed

Poor: Toner films were observed all over the developing roller and/or the photoreceptor (1-d) Image Density A developer was set in a full-color electrophotographic apparatus IPSIO COLOR 8100 (manufactured and modified by Ricoh Co., Ltd), and then a solid image having 0.9 to 1.1 mg/cm$^2$ of a toner thereon were produced on a transfer paper TYPE 6200 (from Ricoh Co., Ltd.) and fixed at a temperature of from 158° C. to 162° C. The image density of the produced solid image is determined by averaging image densities of five randomly selected portions of the solid image measured with a spectrodensitometer X-RITE 938 (from X-rite Inc.). The higher image density a toner has, the higher ability of producing high quality images the toner has. The image density is graded as follows.

Good: Image density was 1.4 or more

Poor: Image density was less than 1.4

(1-e) Wax Dispersibility

Wax dispersibility was evaluated by visually observing a cross section of a toner with a transmission electron microscope (TEM). Wax dispersibility is graded as follows.

Good: Wax particles are uniformly dispersed

Average: Wax particles are slightly unevenly dispersed

Poor: Wax particles are greatly unevenly dispersed (1-f) Overall Evaluation

Overall evaluation was performed considering the above evaluation results. Overall evaluation is graded as follows.

Very good

Good

Average

Poor

TABLE 2

| | Fixing device No. | Fixability: Low temperature fixability | Fixability: Hot offset resistance | Thermostable preserveability | Toner filming resistance | Image density | Wax dispersibility | Overall Evaluation |
|---|---|---|---|---|---|---|---|---|
| Ex. 1 | 1 | Very good | Good | Very good | Good | Good | Good | Good |
| Ex. 2 | 2 | Very good | Good | Very good | Good | Good | Good | Good |
| Ex. 3 | 1 | Good | Good | Very good | Good | Good | Good | Average |
| Ex. 4 | 2 | Average | Good | Very good | Good | Good | Good | Average |
| Ex. 5 | 1 | Very good | Good | Average | Average | Good | Average | Average |
| Ex. 6 | 1 | Very good | Good | Very good | Very good | Good | Good | Very good |
| Ex. 7 | 2 | Very good | Good | Very good | Very good | Good | Good | Very good |
| Ex. 8 | 1 | Good | Good | Very good | Very good | Good | Good | Good |
| Comp. Ex. 1 | 3 | Poor | Poor | Good | Poor | Good | Poor | Poor |

It is clear from Tables 1 and 2 that the toners prepared in Examples 1 to 8, each of which is prepared by emulsifying or dispersing a toner constituent mixture liquid in an aqueous medium, have good wax dispersibility and therefore a proper amount of wax particles exist on the surface thereof. Such toners have good releasability at low temperatures and good toner filming resistance, and a good combination of low temperature fixability and thermostable preservability. In addition, such toners can produce high quality images.

In contrast, in the toner prepared in Comparative Example 1, the wax having a carbonyl group was unevenly dispersed and therefore formation of toner film on image forming components (e.g., developing roller, photoreceptor) were observed. The toner of Comparative Example 1 has poor low temperature fixability and thermostable preservability, and cannot produce high quality images.

Example 9

Preparation of Particulate Resin (2)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were contained and the mixture was agitated with the stirrer for 30 minutes at a revolution of 3,800 rpm. As a result, a milky emulsion was prepared. Then the emulsion was heated to 75° C. to react the monomers for 4 hours.

Further, 30 parts of a 1% aqueous solution of ammonium persulfate were added thereto, and the mixture was aged for 6 hours at 75° C. Thus, an aqueous dispersion (2) (i.e., particle dispersion (2)) of a vinyl resin (2) (i.e., a copolymer of styrene/methacrylic acid/butyl acrylate/sodium salt of sulfate of ethylene oxide adduct of methacrylic acid) was prepared.

The particulate vinyl resin (2) had a volume average particle diameter of 110 nm determined by a particle size distribution analyzer NANOTRAC® UPA-150EX (manufactured by Nikkiso Co., Ltd.). A part of the particle dispersion (2) was dried to isolate the resin. The vinyl resin (2) had a glass transition temperature (Tg) of 58° C., and a weight average molecular weight (Mw) of 130,000.

Preparation of Water Phase (2)

990 parts of water, 37 parts of an aqueous solution of a sodium salt of dodecyldiphenyletherdisulfonic acid (ELEMINOL MON-7 from Sanyo Chemical Industries Ltd., solid content of 48.3%), 83 parts of the particle dispersion (2) prepared above, and 90 parts of ethyl acetate were mixed. As a result, a water phase (2) was prepared.

Preparation of Unmodified Polyester (2) (Low Molecular Weight Polyester (2))

The following components were fed in a reaction vessel equipped with a condenser, a stirrer and a nitrogen feed pipe.

Ethylene oxide (2 mole) adduct of

| | |
|---|---|
| bisphenol A | 724 parts |
| Terephthalic acid | 276 parts |

The mixture was reacted for 7 hours at 230° C. under normal pressure.

Then the reaction was further continued for 5 hours under a reduced pressure of 10 to 15 mmHg. Thus, a unmodified polyester (2) was prepared.

The unmodified polyester (2) had a number average molecular weight (Mn) of 2,300, a weight average molecular weight (Mw) of 6,700, a glass transition temperature (Tg) of 43° C., and an acid value of 4 mgKOH/g.

Preparation of Prepolymer (2)

The following components were fed in a reaction vessel equipped with a condenser, a stirrer and a nitrogen feed pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

The mixture was reacted for 7 hours at 230° C. under normal pressure.

Then the reaction was further continued for 5 hours under a reduced pressure of 10 to 15 mmHg. Thus, an intermediate polyester (2) was prepared.

The intermediate polyester (2) had a number average molecular weight (Mn) of 2,200, a weight average molecular weight (Mw) of 9,700, a peak molecular weight of 3,000, a glass transition temperature (Tg) of 54° C., an acid value of 0.5 mgKOH/g, and a hydroxyl value of 52 mgKOH/g.

In a reaction vessel equipped with a condenser, a stirrer and a nitrogen feed pipe, 410 parts of the intermediate polyester (2), 89 parts of isophorone diisocyanate, and 500 parts of ethyl acetate were mixed and the mixture was heated for 5 hours at 100° C. to perform the reaction. Thus, a polyester prepolymer (2) having an isocyanate group was prepared. A content of free isocyanate in the prepolymer (2) was 1.53% by weight.

Synthesis of Ketimine (2) (Compound Having Active Hydrogen Group)

In a reaction vessel equipped with a stirrer and a thermometer, 170 parts of isophorone diamine and 75 parts of methyl ethyl ketone were mixed and reacted for 4.5 hours at 50° C. to prepare a ketimine compound (2) (i.e., a compound having an active hydrogen group). The ketimine compound (2) had an amine value of 417 mgKOH/g.

Preparation of Master Batch (2)

The following components were mixed with HENSCHEL MIXER (manufactured by Mitsui Mining Co., Ltd.).

| | |
|---|---|
| Water | 1200 parts |
| Carbon black (PRINTEX 35 from Degussa AG, DBP absorption value of 42 ml/100 g, pH of 9.5) | 540 parts |
| Unmodified polyester resin (2) | 1200 parts |

The mixture was kneaded for 1 hour at 130° C. with a two-roll mill, and then subjected to rolling and cooling. The rolled mixture was pulverized using a pulverizer (manufactured by Hosokawa Micron Corporation). Thus, a master batch (2) was prepared.

Preparation Wax/Colorant Dispersion (2)

In a reaction vessel equipped with a stirrer and a thermometer, 378 parts of the unmodified polyester (2), 110 parts of a paraffin wax B (having a melting point of 68° C.), and 947 parts of ethyl acetate were mixed and the mixture was heated to 80° C. while agitated. After being heated at 80° C. for 5 hours, the mixture was cooled to 30° C. over 1 hour. Then 500 parts of the master batch (2) and 500 parts of ethyl acetate were added to the vessel, and the mixture was agitated for 1 hour to prepare a raw material dispersion (2).

Then 1324 parts of the raw material dispersion (2) was subjected to a dispersion treatment using a bead mill (ULTRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Then 1324 parts of a 65% ethyl acetate solution of the unmodified polyester (2) were added thereto. The mixture was subjected to the dispersion treatment using the bead mill. The dispersion conditions are the same as those mentioned above except that the dispersion operation was performed twice (i.e., 2 passes).

Thus, a wax/colorant dispersion (2) was prepared. The solid content of the wax/colorant dispersion (2) was 50%.

Emulsification

Then the following components were mixed in a vessel.

| | |
|---|---|
| Wax/colorant dispersion (2) prepared above | 749 parts |
| Prepolymer (2) prepared above | 115 parts |
| Ketimine compound (2) prepared above | 2.9 parts |

The components were mixed for 2 minutes using a mixer TK HOMOMIXER (trademark) from Tokushu Kika Kogyo K.K. at a revolution of 5,000 rpm. Thus, a toner constituent mixture liquid (2) was prepared.

Then 1200 parts of the water phase (2) were added thereto. The mixture was agitated for 25 minutes with a mixer TK HOMOMIXER (trademark) at a revolution of 13,000 rpm. As a result, an emulsion slurry (2) was prepared.

Solvent Removal

The emulsion slurry (2) was fed into a container equipped with a stirrer and a thermometer, and the emulsion slurry (2) was heated for 7 hours at 30° C. to remove the organic solvent (ethyl acetate) therefrom. Then the emulsion slurry (2) was aged for 7 hours at 45° C. Thus, a dispersion slurry (2) was prepared.

Washing and Drying

One hundred (100) parts of the dispersion slurry (1) were filtered under a reduced pressure.

The thus obtained wet cake was mixed with 100 parts of ion-exchange water and the mixture was agitated for 10 minutes with a TK HOMOMIXER at a revolution of 12,000 rpm, followed by filtering. Thus, a wet cake (i) was prepared.

The wet cake (i) was mixed with 100 parts of a 10% aqueous solution of sodium hydroxide and the mixture was agitated for 10 minutes with a TK HOMOMIXER at a revolution of 12,000 rpm, followed by filtering under a reduced pressure. Thus, a wet cake (ii) was prepared.

The wet cake (ii) was mixed with 100 parts of a 10% aqueous solution of hydrochloric acid and the mixture was agitated for 10 minutes with a TK HOMOMIXER at a revolution of 12,000 rpm, followed by filtering. Thus, a wet cake (iii) was prepared.

The wet cake (iii) was mixed with 300 parts of ion-exchange water and the mixture was agitated for 10 minutes with a TK HOMOMIXER at a revolution of 12,000 rpm, followed by filtering. This washing operation was performed twice. Thus, a wet cake (iv) was prepared.

The wet cake (iv) was dried for 48 hours at 45° C. using a circulating air drier, followed by sieving with a screen having openings of 75 μm. Thus, a mother toner (9) was prepared.

One hundred (100) parts of the prepared mother toner (9) were mixed with 1 part of a hydrophobized silica and 1 part of a hydrophobized titanium oxide using a HENSHEL MIXER (manufactured by Mitsui Mining Co., Ltd.). Thus, a toner (9) was prepared.

Example 10

The procedure for preparation of the toner (9) in Example 9 was repeated except that 20 parts of a styrene-polyethylene polymer (having a Tg of 72° C. and a number average molecular weight of 7,100), serving as a wax dispersing agent, were added to the wax/colorant dispersion (2). Thus, a toner (10) was prepared.

Example 11

The procedure for preparation of the toner (9) in Example 9 was repeated except that the wax/colorant dispersion (2) was replaced with a wax/colorant dispersion (3) which was prepared as follows. Thus, a toner (11) was prepared.

Preparation Wax/Colorant Dispersion (3)

In a reaction vessel equipped with a stirrer and a thermometer, 378 parts of the unmodified polyester (2), 400 parts of a paraffin wax B (having a melting point of 68° C.), and 947 parts of ethyl acetate were mixed and the mixture was heated to 80° C. while agitated. After being heated at 80° C. for 4 hours, the mixture was cooled to 30° C. over 1 hour. Then 500 parts of the master batch (2) and 500 parts of ethyl acetate were added to the vessel, and the mixture was agitated for 2 hours to prepare a raw material dispersion (3).

Then 1324 parts of the raw material dispersion (3) were subjected to a dispersion treatment using a bead mill (ULTRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 7 times (7 passes)

Then 1324 parts of a 65% ethyl acetate solution of the unmodified polyester (2) were added thereto. The mixture was subjected to the dispersion treatment using the bead mill. The dispersion conditions are the same as those mentioned above except that the dispersion operation was performed 4 times (i.e., 4 passes).

Thus, a wax/colorant dispersion (3) was prepared. The solid content of the wax/colorant dispersion (3) was 50%.

Example 12

The procedure for preparation of the toner (9) in Example 9 was repeated except that the wax/colorant dispersion (2) was replaced with a wax/colorant dispersion (4) which was prepared as follows. Thus, a toner (12) was prepared.

Preparation Wax/Colorant Dispersion (4)

In a reaction vessel equipped with a stirrer and a thermometer, 378 parts of the unmodified polyester (2), 100 parts of a polyethylene wax (having a melting point of 68° C.), and 947 parts of ethyl acetate were mixed and the mixture was heated to 80° C. while agitated. After being heated at 80° C. for 5 hours, the mixture was cooled to 30° C. over 1 hour. Then 500 parts of the master batch (2) and 500 parts of ethyl acetate were added to the vessel, and the mixture was agitated for 1 hour to prepare a raw material dispersion (4).

Then 1324 parts of the raw material dispersion (3) were subjected to a dispersion treatment using a bead mill (ULTRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 7 times (7 passes)

Then 1324 parts of a 65% ethyl acetate solution of the unmodified polyester (2) were added thereto. The mixture was subjected to the dispersion treatment using the bead mill. The dispersion conditions are the same as those mentioned above except that the dispersion operation was performed 4 times (i.e., 4 passes).

Thus, a wax/colorant dispersion (4) was prepared. The solid content of the wax/colorant dispersion (4) was 50%.

Comparative Example 2

The procedure for preparation of the toner (9) in Example 9 was repeated except that the wax/colorant dispersion (2) was replaced with a wax/colorant dispersion (5) which was prepared as follows. Thus, a toner (C2) was prepared.

Preparation Wax/Colorant Dispersion (5)

In a reaction vessel equipped with a stirrer and a thermometer, 378 parts of the unmodified polyester (2), 400 parts of a carnauba wax, and 947 parts of ethyl acetate were mixed and the mixture was heated to 80° C. while agitated. After being heated at 80° C. for 5 hours, the mixture was cooled to 30° C. over 1 hour. Then 500 parts of the master batch (2) and 500 parts of ethyl acetate were added to the vessel, and the mixture was agitated for 1 hour to prepare a raw material dispersion (5).

Then 1324 parts of the raw material dispersion (5) were subjected to a dispersion treatment using a bead mill (UL- TRAVISCOMILL (trademark) from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 7 times (7 passes)

Then 1324 parts of a 65% ethyl acetate solution of the unmodified polyester (2) were added thereto. The mixture was subjected to the dispersion treatment using the bead mill. The dispersion conditions are the same as those mentioned above except that the dispersion operation was performed 4 times (i.e., 4 passes).

Thus, a wax/colorant dispersion (5) was prepared. The solid content of the wax/colorant dispersion (5) was 50%.

Toner properties of the prepared toners (9) to (12) and (C2) are shown in Table 3.

TABLE 3

| | Total wax (%) | Surface wax (%) | Toner shape r2/r1 | Toner shape r3/r2 | Particle diameter Dv (μm) | Particle diameter Dn (μm) | Dv/Dn |
|---|---|---|---|---|---|---|---|
| Ex. 9 | 3.7 | 1.7 | 0.8 | 0.9 | 4.8 | 4.2 | 1.14 |
| Ex. 10 | 3.6 | 0.98 | 0.6 | 0.8 | 5.3 | 4.6 | 1.15 |
| Ex. 11 | 6.5 | 1.8 | 0.6 | 0.8 | 5.4 | 4.6 | 1.17 |
| Ex. 12 | 4.0 | 1.9 | 0.7 | 0.8 | 5.0 | 4.2 | 1.19 |
| Comp. Ex. 2 | 6.5 | 4.5 | 0.6 | 0.8 | 5.1 | 4.4 | 1.16 |

Preparation of Carrier for Two-component Developer

The following components were mixed with a stirrer for 10 minutes to prepare a coating liquid.

| | |
|---|---|
| Toluene | 450 parts |
| Silicone resin (SR2400 from Dow Corning Toray Co., Ltd., including 50% of nonvolatile components) | 450 parts |
| Aminosilane (SH6020 from Dow Corning Toray Co., Ltd.) | 10 parts |
| Carbon black | 10 parts |

The thus prepared coating liquid and 5,000 parts of a core (Cu—Zn ferrite having a weight average particle diameter of 35 μm) were put in a coating device, in which a rotatable baseplate disk and an agitation blade is arranged in a fluidized bed to form a rotational flow, so that the coating liquid was applied onto the core. The coated core was calcined in an electric furnace for 2 hours at 250° C. Thus, a carrier covered with a silicone resin layer having an average thickness of 0.5 μm was prepared.

Preparation of Two-component Developer

One hundred (100) parts of the carrier prepared above and 7 parts of each of the toners prepared in Examples 9 to 12 and Comparative Example 2 were mixed using a TURBLER MIXER (in which a sample container rolls so that the sample is agitated) to prepare a developer.

Preparation of Fixing Belt (3)

A primer (DY39-067 from Dow Corning Toray Co., Ltd.) was spray-coated on an endless film substrate made of a polyimide, which has a thickness of 90 μm and a cylindrical shape, to form a layer thereof having a thickness of 4 μm, and then the layer was dried at room temperature.

Next, a two-component addition cure liquid silicone rubber (DY35-2083 from Dow Corning Toray Co., Ltd.) was diluted with toluene after mixing two components thereof. The mixture liquid was spray-coated on the primer layer prepared above to form a layer thereof having a thickness of 200 μm, and then the layer (i.e., silicone rubber) was subjected to primary curing for 10 minutes at 120° C. and secondary curing for 4 hours at 200° C. Thus, an elastic layer was prepared.

Next, a primer (PR-990CL from Du Pont-Mitsui Fluorochemicals Company Ltd.) was spray-coated thereon to form a layer thereof having a thickness of 4 μm, and then the layer was dried for 30 minutes at 150° C. A mixture dispersion, in which a PFA (PFA-950HP PLUS from Du Pont-Mitsui Fluorochemicals Company Ltd.) having an average particle diameter of 10 μm and a MFR of 2 g/10 min and another PFA (PFA-945HP PLUS from Du Pont-Mitsui Fluorochemicals Company Ltd.) having an average particle diameter of 0.1 μm and a MFR of 7 g/10 min were mixed at a mixing ratio of 1/1, was spray coated thereon to form a layer thereof having a thickness of 30 μm. (MFR was measured at a temperature of 372° C. and a load of 5 kgf, based on a legal standard JIS K 7210.) The layer was subjected to a heat treatment (i.e., PFA particles were melted) for 30 minutes at 340° C., to form a release layer.

Thus, a fixing belt (3) was prepared.

Preparation of Fixing Belt (4)

The procedure for preparation of the elastic layer mentioned above was repeated.

A mixture dispersion, in which a PFA having an average particle diameter of 10 μm and a MFR of 7 g/10 min and another PFA (PFA-945HP PLUS from Du Pont-Mitsui Fluorochemicals Company Ltd.) having an average particle diameter of 0.1 μm and a MFR of 7 g/10 min were mixed at a mixing ratio of 1/1, was spray coated on the elastic layer to form a layer thereof having a thickness of 30 μm. (MFR was measured at a temperature of 372° C. and a load of 5 kgf, based on a legal standard JIS K 7210.) The layer was subjected to a heat treatment (i.e., PFA particles were melted) for 30 minutes at 340° C., to form a release layer.

Thus, a fixing belt (4) was prepared.

Preparation of Fixing Device (4)

The fixing belt (3) and a fixing roller having a curvature radius of 3.0 mm were set in the fixing device 40 illustrated in FIG. 8. Thus, a fixing device (4) was prepared.

Preparation of Fixing Device (5)

The fixing belt (4) and a fixing roller having a curvature radius of 3.0 mm were set in the fixing device 40 illustrated in FIG. 8. Thus, a fixing device (5) was prepared.

Preparation of Fixing Device (6)

The fixing belt (4) and a fixing roller having a curvature radius of 8.0 mm were set in the fixing device 40 illustrated in FIG. 8. Thus, a fixing device (6) was prepared.

Evaluations were performed on the prepared developers as follows. The results are shown in Table 4.

(2-a) Fixability (Hot Offset Resistance and Low Temperature Fixability)

Hot offset resistance was evaluated by the maximum fixable temperature. Solid images having 0.9 to 1.1 mg/cm$^2$ of a toner thereon were produced on a transfer paper TYPE 6200 (from Ricoh Co., Ltd.). The solid images on transfer papers were fixed with a fixing device described in Table 4 at various temperatures to determine the maximum fixable temperature above which the hot offset occurs.

Low temperature fixability was evaluated by the minimum fixable temperature. Solid images having 0.9 to 1.1 mg/cm2 of a toner thereon were produced on a copy paper 135 (from NBS Ricoh Co., Ltd.). The solid images on papers were fixed with a fixing device described in Table 4 at various temperatures to determine the minimum fixable temperature below which the residual rate of the image density was less than 70% when the fixed image was rubbed with a pad.

A toner having a maximum fixable temperature of 200° C. or more and a minimum fixable temperature of 130° C. or less is considered to have good fixability.

(2-b) Durability (Fixing Belt Stability)

A running test in which 300,000 copies were continuously produced was performed using a fixing device described in Table 4. After the running test, the release layer of the fixing belt was visually observed whether cracks appear or not. Durability is graded as follows.

Good: No cracks were observed

Average: A few cracks were observed but no abnormal images were produced

Poor: Cracks were observed and abnormal images were produced (2-c) Toner Filming Resistance A developer was set in a full-color electrophotographic apparatus IPSIO COLOR 8100 (manufactured by Ricoh Co., Ltd), and then a running test in which 50,000 copies were continuously produced was performed. After the running test, the developing roller and the photoreceptor were visually observed whether toner films were formed thereon. Toner filming resistance is graded as follows.

Very good: No toner film was observed

Good: Few linear toner films were observed

Average: Linear toner films were partially observed

Poor: Toner films were observed all over the developing roller and/or the photoreceptor (2-d) Charging Stability A developer was set in a modified full-color electrophotographic apparatus IPSIO COLOR 8100 (manufactured and modified by Ricoh Co., Ltd) utilizing an oilless fixing method, and then a running test in which 100,000 images having an image proportion of 5% were continuously produced was performed. The charge quantity of 1 g of the developer was measured by a blow-off method before and after the running test, and a difference therebetween was calculated. Charging stability is graded as follows.

Good: Charge quantity difference was 5 μC/g or less

Average: Charge quantity difference was 10 μC/g or less

Poor: Charge quantity difference was larger than 10 μC/g (2-e) Image Density

A toner was set in a modified electrophotographic apparatus IMAGIO NEO 450 (manufactured and modified by Ricoh Co., Ltd) utilizing a belt fixing method, and then a solid image having 0.3 to 0.5 mg/cm$^2$ of a toner thereon was produced on a transfer paper TYPE 6200 (from Ricoh Co., Ltd.). The image density of the produced solid image was measured with a spectrodensitometer X-RITE 938 (from X-rite Inc.). The image density is graded as follows.

Good: Image density was 1.4 or more

Poor: Image density was less than 1.4

(2-f) Environmental Preservability (Toner Blocking Resistance)

At first, a 20 ml glass container was filled with 10 g of a toner, and then the glass container containing the toner was tapped for 100 times. Then the container was put in a thermostatic chamber for 24 hours at 50° C. and 80% RH (i.e., high temperature and high humidity condition), and then the toner was subjected to a penetration test. The same penetration test was performed on the toner which was preserved at 10° C. and 15% RH (i.e., low temperature and low humidity condition) in the same manner. Environmental preservability was evaluated by penetration, among which was smaller, and is graded as follows.

Very good: Penetration is 20 mm or more

Good: Penetration is 15 mm or more and less than 20 mm

Average: Penetration is 10 mm or more and less than 15 mm

Poor: Penetration is less than 10 mm (2-g) Fixing Contamination

A developer was set in a modified full-color electrophotographic apparatus IPSIO COLOR 8100 (manufactured and modified by Ricoh Co., Ltd) utilizing an oilless fixing method, and then a running test in which 100,000 images having an image proportion of 5% were continuously produced was performed. After the running test, produced images were visually observed whether offset components, which were once adhered to the fixing belt, were retransferred onto the produced images. Fixing contamination is graded as follows.

Good: No contamination was observed.

Average: 1 to 2 contaminations were observed per paper.

Poor: Contaminations were greatly observed. Not suitable for practical use.

(2-h) Wax Dispersibility

Wax dispersibility was evaluated by visually observing a cross section of a toner with a transmission electron microscope (TEM). Wax dispersibility is graded as follows.

Good: At least two wax particles were uniformly (not unevenly) dispersed in one toner particle.

Poor: Not in the above condition.

(2-i) Overall Evaluation

Overall evaluation was performed considering the above evaluation results. Overall evaluation is graded as follows.

Very good

Good

Average

Poor

TABLE 4

| | Fixing device No. | Fixability: Minimum fixable temperature (° C.) | Fixability: Maximum fixable temperature (° C.) | Durability | Toner filming resistance | Charging stability |
|---|---|---|---|---|---|---|
| Ex. 9 | 4 | 120 | 210 | Good | Good | Good |
| | 6 | 125 | 190 | Average | Good | Good |
| Ex. 10 | 4 | 125 | 200 | Good | Good | Good |
| Ex. 11 | 4 | 125 | 200 | Good | Average | Good |
| Ex. 12 | 4 | 125 | 200 | Good | Good | Good |
| Comp. Ex. 2 | 5 | 130 | 180 | Poor | Poor | Poor |

TABLE 4-continued

| | Fixing device No. | Image density | Environmental perservability | Fixing contamination | Wax dispersibility | Overall Evaluation |
|---|---|---|---|---|---|---|
| Ex. 9 | 4 | Good | Very Good | Good | Good | Very good |
| | 6 | Good | Very Good | Good | Good | Average |
| Ex. 10 | 4 | Good | Very Good | Good | Good | Good |
| Ex. 11 | 4 | Good | Very Good | Good | Good | Average |
| Ex. 12 | 4 | Good | Very Good | Good | Good | Good |
| Comp. Ex. 2 | 5 | Good | Good | Good | Good | Poor |

This document claims priority and contains subject matter related to Japanese Patent Application No.2005-267942, filed on Sep. 15, 2005, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a binder resin; and a wax consisting essentially of C—H and C—C bonds, and having a melting point of 50 to 90° C., wherein the wax is present, in a surface portion ranging from an outermost surface of the toner to a depth of 0.3 μm, in an amount of from 0.1 to 4.0% by weight, which is determined by Fourier transform infrared spectroscopy attenuated total reflectance (FTIR-ATR);

wherein the toner comprises the wax in an amount of from 0.5% to 4.0% by weight, which is determined by differential scanning calorimetry (DSC), wherein the toner is manufactured by a method comprising emulsifying or dispersing a toner constituent mixture liquid comprising a dispersion of the wax, in an aqueous medium, and wherein the wax has a volume average particle diameter of from 0.1 to 2 μm in the toner constituent mixture liquid.

2. The toner according to claim 1, wherein the wax is at least one member selected from the group consisting of a paraffin wax, a polyethylene wax, and a polypropylene wax.

3. The toner according to claim 1, wherein the toner manufacturing method further comprises: dissolving or dispersing a toner constituent mixture comprising the wax in an oily medium comprising an organic solvent to prepare the toner constituent mixture liquid; and optionally removing the organic solvent.

4. The toner according to claim 1, wherein the toner constituent mixture liquid further comprises a compound having an active hydrogen group and a polymer capable of reacting with the active hydrogen group, and wherein the toner manufacturing method further comprises:

subjecting the compound having an active hydrogen group and the polymer capable of reacting with the active hydrogen to a reaction to prepare the binder resin, when the toner constituent mixture liquid is emulsified or dispersed in the aqueous medium.

5. The toner according to claim 1, wherein the toner constituent mixture liquid further comprises a polyester resin.

6. The toner according to claim 1, wherein the toner has a ratio (Dv/Dn) between a volume average particle diameter (Dv) and a number average particle diameter (Dn) of from 1.00 to 1.25.

7. The toner according to claim 1, wherein the toner has a volume average particle diameter (Dv) of from 3 to 9 μm.

8. A developer, comprising a carrier and the toner according to claim 1.

9. An image forming method, comprising:

forming an electrostatic latent image on an image bearing member;

developing the electrostatic latent image with a toner to form a toner image;

transferring the toner image onto a recording medium; and passing the recording medium bearing the toner image thereon through a nip formed between a fixing belt and a pressing roller to fix the toner image onto the recording medium, wherein the toner is the toner according to claim 1.

10. The image forming method according to claim 9, wherein the fixing belt is directly or indirectly heated by induction heating.

11. An image forming method, comprising:

forming an electrostatic latent image on an image bearing member;

developing the electrostatic latent image with a toner to form a toner image;

transferring the toner image onto a recording medium; and contacting the toner image on the recording medium with a heated fixing member, a surface of which comprises two or more fluorocarbon resins having different melt flow rates to fix the toner image onto the recording medium, wherein the toner is the toner according to claim 1.

12. An image forming apparatus, comprising:

an image bearing member configured to form an electrostatic latent image thereon;

a developing device comprising a toner that is configured to develop the electrostatic latent image with said toner to form a toner image;

a transfer device configured to transfer the toner image onto a recording medium; and a fixing device configured to fix the toner image onto the recording medium, wherein the fixing device comprises: a fixing roller;

a facing roller arranged in parallel with the fixing roller;

an endless fixing belt tightly stretched with the fixing roller and the facing roller;

an induction heating means for heating the fixing belt or the facing roller by electromagnetic induction; and a pressing roller configured to press the fixing roller with the fixing belt therebetween, wherein the toner image is fixed on the recording medium by passing through a nip formed between the fixing belt and the pressing roller, wherein either the fixing belt or the facing roller consists essentially of a non-magnetic material, and the induction heating means heats the fixing belt when the facing roller consists essentially of a non-magnetic material, or the facing roller when the fixing belt consists essentially of a non-magnetic material, wherein the toner is the toner according to claim 1.

13. The image forming apparatus according to claim 12, wherein the fixing belt comprises a magnetic shunt material when the facing roller consists essentially of a non-magnetic material, or the facing roller comprises a magnetic shunt material when the fixing belt consists essentially of a non-magnetic material, wherein the magnetic shunt material has a Curie point lower than a maximum fixable temperature of the toner above which the toner causes hot offset.

14. The image forming apparatus according to claim 12, wherein the facing roller comprises a cylindrical portion, wherein a wall thickness of the cylindrical portion in a central part is larger than that in an end part, in the axial direction of the facing roller.

15. An image forming apparatus, comprising:

an image bearing member configured to form an electrostatic latent image thereon;

a developing device comprising a toner that is configured to develop the electrostatic latent image with said toner to form a toner image;

a transfer device configured to transfer the toner image onto a recording medium; and a fixing device configured to fix the toner image onto the recording medium, wherein the fixing device comprises a fixing member configured to heat the toner image while contacting the toner image, said fixing member having a surface comprising two or more fluorocarbon resins having different melt flow rates, and wherein the toner is the toner according to claim 1.

16. A process cartridge detachably attachable to an image forming apparatus, comprising:

an image bearing member configured to bear an electrostatic latent image; and a developing device comprising a toner that is configured to develop the electrostatic latent image with a developer including said toner to form a toner image on the image bearing member, wherein the toner is the toner according to claim 1.

17. A toner container comprising the toner according to claim 1.

18. The toner according to claim 1, wherein said wax has a melting point of from 78 to 90° C.

19. The toner according to claim 1, wherein the toner comprises the wax in an amount of from 0.5% to 1.9% by weight, which is determined by differential scanning calorimetry (DSC).

20. A method of manufacturing toner, comprising:

emulsifying or dispersing a toner constituent mixture liquid comprising a dispersion of a wax in an aqueous medium, wherein the wax consists essentially of C—H and C—C bonds, and has a melting point of from 50 to 90° C., wherein the wax is present, in a surface portion ranging from an outermost surface of the toner to a depth of 0.3 μm, in an amount of from 0.1 to 4.0% by weight, which is determined by Fourier transform infrared spectroscopy attenuated total reflectance (FTIR-ATR), and wherein the toner comprises the wax in an amount of from 0.5% to 4.0% by weight, which is determined by differential scanning calorimetry (DSC).

21. The toner according to claim 1, wherein a ratio of wax present at a surface portion of the toner and the total wax present in said toner is from 0.43 to 0.95.

22. The toner according to claim 1, wherein the toner has a ratio (Dv/Dn) between a volume average particle diameter (Dv) and a number average particle diameter (Dn) of from 1.00 to 1.14.

* * * * *